US008690676B2

(12) United States Patent
Taniguchi et al.

(10) Patent No.: US 8,690,676 B2
(45) Date of Patent: Apr. 8, 2014

(54) GAME MACHINE

(71) Applicant: Kyoraku Industrial Co., Ltd., Nagoya (JP)

(72) Inventors: Masayuki Taniguchi, Nagoya (JP); Naoyuki Watanabe, Nagoya (JP)

(73) Assignee: Kyoraku Industrial Co., Ltd., Nagoya-shi (JP)

( * ) Notice: Subject to any disclaimer, the term of this patent is extended or adjusted under 35 U.S.C. 154(b) by 0 days.

(21) Appl. No.: 13/691,013

(22) Filed: Nov. 30, 2012

(65) Prior Publication Data

US 2013/0143665 A1 Jun. 6, 2013

(30) Foreign Application Priority Data

Dec. 2, 2011 (JP) ..... 2011-264293
Dec. 2, 2011 (JP) ..... 2011-264294

(51) Int. Cl.
*A63F 9/24* (2006.01)

(52) U.S. Cl.
USPC ..... 463/37; 463/46

(58) Field of Classification Search
USPC ..... 463/37, 38, 46
See application file for complete search history.

(56) References Cited

U.S. PATENT DOCUMENTS

2005/0059490 A1* 3/2005 Hedrick et al. ..... 463/37
2007/0111776 A1* 5/2007 Griswold et al. ..... 463/16
2008/0025785 A1* 1/2008 Ma et al. ..... 401/87

FOREIGN PATENT DOCUMENTS

JP 3989287 B2 10/2007
JP 2009-056085 3/2009

* cited by examiner

*Primary Examiner* — Dmitry Suhol
*Assistant Examiner* — Carl V Larsen
(74) *Attorney, Agent, or Firm* — Oblon, Spivak, McClelland, Maier & Neustadt, L.L.P.

(57) ABSTRACT

A game machine includes: an entertainment button that can move up and down from a normal operation position to a protruding position; a display part that displays characters associated with a game; a character determining part that determines a character to be displayed on the display part; a movement determining part that determines whether or not to move the entertainment button from the normal operation position to the protruding position; a drive control part to move the entertainment button from the normal operation position to the protruding position, when the movement determining part determines to move the entertainment button from the normal operation position to the protruding position; a push operation detecting part that detects the entertainment button being pushed down; and an enabling determining part that determines, when the push operation detecting part detects the entertainment button being pushed, whether or not to enable the detected push operation.

7 Claims, 63 Drawing Sheets

FIRST ASSIGNED OBJECT DETERMINATION TABLE

| RANDOM NUMBER VALUES FOR BONUS GAME DETERMINATION (0~299) | RESULT OF BONUS GAME LOTTERY | PROBABILITY |
|---|---|---|
| 7 | JACKPOT | 1/300 |
| OTHERS | LOSS | 299/300 |

*FIG.32*

SECOND ASSIGNED OBJECT DETERMINATION TABLE

| RESULT OF BONUS GAME LOTTERY | RANDOM NUMBER VALUES FOR BONUS GAME SYMBOL (0~99) | DATA ON SPECIAL SYMBOL TO BE STOPPED | ASSIGNED OBJECT COMMAND | |
|---|---|---|---|---|
| | | | MODE | DATA |
| JACKPOT | 0~49 | 01 | E0H | 01H |
| | 50~54 | 02 | E0H | 02H |
| | 55~59 | 03 | E0H | 03H |
| | 60~99 | 04 | E0H | 04H |
| LOSS | — | 00 | E0H | 00H |

*FIG.33*

PRIZE DETERMINATION TABLE

| DATA ON SPECIAL SYMBOL TO BE STOPPED | ROUND NUMBER | ROUND NUMBER COMMAND | |
|---|---|---|---|
| | | MODE | DATA |
| 01 | 16R | E1H | 01H |
| 02 | 10R | E1H | 02H |
| 03 | 8R | E1H | 03H |
| 04 | 4R | E1H | 04H |

*FIG.34*

A

FIRST MOVEMENT DETERMINATION TABLE

| ASSIGNED OBJECT DATA | RANDOM NUMBER VALUES FOR MOVEMENT DETERMINATION (0~99) | MOVEMENT DATA | CONTENTS |
|---|---|---|---|
| JACKPOT | 0~49(50%) | — | NOT MOVE |
| | 50~99(50%) | MOVEMENT | MOVE |
| LOSS | 0~98(100%) | — | NOT MOVE |
| | 99 (1%) | MOVEMENT | MOVE |

B

ECOND MOVEMENT DETERMINATION TABLE

| ROUND NUMBER DATA | RANDOM NUMBER VALUES FOR MOVEMENT DETERMINATION (0~99) | MOVEMENT DATA | CONTENTS |
|---|---|---|---|
| 16R | 0~49(50%) | — | NOT MOVE |
| | 50~99(50%) | MOVEMENT | MOVE |
| 10R | 0~74(75%) | — | NOT MOVE |
| | 75~99(25%) | MOVEMENT | MOVE |
| 8R | 0~99(100%) | — | NOT MOVE |
| 4R | 0~99(100%) | — | NOT MOVE |

*FIG.35*

A

FIRST PROTRUDING MANNER DETERMINATION TABLE

| ASSIGNED OBJECT DATA | RANDOM NUMBER VALUES FOR PROTRUSION (0～99) | PROTRUDING MANNER DATA | CONTENTS |
|---|---|---|---|
| JACKPOT | 0～39(40%) | PROTRUDING MANNER 1 | MOVEMENT IN II DIRECTION |
| | 40～79(40%) | PROTRUDING MANNER 2 | MOVEMENT IN I DIRECTION AT A CONSTANT RATE |
| | 80～99(20%) | PROTRUDING MANNER 3 | SPECIAL MOVEMENT IN I DIRECTION |
| LOSS | 0～89(90%) | PROTRUDING MANNER 1 | MOVEMENT IN II DIRECTION |
| | 90～99(10%) | PROTRUDING MANNER 2 | MOVEMENT IN I DIRECTION AT A CONSTANT RATE |

B

SECOND PROTRUDING MANNER DETERMINATION TABLE

| ROUND NUMBER DATA | RANDOM NUMBER VALUES FOR PROTRUSION (0～99) | PROTRUDING MANNER DATA | CONTENTS |
|---|---|---|---|
| 16R | 0～39(40%) | PROTRUDING MANNER 1 | MOVEMENT IN II DIRECTION |
| | 40～79(40%) | PROTRUDING MANNER 2 | MOVEMENT IN I DIRECTION AT A CONSTANT RATE |
| | 80～99(20%) | PROTRUDING MANNER 3 | SPECIAL MOVEMENT IN I DIRECTION |
| 10R | 0～89(90%) | PROTRUDING MANNER 1 | MOVEMENT IN II DIRECTION |
| | 90～99(10%) | PROTRUDING MANNER 2 | MOVEMENT IN I DIRECTION AT A CONSTANT RATE |

*FIG.36*

FIRST REGULAR CHARACTER DETERMINATION TABLE

A

| ASSIGNED OBJECT DATA | CHARACTER DATA | CONTENTS OF ENTERTAINMENT |
|---|---|---|
| JACKPOT | CHARACTER 02 | DISPLAY FIRST ASSIGNED OBJECT SYMBOL IN SECOND DISPLAY MANNER |
| LOSS | CHARACTER 05 | DISPLAY SECOND ASSIGNED OBJECT SYMBOL IN SECOND DISPLAY MANNER |

FIRST SPECIAL CHARACTER DETERMINATION TABLE

B

| ASSIGNED OBJECT DATA | TIME INTERVAL (ms) | CHARACTER DATA | CONTENTS OF ENTERTAINMENT |
|---|---|---|---|
| JACKPOT | 1～99 | CHARACTER 01 | DISPLAY FIRST ASSIGNED OBJECT SYMBOL IN FIRST DISPLAY MANNER |
| | 100～500 | CHARACTER 02 | DISPLAY FIRST ASSIGNED OBJECT SYMBOL IN SECOND DISPLAY MANNER |
| | 501 OR MORE | CHARACTER 03 | DISPLAY FIRST ASSIGNED OBJECT SYMBOL IN THIRD DISPLAY MANNER |
| LOSS | 1～200 | CHARACTER 04 | DISPLAY SECOND ASSIGNED OBJECT SYMBOL IN FIRST DISPLAY MANNER |
| | 201～999 | CHARACTER 05 | DISPLAY SECOND ASSIGNED OBJECT SYMBOL IN SECOND DISPLAY MANNER |
| | 1000 OR MORE | CHARACTER 06 | DISPLAY SECOND ASSIGNED OBJECT SYMBOL IN THIRD DISPLAY MANNER |

SECOND REGULAR CHARACTER DETERMINATION TABLE

C

| ROUND NUMBER DATA | CHARACTER DATA | CONTENTS OF ENTERTAINMENT |
|---|---|---|
| 16R | CHARACTER 12 | DISPLAY "16R" IN SECOND DISPLAY MANNER |
| 10R | CHARACTER 15 | DISPLAY "10R" IN SECOND DISPLAY MANNER |
| 8R | CHARACTER 18 | DISPLAY "8R" IN SECOND DISPLAY MANNER |
| 4R | CHARACTER 21 | DISPLAY "4R" IN SECOND DISPLAY MANNER |

SECOND SPECIAL CHARACTER DETERMINATION TABLE

D

| ROUND NUMBER DATA | TIME INTERVAL (ms) | CHARACTER DATA | CONTENTS OF ENTERTAINMENT |
|---|---|---|---|
| 16R | 1～99 | CHARACTER 11 | DISPLAY "16R" IN FIRST DISPLAY MANNER |
| | 100～500 | CHARACTER 12 | DISPLAY "16R" IN SECOND DISPLAY MANNER |
| | 501 OR MORE | CHARACTER 13 | DISPLAY "16R" IN THIRD DISPLAY MANNER |
| 10R | 1～200 | CHARACTER 14 | DISPLAY "10R" IN FIRST DISPLAY MANNER |
| | 201～999 | CHARACTER 15 | DISPLAY "10R" IN SECOND DISPLAY MANNER |
| | 1000 OR MORE | CHARACTER 16 | DISPLAY "10R" IN THIRD DISPLAY MANNER |
| 8R | 1～99 | CHARACTER 17 | DISPLAY "8R" IN FIRST DISPLAY MANNER |
| | 100～500 | CHARACTER 18 | DISPLAY "8R" IN SECOND DISPLAY MANNER |
| | 501 OR MORE | CHARACTER 19 | DISPLAY "8R" IN THIRD DISPLAY MANNER |
| 4R | 1～200 | CHARACTER 20 | DISPLAY "4R" IN FIRST DISPLAY MANNER |
| | 201～999 | CHARACTER 21 | DISPLAY "4R" IN SECOND DISPLAY MANNER |
| | 1000 OR MORE | CHARACTER 22 | DISPLAY "4R" IN THIRD DISPLAY MANNER |

*FIG.37*

GAME MACHINE

CROSS-REFERENCES TO RELATED APPLICATIONS

This application claims the prize of Japanese Patent Applications No. 2011-264293 filed Dec. 2, 2011 and No. 2011-264294 filed Dec. 2, 2011 which are incorporated herein by reference.

BACKGROUND

1. Technical Field

The present invention relates to an entertainment button device and a game machine, and more specifically to an entertainment button device having a button-up-and-down mechanism to move an entertainment button up and down, and a game machine including the entertainment button.

2. Related Art

Conventionally, a pachinko game machine includes a frame body in which a game board is set, and an opening and closing body. The opening and closing body is supported to be able to open and close by the frame body and includes a transparent plate that covers the board surface of the game board in the closed position. A tray unit having an accumulating tray to accumulate playing balls is provided below the opening and closing body (below the transparent plate). In recent years, mainstream pachinko game machines include an entertainment button device. This entertainment button device has an entertainment button that the player can push, and is set in a tray unit, as disclosed in, for example, Japanese Patent No. 3989287, and Japanese Patent Application Laid-Open No. 2009-56085. The entertainment button device has a spring that biases the entertainment button to the moving-up direction, and is generally configured to push the entertainment button from the upper side of the tray unit.

This entertainment button device has a configuration where the entertainment button is fitted into a bottom hole formed in the upper end of the tray unit to be able to move up and down. In the normal operation position, the entertainment button is held to protrude upward from the tray unit. When the entertainment button is pushed from the normal operation position to the pushed position, and then is released from being pushed, it returns to the normal operation position and held in this position. When the button is pushed during a period of time in which the button can be operated, the push operation is detected, and therefore a specific entertainment in the game is performed. This enhances the player's sense of participation and improves the effect of the entertainment in the game.

Here, in order to improve the effect of the entertainment in a game, the applicants are developing an entertainment button for practical use, which moves from a normal operation position and a protruding position in which the entertainment button protruding upward from the normal operation position and can be accommodated in a button case.

In the entertainment button device disclosed in 3989287, the entertainment button moves between the normal operation position and the pushed position. The position in which the entertainment button is held is alternately switched between the normal operation position and the pushed position. Meanwhile, in the entertainment button device disclosed in 2009-56085, the entertainment button moves over the normal operation position, the pushed position and a protruding position in which the entertainment button protrudes much further than in the normal operation position. The position of the entertainment button is alternately switched between the normal operation position and the protruding position.

With the entertainment button device disclosed in 3989287, the button case is moved by the solenoid to allow the entertainment button to move between the normal operation position and the pushed position. Meanwhile, with the entertainment button disclosed in 2009-56085, the locking member is moved by the solenoid to allow the entertainment button to move between the normal operation position and the protruding position.

However, with the above-described related art, it is difficult to desirably move up and down the entertainment button, for example, the entertainment button is stopped temporarily at a predetermined position or moves up and down repeatedly, because the entertainment button is controlled through the solenoid to only move up and down between the two positions (between the normal operation position and the pushed position in 3989287; between the normal operation position and the protruding position in 2009-56085), which are the upper and lower limit positions to which the solenoid moves up and down.

Here, with a general entertainment button device, the entertainment button is small and has a short stroke of up-and-down movement. Therefore, even if the entertainment button moves up and down, the movement is less represented, and consequently is not much help to the improvement of the effect of the entertainment in a game. To solve this drawback, an approach is proposed to increase the size of the entertainment button to lengthen the stroke of up-and-down movement. However, a large solenoid is required to lengthen the stroke of the up-and-down movement. With such a large solenoid, the entertainment button is not likely to smoothly move between the above-described two positions. Moreover, there is another problem of the arrangement and the installation of the solenoid. The above-described problem in the control of the entertainment button to move up and down by the solenoid still remains.

SUMMARY

It is therefore, an object of the present invention to provide an entertainment button device and a game machine. The entertainment button device has a button-up-and-down mechanism to move an entertainment button up and down. This mechanism allows the entertainment button to smoothly and desirably move up and down.

According to a first aspect of the present invention, a game machine includes: an entertainment button configured to be able to move up and down from a normal operation position to a protruding position in which the entertainment button protrudes upward from the normal operation position; a display part configured to display characters associated with a game; a character determining part configured to determine a character to be displayed on the display part; a movement determining part configured to determine whether or not to move the entertainment button from the normal operation position to the protruding position; a drive control part configured to perform drive control to move the entertainment button from the normal operation position to the protruding position, when the movement determining part determines to move the entertainment button from the normal operation position to the protruding position; a push operation detecting part configured to detect the entertainment button being pushed down; and an enabling determining part configured to determine, when the push operation detecting part detects the entertainment button being pushed, whether or not to enable the detected push operation on the entertainment button. The enabling detecting part determines to disable the push operation on the entertainment button detected by the push operation detecting part before the entertainment button is held in the protruding position, when the movement determining part determines to move the entertainment button from the normal operation position to the protruding position. The character determining part determines a predetermined character when the push operation detecting part detects the entertainment button being pushed down and also the enabling determining part determines to enable the push operation on the entertainment button. When the character determining part determines the character, the display part displays the determined character.

According to a second aspect of the present invention, the game machine further includes: a stopper plate configured to hold the entertainment button in the protruding position; and a protruding position detecting part configured to detect the entertainment button being held in the protruding position by the stopper plate. When the movement determining part determines to move the entertainment button from the normal operation position to the protruding position, the enabling determining part determines to disable the push operation on the entertainment button which is detected by the push operation detecting part until the protruding position detecting part detects the entertainment button being held in the protruding position.

According to a third aspect of the present invention, the character determining part determines a character that is different from the predetermined character, when the protruding position detecting part detects the entertainment button being held in the protruding position.

According to a fourth aspect of the present invention, the game machine further includes: a button-up-and-down mechanism configured to move the entertainment button up and down from the normal operation position to the protruding position; and a base mounted on a lower part of the button-up-and-down mechanism. The button up-and-down mechanism includes: a cylindrical shaft member extending in a moving direction of the entertainment button; a rotating mechanism configured to rotate the shaft member; an annular member that can move between the stopper plate and the base, the entertainment button being attached to the annular member; and a bias member configured to bias the annular member to a direction in which the entertainment button moves up. A convex part having an inverted trapezoid shape and a concave part having a trapezoid shape are formed on the shaft member. A spiral guide part is formed at a boundary between the convex part and the concave part. The annular member has an engagement part configured to engage with the spiral guide part. When the rotating mechanism rotates the shaft member in a specific direction, the engagement part moves to an upper end of the shaft member, engaging with the spiral guide part, so that the entertainment button moves to the protruding position.

According to a fifth aspect of the present invention, the protruding position detecting part includes a first protruding position detecting part and a second protruding position detecting part. The first protruding position detecting part is provided on the stopper plate. The second protruding position detecting part is provided on the annular member. The protruding position detecting part detects the entertainment button being held in the protruding position when the first protruding position detecting part approaches the second protruding position detecting part.

According to a sixth aspect of the present invention, the push operation detecting part includes a first push operation detecting part and a second push operation detecting part. The first push operation detecting part is provided on the annular member. The second push operation detecting part is provided on the base. The push operation detecting part detects the entertainment button being pushed down when the first push operation detecting part approaches the second push operation detecting part.

With the entertainment button device and the game machine according to the present invention, it is possible to smoothly move the entertainment button up and down by means of the button-up-and-down mechanism, and therefore improve the effect of the entertainment in a game.

BRIEF DESCRIPTION OF THE DRAWINGS

FIG. 32 shows an exemplary first assigned object determination table;

FIG. 33 shows an exemplary second assigned object determination table;

FIG. 34 shows an exemplary prize determination table;

FIG. 35A shows a first movement determination table;

FIG. 35B shows a second movement determination table;

FIG. 36A shows a first protruding manner determination table;

FIG. 36B shows a second protruding manner determination table;

FIG. 37A shows a first regular character determination table;

FIG. 37B shows a first special character determination table;

FIG. 37C shows a second regular character determination table;

FIG. 37D shows a second special character determination table;

DESCRIPTION OF EXEMPLARY EMBODIMENTS

Now, a plurality of aspects of the present invention will be explained according to an embodiment.

Embodiment

Figure 1:
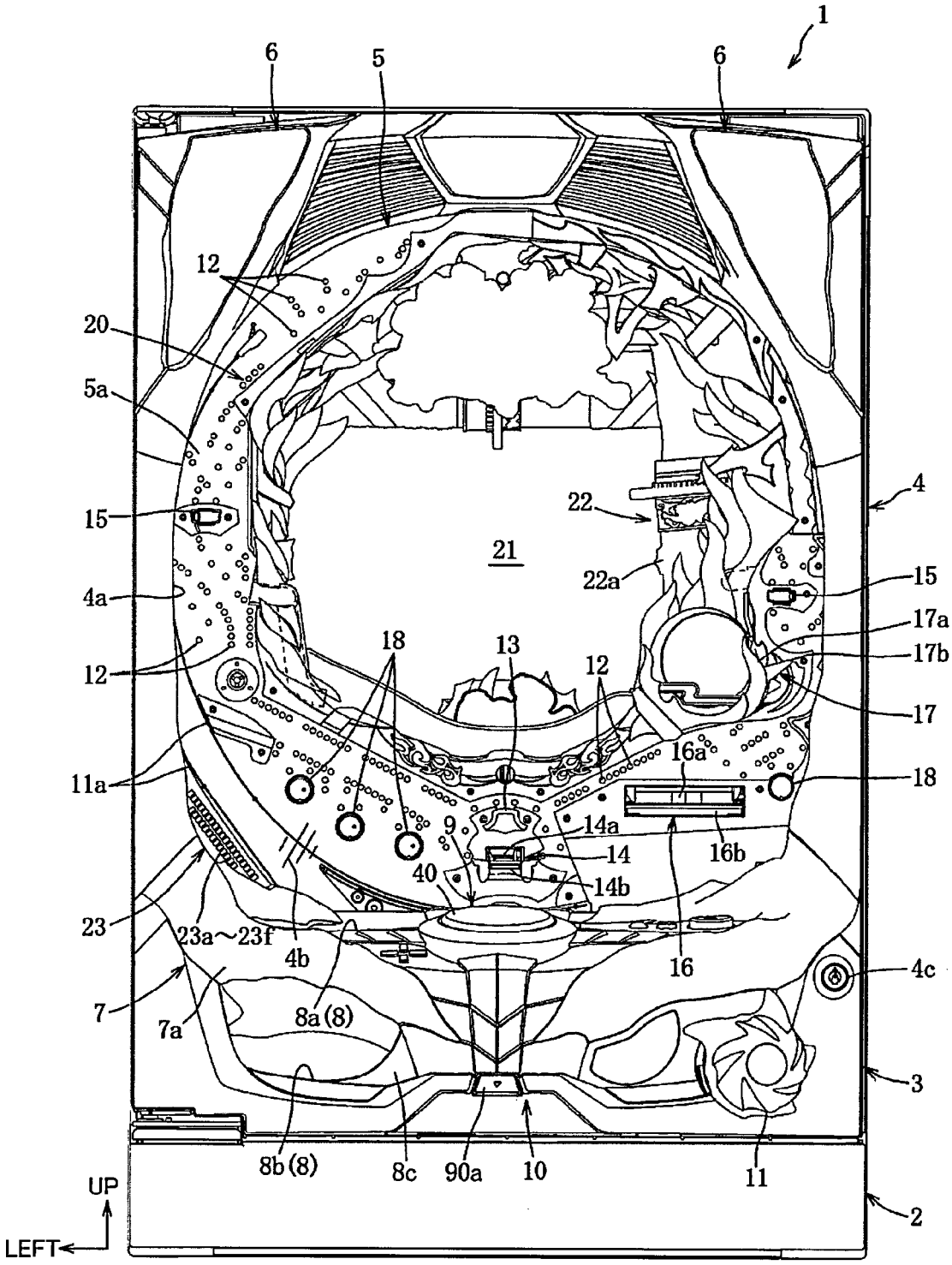
FIG. 1 is an exemplary front view showing a pachinko game machine according to an embodiment.

As shown in FIG. 1, a pachinko game machine 1 includes an outer frame 2, an opening and closing frame 3 (inner frame 3) and a door 4. The outer frame 2 is attached to a game machine array structure in a pachinko game parlor. The opening and closing frame 3 is mounted to the outer frame 2 to be able to open and close, and the door 4 is mounted to the opening and closing frame 3 to be able to open and close. A window 4*a* is formed in the door 4, and a transparent plate 4*b* is put in the window 4*a*. A game board 5 having a board surface in which playing balls are launched, is set in the opening and closing frame 3. A playfield 5*a* is formed between the board surface of the game board 5 and the transparent plate 4*b* in front of the game board 5*a*. The playfield 5*a* allows playing balls to cascade down. Here, the outer frame 2 and the opening and closing frame 3 serve, or only the opening and closing frame 3 serves as a frame part, and the door 4 serves as an opening and closing part.

The left end of the opening and closing frame 3 is supported at the left end of the outer frame 2 to be able to revolve around the vertical axis. The opening and closing frame 3 is locked to the outer frame 2 in a closed position. The left end of the door 4 is supported at the left end of the opening and closing frame 3 to be able to revolve around the vertical axis. The door 4 is locked to the opening and closing frame 3 in a closed position in which the door 4 overlaps the opening and closing frame 3 to cover the board surface (playfield 5*a*) of the game board 5. A key cylinder 4*c* is provided in the lower right of the door 4. The key cylinder 4*c* is operated by a key to release the opening and closing frame 3 from being locked to the outer frame 2, and also release the door 4 from being locked to the opening and closing frame 3.

A pair of left and right light emitting devices 6 (movable entertainment devices 6) is provided in the upper part of the door 4. A tray unit 7 having an accumulating tray 8 (an upper tray 8*a* and a lower tray 8*b*) that accumulates playing balls, is provided in the lower part of the door 4 (the lower part of the window 4*a*). An entertainment button device 9 and a discharge device 10 are set in the tray unit 7. The entertainment button device 9 includes an entertainment button 40 that the player can push. The discharge device 10 discharges the playing balls accumulated in the lower tray 8*b* to the outside of the game machine 1.

A launching handle 11 is provided in the lower right of the tray unit 7. When the launching handle 11 is rotated, a launching device (not shown) launches a playing ball introduced by a ball feeding device (not shown) from the upper tray 8*a* to a launching position. When a plurality of playing balls are accumulated in the upper tray 8*a*, the plurality of playing balls are launched consecutively every approximately 0.6 seconds. The launched playing balls are guided through a guide rail 11*a* and introduced into the upper part of the playfield 5*a*.

Figure 2:
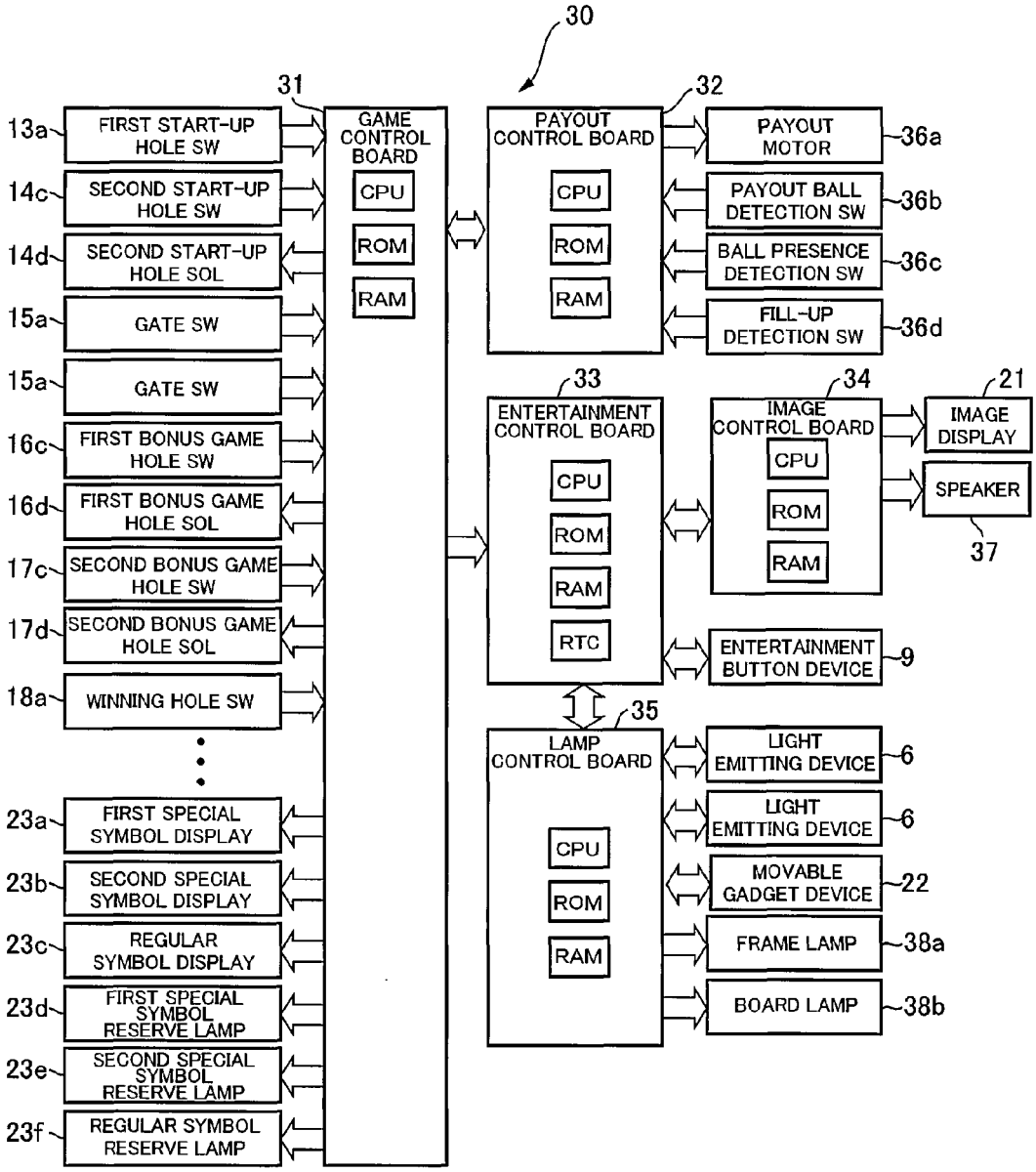
FIG. 2 is an exemplary block diagram showing a control system of the pachinko game machine.

As shown in FIG. 1 and FIG. 2, in the playfield 5*a* of the game board 5, a first start-up hole 13, a second start-up hole device 14 having an openable second start-up hole 14*a*, a pair of gates 15, a first bonus game hole device 16 having an openable first bonus game hole 16*a*, a second bonus game hole device 17 having an openable second bonus game hole 17*a*, and a plurality of (e.g. four) winning holes 18, as well as a number of pegs 12, are arranged so that playing balls can enter or pass through.

The first start-up hole 13, the pair of gates 15 and the plurality of winning holes 18 are provided with a first start-up hole SW 13*a* (here "SW" refers to "switch"), a pair of gate SWs 15*a* and a plurality of winning hole SWs 18*a*, respectively, to detect the playing balls entering these hole and gates. The second start-up hole device 14 has a second start-up hole 14*a*, an opening and closing member 14*b* that opens and closes the second start-up hole 14*a*, a second start-up hole SW 14*c* that detects a playing ball entering the second start-up hole 14*a*, and a second start-up hole SOL 14*d* ("SOL" refers to "solenoid actuator") that allows the opening and closing member 14*b* to open and close.

The first and second bonus game hole devices 16 and 17 have: first and second bonus game holes 16*a* and 17*a*; first and second opening and closing members 16*b* and 17*b* that open and close the first and second bonus game holes 16*a* and 17*a*; first and second bonus game hole SWs 16*c* and 17*c* that detect playing balls entering the first and second bonus game holes 16*a* and 17*a*; and first and second bonus game hole SOLs 16*d* and 17*d* that allow the first and second opening and closing members 16*b* and 17*b* to open and close, respectively. The number of balls to be paid out for a case in which one playing ball enters a hole is preset for each of the holes 13, 14*a*, 16*a*, 17*a* and 18. When a playing ball enters any of the holes 13, 14*a*, 16*a*, 17*a* and 18, the playing balls in the number which is set for the hole, are paid out to the accumulating tray 8.

At the time a playing ball enters one of the start-up holes 13 and 14*a*, a bonus game lottery is started. When the player wins the bonus game lottery, one of the first and second bonus game hole devices 16 and 17 activates and starts a bonus game to open one of the first and second bonus game holes 16*a* and 17*a* which are closed in general. At the time a playing ball passes through one of the pair of gates 15, a lottery is started. When the player wins the lottery, the second start-up hole device 14 activates and starts a supplementary game to open the second start-up hole 14*a* which is closed in general.

A center object 20 is set in the game board 5. This center object 20 is provided with an image display 21 and a movable object device 22. The screen of the image display 21 is arranged to appear in the frame of the center object device 20. The entertainment representing a bonus game lottery and so forth are shown on the image display 21. The movable object device 22 activates to inform about a bonus game lottery (for example, inform a high possibility of winning a bonus game lottery). For example, the movable object device 22 moves the movable object 22*a* in the direction parallel to the board surface of the game board 5 in a position near the screen of the image display 21.

A game display board 23 is provided in the lower left of the game board 5. A first special symbol display 23*a*, a second special symbol display 23*b*, a regular symbol display 23*c*, a first special symbol reserve lamp 23*d*, a second special symbol reserve lamp 23*e* and a regular symbol reserve lamp 23*f* are provided on the game display board 23.

A first special symbol is variably displayed on the first special symbol display 23*a* and a first special symbol reserve number is displayed on the first special symbol reserve lamp 23*d*. When the first special symbol reserve number is smaller than four, it is incremented by one every time a playing ball enters the first start-up hole 13. A second special symbol is variably displayed on the second special symbol display 23*b*, and a second special symbol reserve number is displayed on the second special symbol reserve lamp 23*e*. When the second special symbol reserve number is smaller than four, it is incremented by one every time a playing ball enters the second start-up hole 14*a*.

When the first special symbol reserve number is more than one and the second special symbol reserve number is zero while the first special symbol and the second special symbol stop, the first special symbol reserve number is decremented by one, and therefore the first special symbol starts changing. Then, when the first special symbol stops, the result of the bonus game lottery is represented by the stopped first special symbol. When the second special symbol reserve number is more than one while the first and second special symbols stop, the second special symbol reserve number is decremented by one regardless of the first special symbol reserve number, and therefore the second special symbol starts changing. Then, when the second special symbol stops, the result of the bonus game lottery is represented by the stopped second special symbol.

A regular symbol is variably displayed on the regular symbol display 23*c*, and a regular symbol reserve number is displayed on the regular symbol reserve lamp 23*f*. When the regular symbol reserve number is smaller than four, the regular symbol reserve number is incremented by one every time a playing ball passes through the gate 15. When the regular symbol reserve number is more than one while the regular symbol stops, the regular symbol reserve number is decremented by one, and therefore the regular symbol starts changing. Then, when the regular symbol stops, the result of the lottery is represented by the stopped regular symbol.

As shown in FIG. 2, a control device 30 of the pachinko game machine 1 has a game control board 31, a payout control board 32, an entertainment control board 33, an image control board 34, and a lamp control board 35. Each of these control boards 31 to 35 has a computer including a CPU, a ROM and a RAM. The entertainment control board 33 further includes an RTC 33*d* ("RTC" means "real time clock"). To be more specific, the game control board includes a CPU 31*a*, a ROM 31*b* and a RAM 31*c*. The entertainment control board 33 includes a CPU 33*a*, a ROM 33*b* and a RAM 33*c*. The image control board 34 includes a CPU 34*a*, a ROM 34*b* and a RAM 34*c*.

The CPU 31*a* for the game control board 31 controls the start-up hole SOL 14*d*, the bonus game hole SOLS 16*d* and 17*d*, the symbol displays 23*a* to 23*c* and the symbol reserve lamps 23*d* to 23*f* in response to detection signals from the start-up hole SWs 13*a* and 14*c*, the gate SW 15*a*, the bonus game hole SWs 16*c* and 17*c* and the winning hole SW 18*a*, and the control information from the payout control board 32, and outputs control information to the payout control board 32 and the entertainment control board 33.

The computer for the payout control board 32 controls a payout motor 36*a* of the payout device in response to the control information from the game control board 31 and the detection signals from a payout ball detection SW 36*b*, a ball presence detection SW 36*c* and a fill-up detection SW 36*d*, and outputs control information to the game control board 31. The CPU 33*a* for the entertainment control board 33 controls the entertainment button device 9 in response to the control information from the game control board 31, the image control board 34 and the lamp control board 35, and the detection signal from the entertainment button device 9, and outputs control information to the image control board 34 and the lamp control board 35.

The CPU 34*a* for the image control board 34 controls the image display 21 and a speaker 37 in response to the control information from the entertainment control board 33, and outputs the control information to the entertainment control board 33. The computer for the lamp control board 35 controls the pair of light emitting devices 6, the movable object device 22, a frame lamp 38*a* and a board lamp 38*b* in response to the control information from the entertainment control board 23 and the detection signals from the pair of light emitting devices 6 and the movable object device 22, and outputs control information to the entertainment control board 33.

The respective CPUs for the entertainment control board 33, the image control board 34 and the lamp control board 35 control the image display 21, the speaker 37, the entertainment button device 9, the pair of light emitting devices 6, the movable object device 22, the frame lamp 38*a* and the board lamp 38*b* which are entertainment equipment. The equipment makes entertainment along the progression of a game using playing balls.

Next, the tray unit 7, and the entertainment button device 9 and the discharge device 10 set in the tray unit 7, will be described in detail.

First, the tray unit 7 will be described. As shown in FIG. 1 and FIGS. 3 to 11, the tray unit 7 has a thickness in the vertical direction, which is approximately the same as the height of the lower part of the door 4 (the portion below the window 4*a*). The tray unit 7 is formed to bulge forward from the lower part of the door 4, which looks like a mountain in a plan view. The tray unit 7 includes a unit main body 7*a* as its external form, which is made of synthetic resin. The upper tray 8*a* is formed in the upper part of the unit main body 7*a*, and the lower tray 8*b* is formed in the lower left of the unit main body 7*a*. A playing ball paid out from the payout device mounted to the opening and closing frame 3 is introduced through a payout passage (not shown) provided in the opening and closing frame 3, into the upper tray 8*a* and accumulated. When the upper tray 8*a* is filled with playing balls, the playing balls are introduced into the lower tray 8*b* and accumulated.

The length of the upper tray 8*a* in the longitudinal direction is reduced from a position near the center of the upper tray 8*a* such that the front wall of the upper tray 8*a* in the right side is placed in the back rather than in the left side. The main bottom part of the upper tray 8*a* gently tilts down to the right, and therefore playing balls are introduced from the right end part of the upper tray 8*a* into the ball feeding device. The front wall of the lower tray 8*b* bulges forward in the right side rather than in the left side, and the bottom part of the lower tray 8*b* gently tilts forward and to the right. Playing balls are introduced from the front right part of the lower tray 8*b* into the discharge device 10, drop down to the bottom part of the discharge device 10 and are discharged to the outside of the game machine 1. A ball accommodating case (not shown), so-called "gold mine" is placed below the discharge device 10. The playing balls discharged from the discharge device 10 are received by and accommodated in the ball accommodating case.

The playing balls accumulated in the lower tray 8*b* may not be discharged from the discharge device 10 to the outside but supplied to the upper tray 8*a*. In this case, the playing balls accumulated in the lower tray 8*b* are taken out with the left hand while the player grips the launching handle 11 with the right hand. At this time, the playing balls are likely to run over from the upper right of the lower tray 8*b* due to the shape of the front wall of the lower tray 8*b*, the manner of taking out the playing balls by the player and so forth. Therefore, in order to prevent this, a transparent plate 8*c* (see FIG. 1) made of synthetic resin is provided as a partition wall from the outside of the upper right part of the lower tray 8*b*.

This transparent plate 8*c* bends to protrude forward a little, and also the upper edge of the transparent plate 8*c* curves such that the slope angle of the upper edge increases to the right to increase the height of the transparent plate 8*c* to the right. The bottom edge of the transparent plate 8*c* is fixed to the front wall of the lower tray 8*b*. The right edge of the transparent plate 8*c* is fixed to the part of the unit main body 7*a*, which is the right wall of the space above the lower tray 8*b*. The player can see and check the playing balls located behind the transparent plate 8*c*, and the transparent plate 8*c* has the upper edge with the shape which does not interfere with the left hand taking out the playing balls. Thus, the transparent plate 8*c* allows the player to reliably take out playing balls from the lower tray 8*b* without dropping playing balls.

Figure 12:
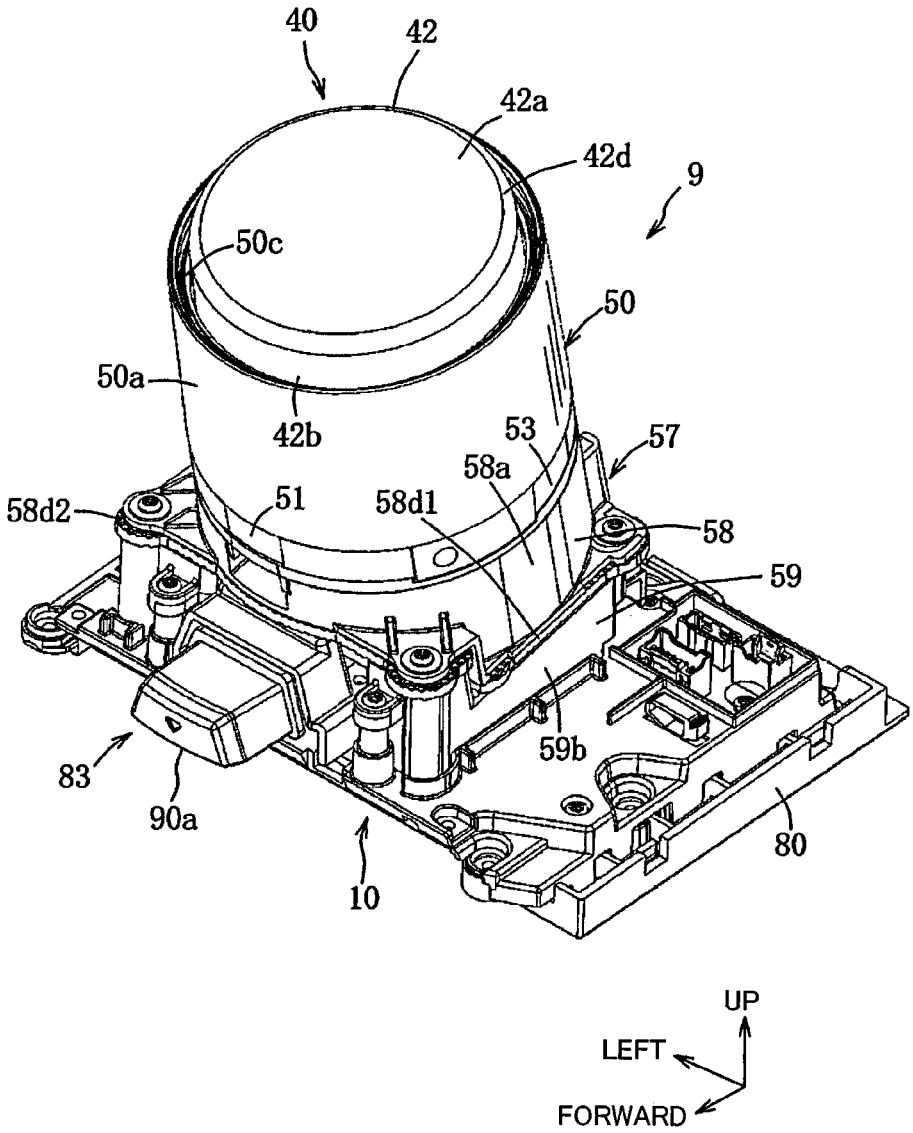
FIG. 12 is an exemplary perspective view showing the entertainment button device, a base and a discharge device.
Figure 13:
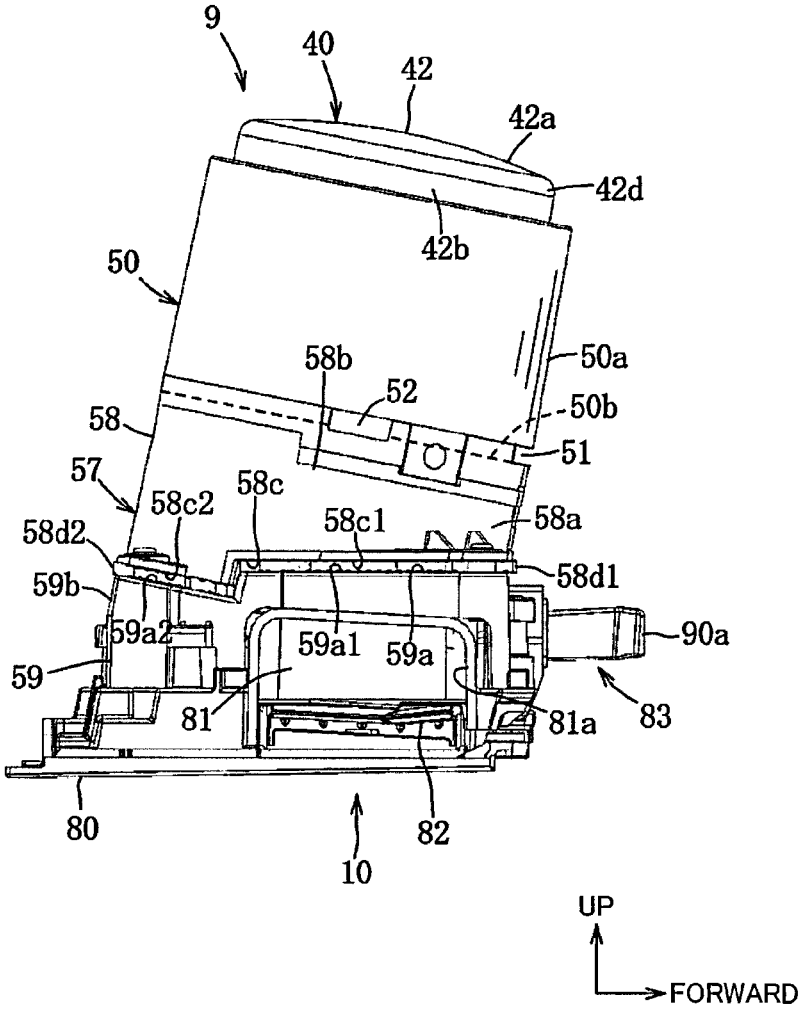
FIG. 13 is an exemplary left side view showing the entertainment button device, the base and the discharge device.
Figure 14:
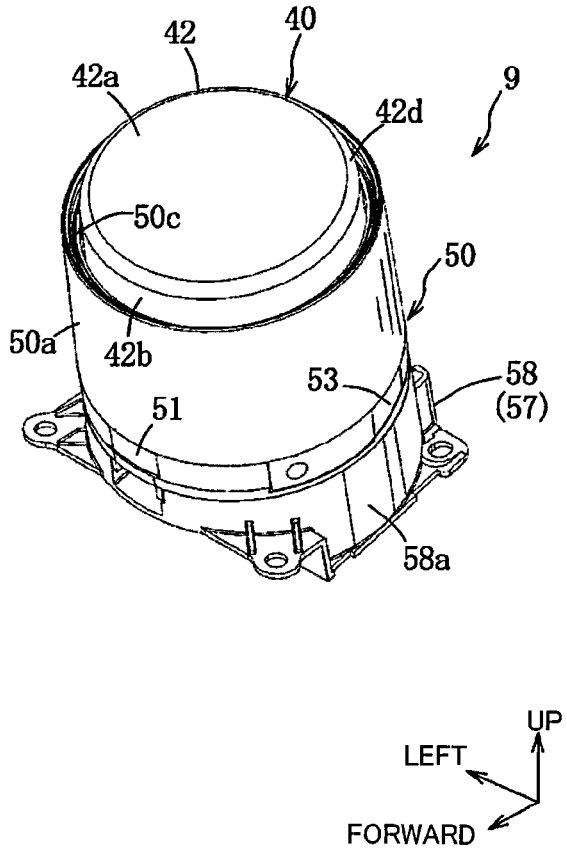
FIG. 14 is an exemplary perspective view showing the entertainment button device and an upper base.
Figure 15:
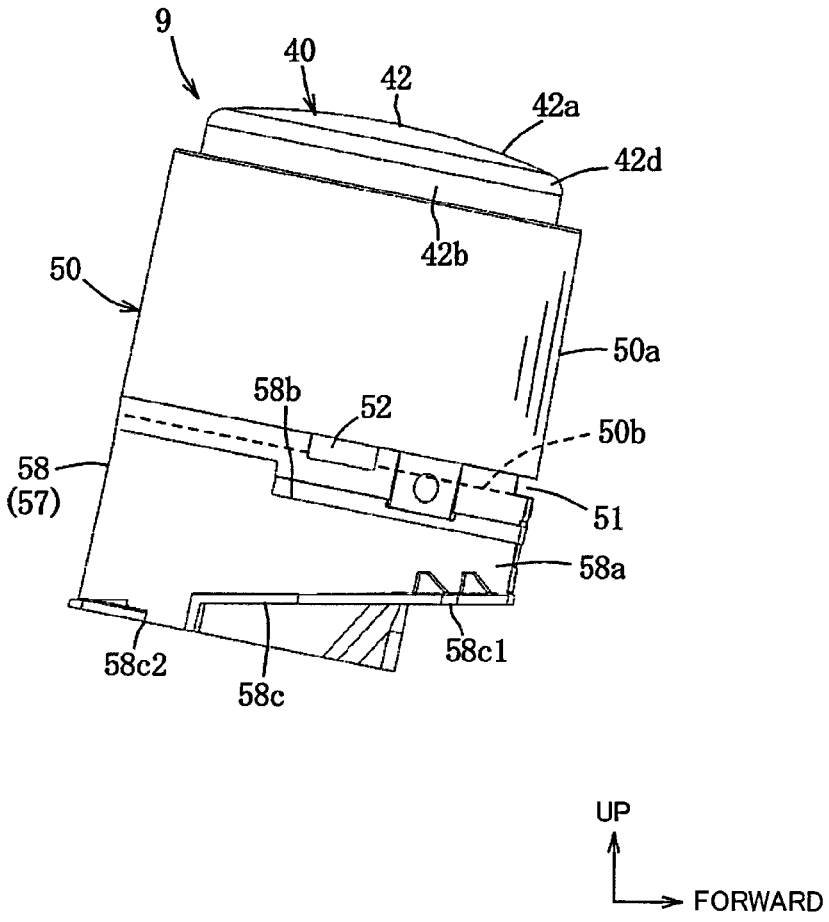
FIG. 15 is an exemplary left side view showing the entertainment button device and the upper base.
Figure 16:
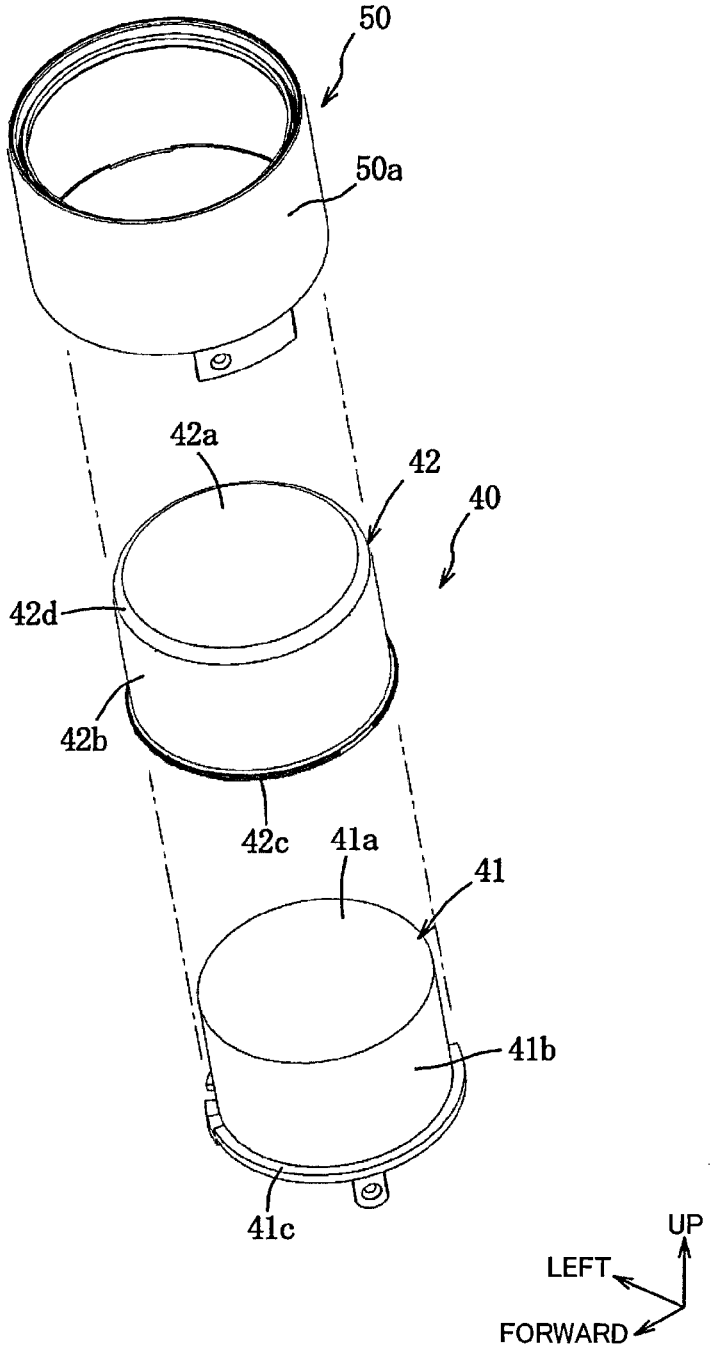
FIG. 16 is an exemplary exploded perspective view showing a button body, a button cover and the side wall of a button case.
Figure 17:
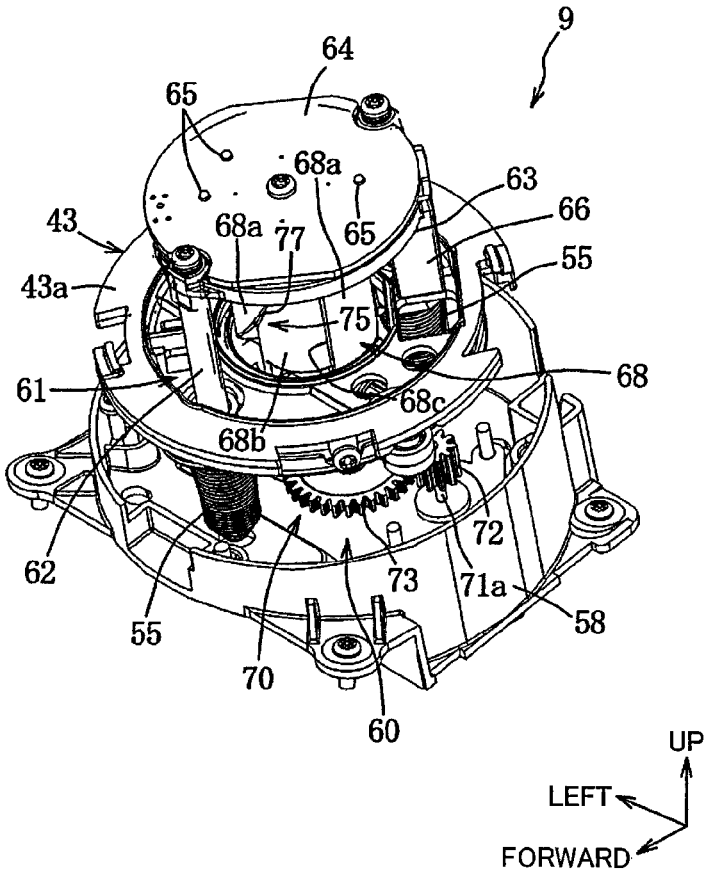
FIG. 17 is an exemplary perspective view showing the entertainment button device in a normal operation position without parts such as the entertainment button, button case and so forth, and also showing main parts of the upper base.
Figure 18:
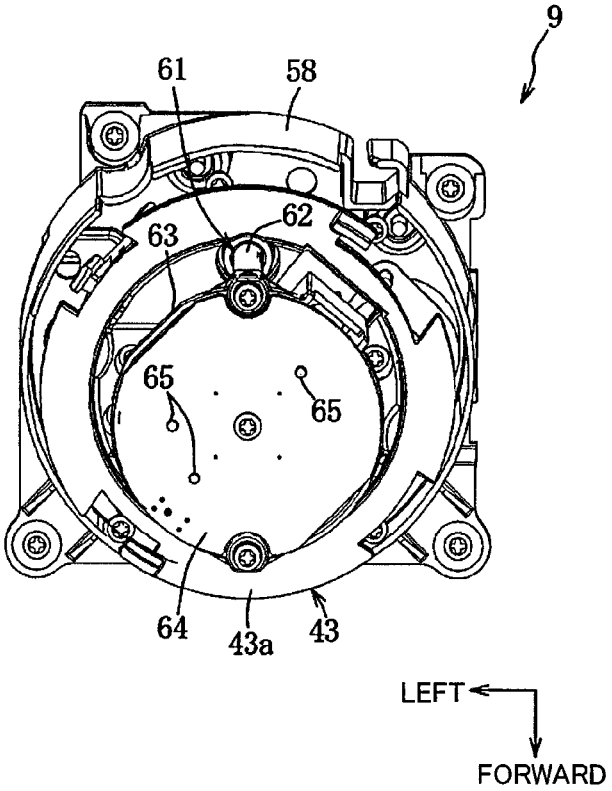
FIG. 18 is an exemplary plan view showing the entertainment button device in the normal operation position and the main parts of the upper base.
Figure 19:
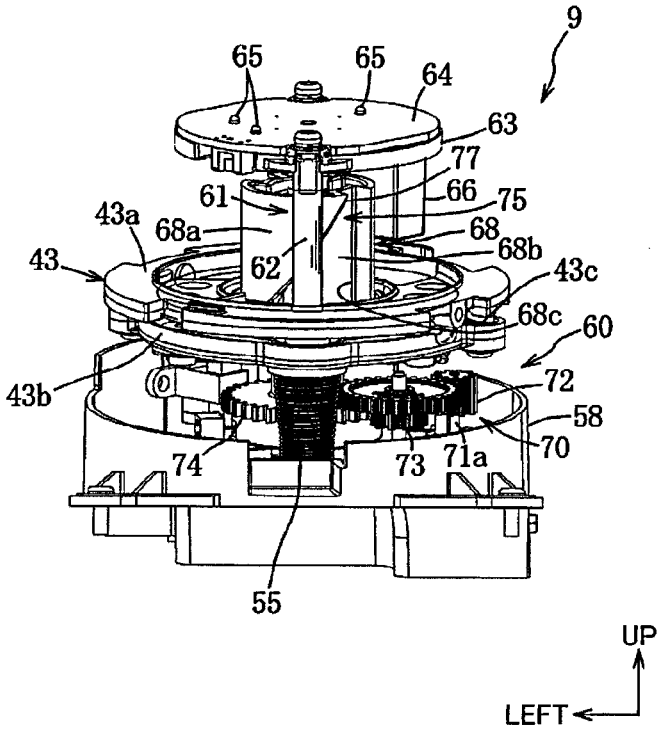
FIG. 19 is an exemplary front view showing the entertainment button device in the normal operation position and the main parts of the upper base.
Figure 20:
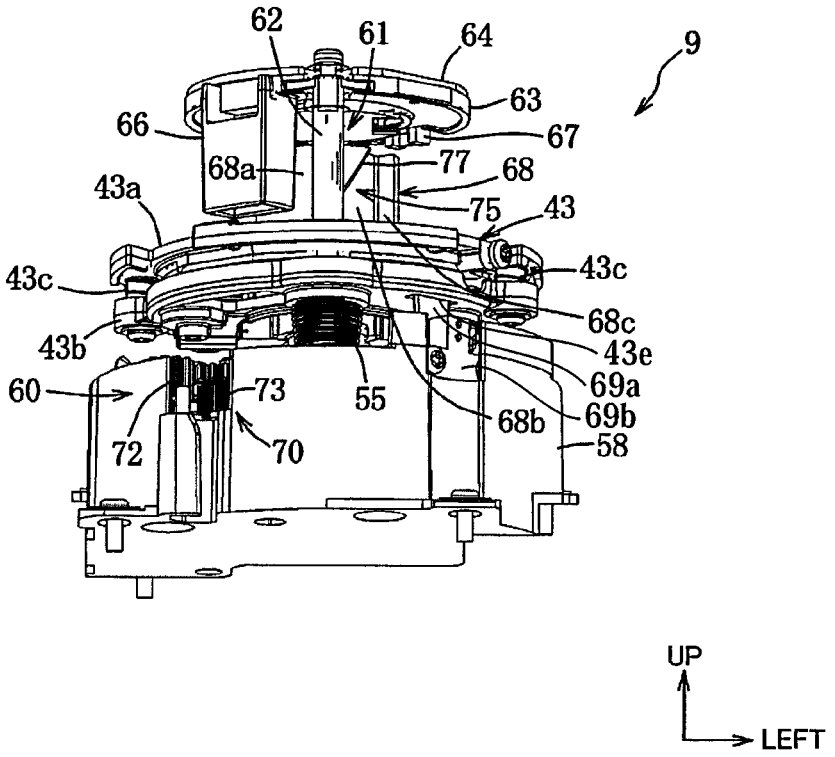
FIG. 20 is an exemplary rear view showing the entertainment button device in the normal operation position and the main parts of the upper base.

The entertainment button device 9 and the discharge device 10 are set in the central part of the tray unit 7. The entertainment button device 9 is arranged such that the entertainment button 40 can be pushed from the upper side of the tray unit 7. The discharge device 10 is arranged in the lower end of the tray unit 7 to be located on the right side of the lower tray 8*b* and below the entertainment button device 9. The discharge device 10 is fixed to a device mounting frame part 7*b* (see FIGS. 8 to 11) which is formed in the lower end of the tray unit 7 (unit main body 7*a*). The entertainment button device 9 is placed on and fixedly supported by the discharge device 10 (see FIG. 12 and FIG. 13).

As shown in FIGS. 3 to 7, in order to set the entertainment button device 9 and the discharge device 10 in the tray unit 7, a button hole 7*c* is formed in the upper end of the unit main body 7*a*. In addition, a device accommodating hole 7*d* including the button hole 7*c* is formed to vertically penetrate the unit main body 7*a*, and the device mounting frame part 7*b* is formed near the outer circumference of the lower end of the device accommodating hole 7*d*. Part of the rear of the upper peripheral wall 7*c*1 of the button hole 7*c* in the unit main body 7*a* is formed by the front wall in the middle of the upper tray 8*a*, where the length of the upper tray 8*a* in the longitudinal direction changes.

As shown in FIGS. 8 to 11, a reinforcing metal plate 39 shaped like a gate in a plan view, which opens outward, is attached to the device mounting frame part 7*b*. The discharge device 10 is fixed to the device mounting frame part 7*b* of the unit main body 7*a* via the reinforcing metal plate 39. A pair of plate support portions 7*b*1 and 7*b*2 extending in the longitudinal direction is formed in the left and right sides of the device mounting frame part 7*b*. A pair of left and right plate pieces 39*a* and 39*b* extending in the longitudinal direction, which is part of the reinforcing metal plate 39, is placed on and attached to the pair of plate support portions 7*b*1 and 7*b*2, respectively, contacting face-to-face. A plurality of (five) nut members 39*c* are fixed to the reinforcing metal plate 39 to protrude downward. The discharge device 10 is attached to the reinforcing metal plate 39 by being fastened with a plurality of (five) bolts (not shown) screwed into the plurality of nut member 39*c*.

Here, another configuration is possible where a plurality of reinforcing metal plates are provided instead of the reinforcing metal plate 39, and the discharge device 10 is fixed to the device mounting frame part 7*b* of the unit main body 7*a* via the plurality of reinforcing metal plates. In this case, at least one of the plurality of reinforcing metal plates (for example, a pair of reinforcing plates corresponding to a left plate piece 39*a* and a right plate piece 39*b*) may be placed on and attached to the plate support portions (for example, the pair of plate support portions 7*b*1 and 7*b*2) formed in the device mounting frame part 7*b*, contacting face-to-face.

Figure 3:
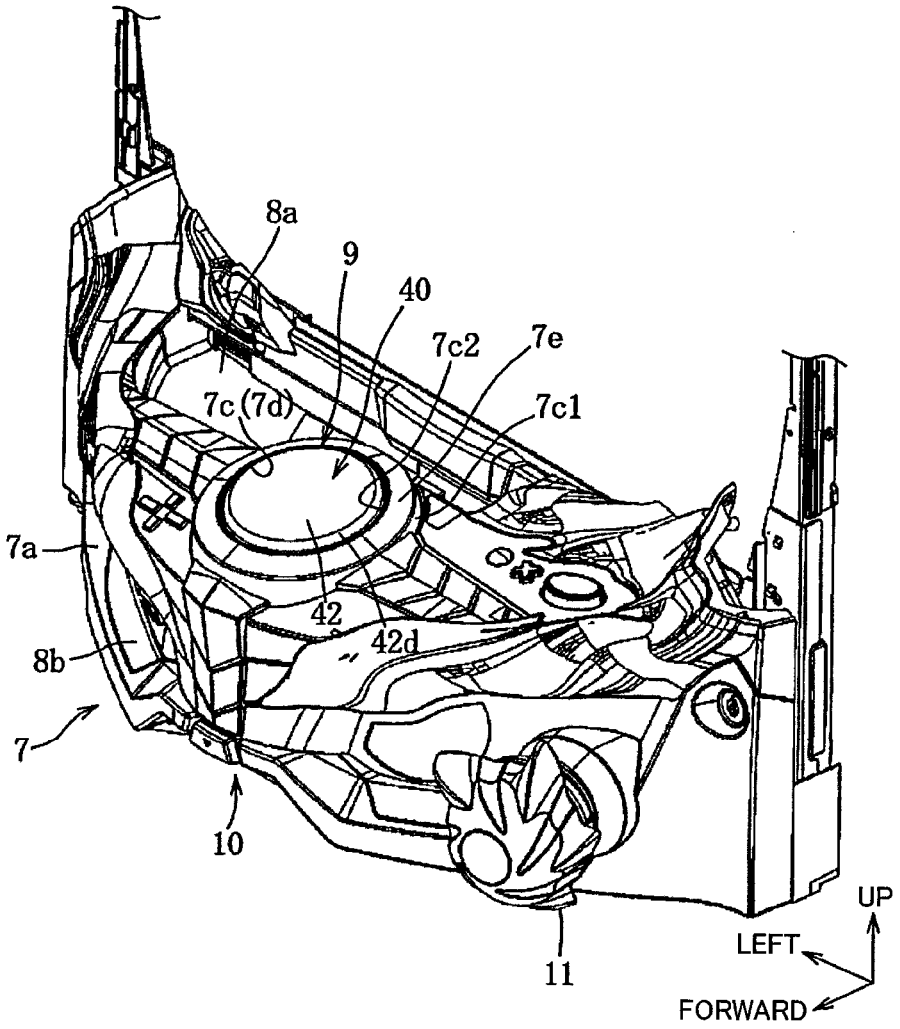
FIG. 3 is an exemplary perspective view showing a tray unit in a state in which an entertainment button is in a normal operation position.
Figure 4:
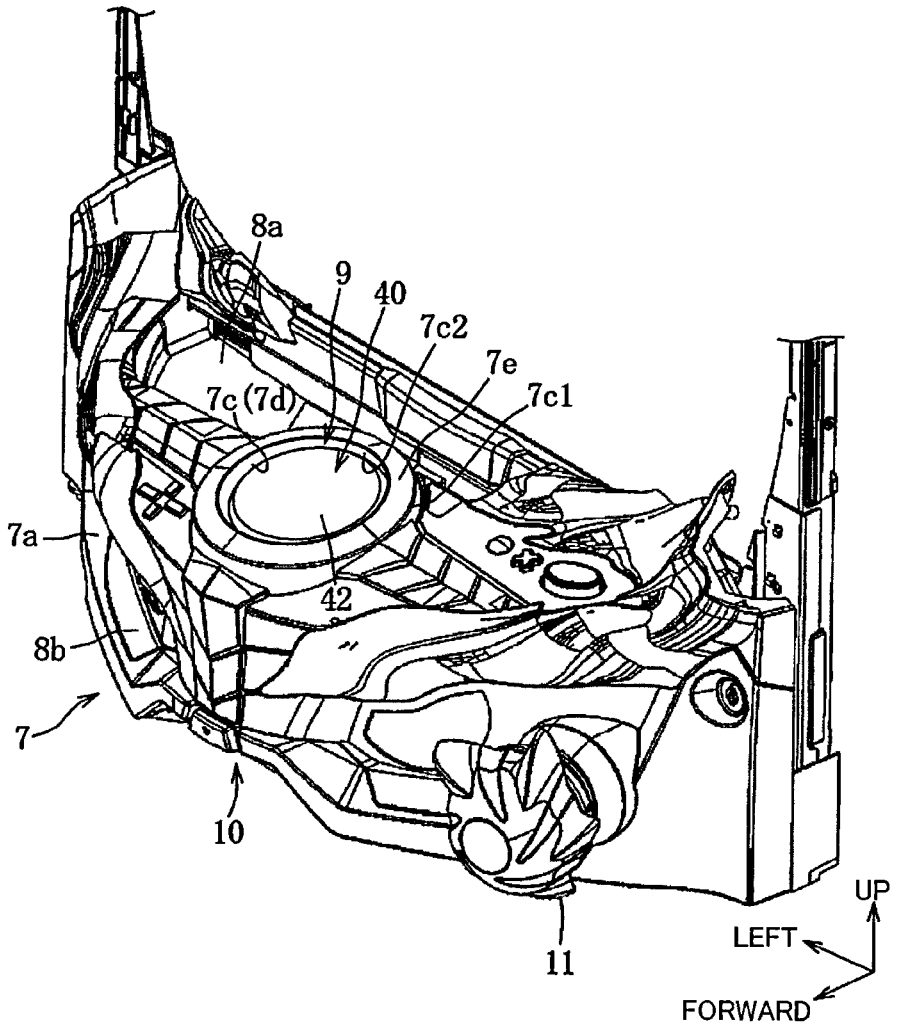
FIG. 4 is an exemplary perspective view showing the tray unit in a state in which the entertainment button is in a pushed position.
Figure 5:
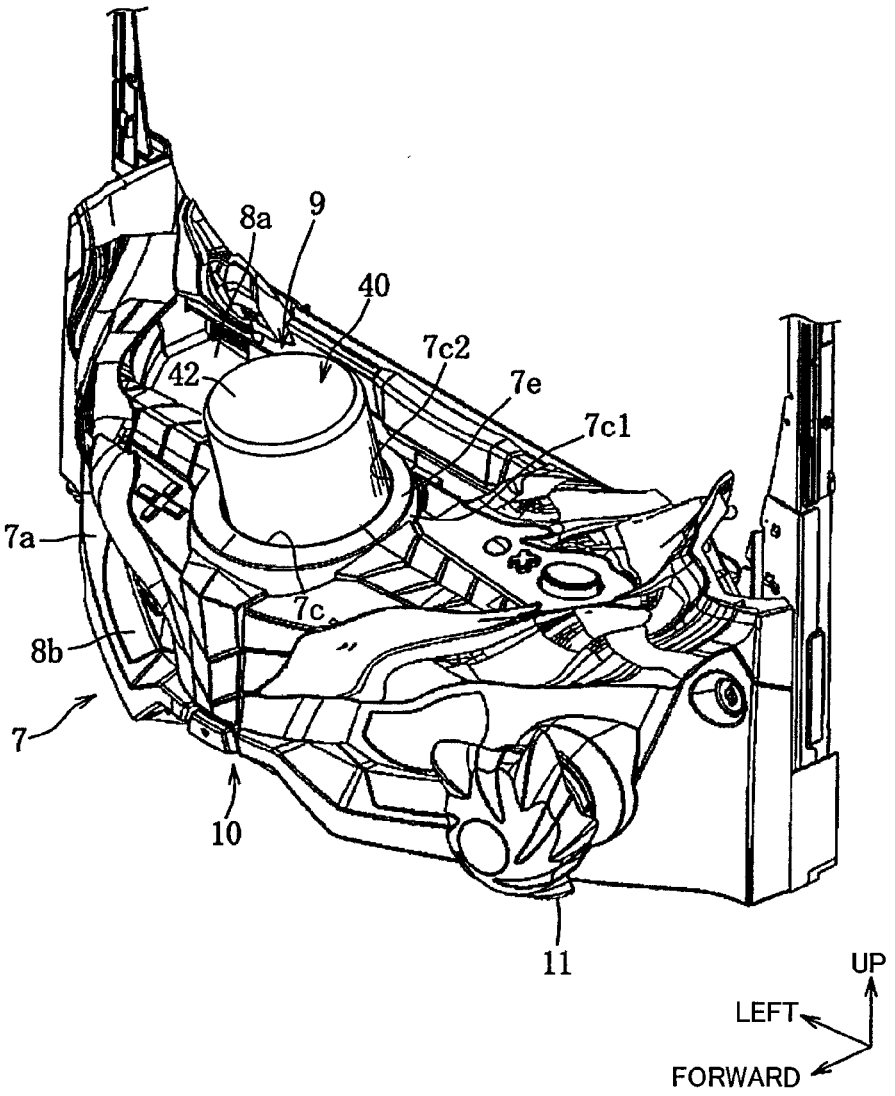
FIG. 5 is an exemplary perspective view showing the tray unit in a state in which the entertainment button is in a protruding position.
Figure 6:
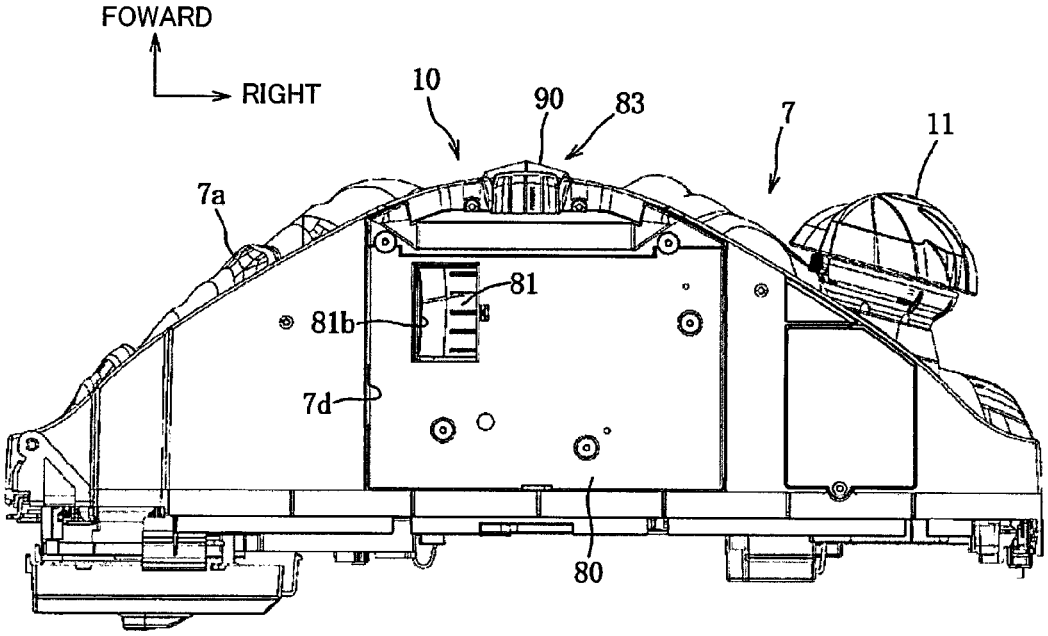
FIG. 6 is an exemplary bottom view showing the tray unit.
Figure 7:
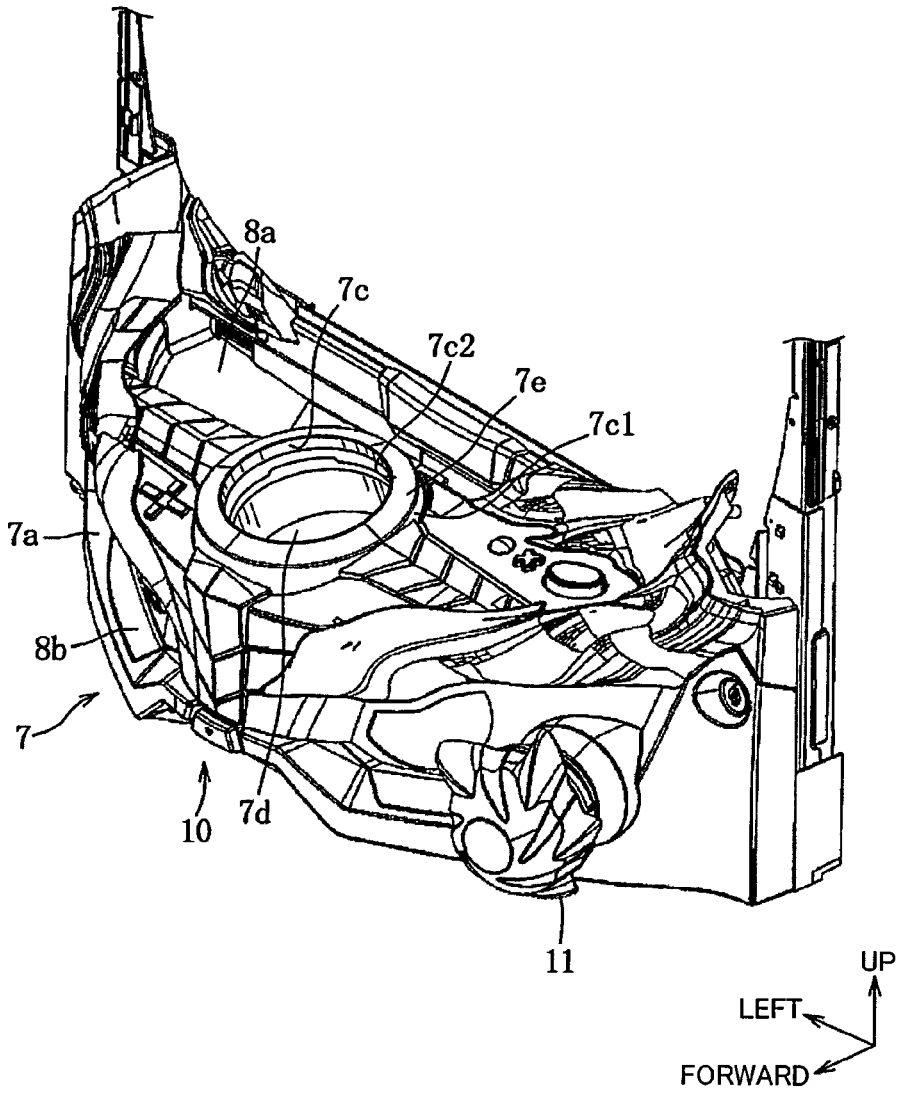
FIG. 7 is an exemplary perspective view showing the tray unit without an entertainment button device.
Figure 8:
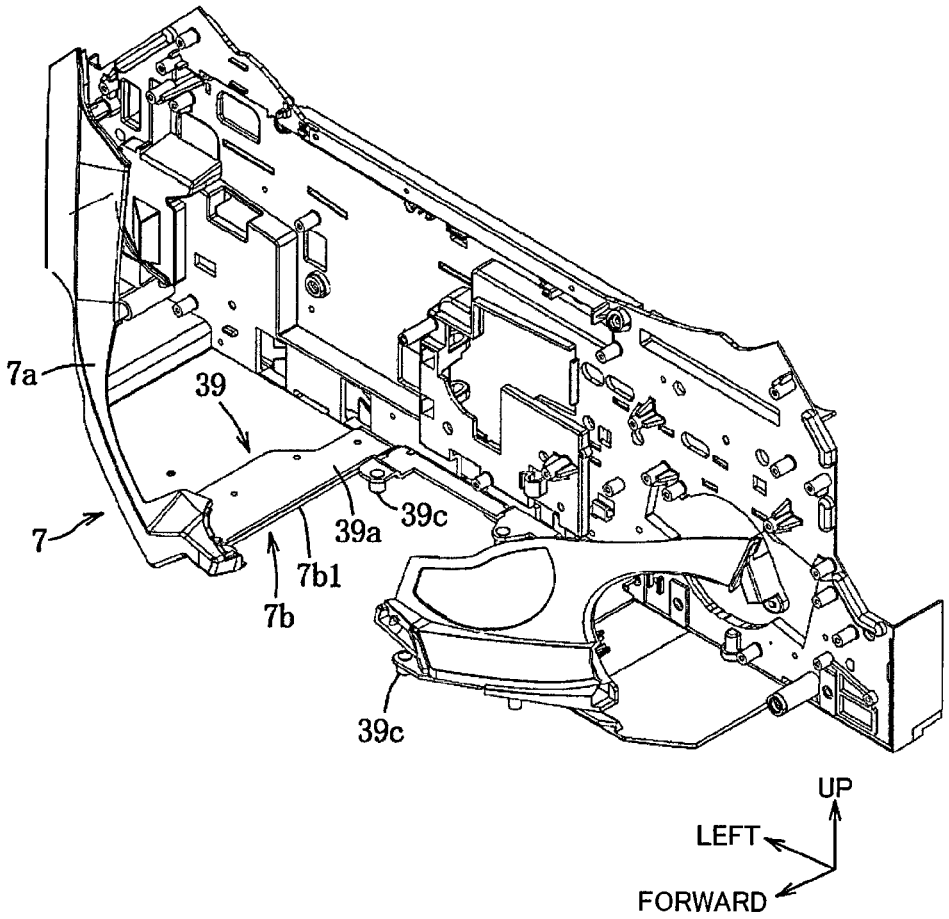
FIG. 8 is an exemplary perspective view showing part of the unit main body of the tray unit.
Figure 9:
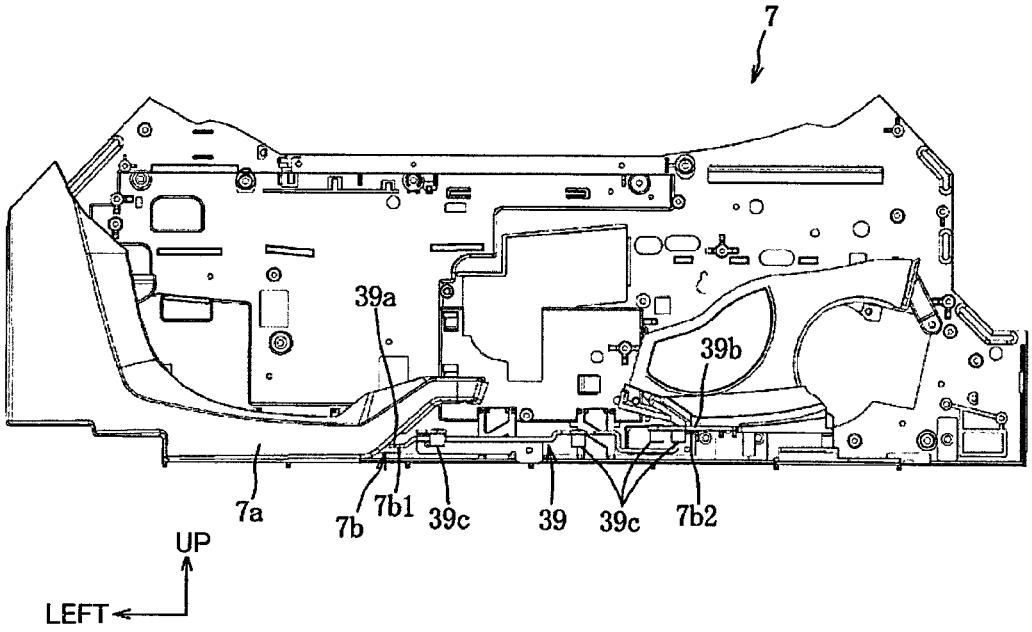
FIG. 9 is an exemplary front view showing part of the unit main body.
Figure 10:
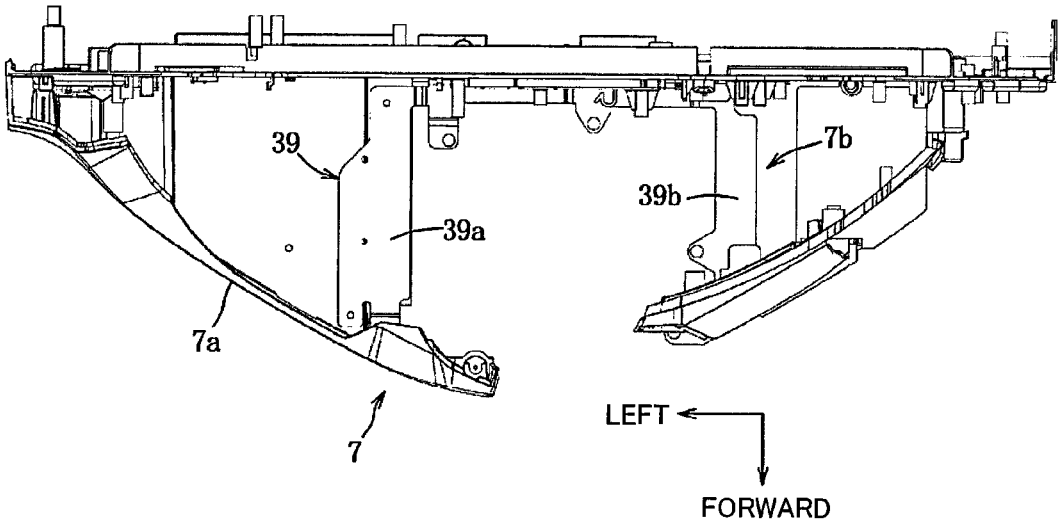
FIG. 10 is an exemplary plan view showing part of the unit main body.
Figure 11:
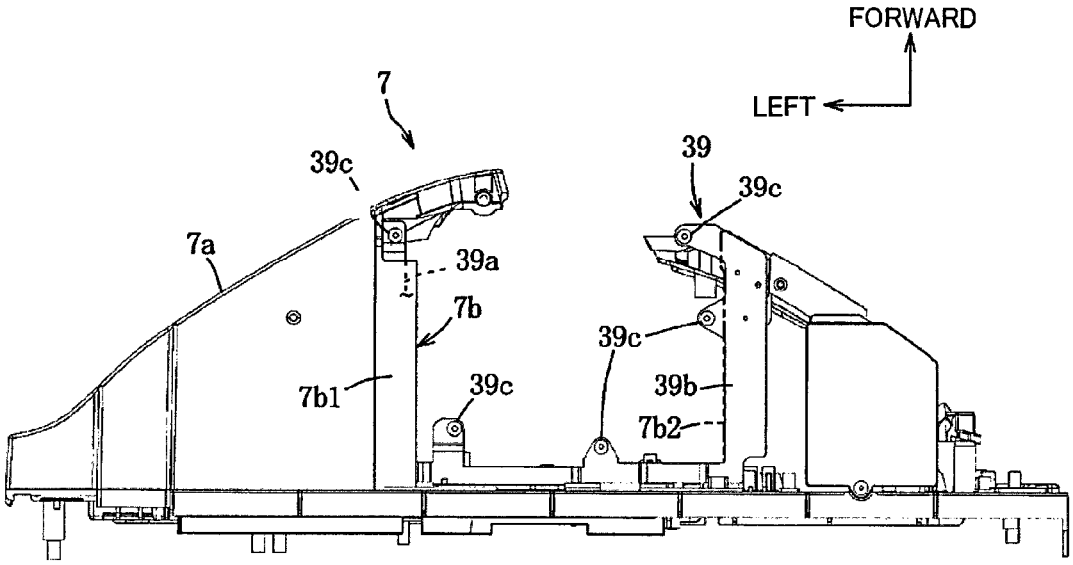
FIG. 11 is an exemplary bottom view showing part of the unit main body.

Next, the entertainment button device 9 will be explained. The entertainment button device 9 is configured to be able to move the entertainment button 40 over a predetermined normal operation position shown in FIG. 3; a pushed position shown in FIG. 4 in which the entertainment button 9 retracts from the normal operation position; and a protruding position shown in FIG. 5 in which the entertainment button 40 protrudes upward from the normal operation position. In addition, the entertainment button device 9 is configured to be able to push the entertainment button 40 from any position including the normal operation position (FIG. 3) and the protruding position (FIG. 5) to the pushed position (FIG. 4).

A large-sized entertainment button device 9 is provided, where the entertainment button 40 is several times as large as a general entertainment button and moves up and down in a stroke several times as long as a general entertainment button.

Here, the direction in which the entertainment button 40 moves over the normal operation position, the pushed position and the protruding position, is defined as the direction in which the entertainment button 40 moves up and down. One end to which the entertainment button 40 moves up is referred to as "front end" meanwhile the other end to which the entertainment button 40 moves down is referred to as "base end." Hereinafter, the direction in which the entertainment button 40 moves up and down is simply referred to as "moving direction." In addition, the direction in which the entertainment button 40 moves up is simply referred to as "moving-up direction", the direction in which the entertainment button 40 moves down is simply referred to as "moving-down direction", and the center of the axis of the entertainment button 40 (and a button case 50 and a shaft member 68 described later) is simply referred to as "central axis."

As shown in FIGS. 3 to 5 and 7, an ring-shaped convex portion 7*e* continuing to the respective upper ends of an outer peripheral wall 7*c*1 and an inner peripheral wall 7*c*2 of the button hole 7*c*. Here, when in a position in which the entertainment button 40 protrudes upward a little from the ring-shaped convex portion 7*e*, the entertainment button 40 is in the normal operation position (see FIG. 3). When in a position in which the entertainment button 40 moves down a little and enters the ring-shaped convex portion 7*e*, the entertainment button 40 is in the pushed position (see FIG. 4). When in a position in which the entertainment button 40 protrudes from the ring-shaped convex portion 7*e* with an amount several times (about seven to ten times) as much as the amount in the normal operation position, the entertainment button 40 is in the protruding position (see FIG. 5).

As shown in FIGS. 12 to 25, the entertainment button device 9 includes: the entertainment button 40; the button case 50 that accommodates the entertainment button 40 to allow the entertainment button 40 to move over the normal operation position, the pushed position and the protruding position; a pair of front and back biasing members 55 that biases the entertainment button 40 to the moving-up direction; and a button-up-and-down mechanism 60 that automatically moves the entertainment button 40 between the normal operation position and the protruding position. The button case 50 is placed on and attached to the discharge device 10 via a base 57.

As shown in FIGS. 12 to 15, the base 57 includes an upper base 58 and a lower base 59 made of synthetic resin. The upper base 58 has a cylindrical peripheral wall 58*a*, an upper wall 58*b* and a lower wall 58*c*. The upper wall 58*b* leans forward. The lower wall 58*c* includes a horizontal lower surface 58*c*1 and an inclined lower surface 58*c*2 which inclines forward. The lower base 59 has an upper wall 59*a* and a support leg 59*b*. The upper wall 59*a* includes a horizontal upper surface 59*a*1 and an inclined upper surface 59*a*2 which inclines forward. The support leg 59*b* is placed on and fixed to the discharge device 10.

The upper base 58 is fixed to the lower base 59 while the horizontal lower surface 58*c*1 and the inclined lower surface 58*c*2 of the upper base 58 are placed on the horizontal upper surface 59*a*1 and the inclined upper surface 59*a*2 of the lower base 59 through rubber cushion sheets 58*d*1 and 58*d*2, respectively. The peripheral wall 58*a* of the upper base 58 leans forward a little from the upright state. The main parts of the button-up-and-down mechanism 60 are mounted on the upper base 58.

As shown in FIGS. 12 to 16, the entertainment button 40 includes a button body 41 having an upper wall 41*a* and a peripheral wall 41*b* made of synthetic resin; a transparent button cover 42 that has an upper wall 42*a* and a peripheral wall 42*b* made of synthetic resin to cover the button body 41 and that can rotate around the central axis relative to the button body 41; and an annular member 43 (see FIGS. 17 to 21) attached to the lower end of the button body 41.

An outer flange part 42*c* formed on the lower end of the peripheral wall 42*b* of the button cover 42 is placed on an outer flange part 41*c* formed on the lower end of the peripheral wall 41*b* of the button body 41. In this state, the upper wall 41*a* of the button body 41 contacts (abuts on) the upper wall 42*a* of the button cover 42. The button cover 42 is supported by the button body 41 and moves up and down with the button body 41.

As shown in FIGS. 17 to 22, the annular member 43 includes: a fixed annular member 43*a* made of synthetic resin, which is fixed to the outer flange part 41*c* in the lower end of the button body 41; and a movable annular member 43*b* made of synthetic resin, which is provided below the fixed annular member 43*a* such that the movable annular member 43*b* can move up and down with respect to the fixed annular member 43*a* but cannot rotate around the central axis. The movable annular member 43*b* can move between the position in which the movable annular member 43*b* contacts the fixed annular member 43*a* and the position in which the movable annular member 43*b* is placed a little apart from the fixed annular member 43*a* in the moving-down direction.

The movable annular member 43*b* is biased in the moving-down direction in which the movable annular member 43*b* is placed apart from the fixed annular member 43*a* by a pair of left and right spring members 43*c* with a stronger biasing force than of the pair of biasing members 55. When the entertainment button 40 is in a position other than the pushed position, the movable annular member 43*b* is placed apart from the fixed annular member 43*a* in the moving-down direction.

As shown in FIGS. 12 to 16, the button case 50 has a cylindrical peripheral wall 50*a* and a bottom wall 50*b* made of synthetic resin, and the entertainment button 40 protrudes upward from the button case 50 (peripheral wall 50*a*). The bottom wall 50*b* is placed on and fixed to the upper wall 58*b* of the upper base 58 to lean forward while the peripheral wall 50*a* leans forward from its vertical state, and continues and extends from the peripheral wall 58*a* of the upper base 58.

The entertainment button 40 moves up and down in the direction in which the peripheral wall 50*a* of the button case 50 inclines, that is, the entertainment button 40 moves up and down while leaning forward in the moving-up direction from the upright state. The inner peripheral wall 7*c*2 of the button hole 7*c* formed in the unit main body 7*a* is fitted into the upper end of the peripheral wall 50*a* of the button case 50 from below, so that the entertainment button 40 protruding from the button case 50 moves into and out of the button hole 7*c*. An inner flange part 50*c* formed in the upper end of the peripheral wall 50*a* of the button case 50 is placed on the outer flange part 42*c* of the button cover 42 to prevent the button cover 42 from falling out in the moving-up direction.

The button case 50 has a plurality of (three) outlets 51 to 53 (openings 51 to 53) to discharge foreign matters such as liquid between the outer periphery (the peripheral wall 42*b* of the button cover 42) of the entertainment button 40 and the peripheral wall 50*a* of the button case 50, to the outside of the button case 50.

The plurality of outlets 51 to 53 are formed in the lower edge of the peripheral wall 50*a* of the button case 50 such that the outlets 51 to 53 are placed apart from each other in the circumference direction. The outlet 51 lying between the outlets 52 and 53 is formed in the lower edge of the front part of the peripheral wall 50*a* of the button case 50. This outlet 51 serves as a main opening to discharge foreign matters to the outside. Each of the outlets 51 to 53 has a rectangular shape. The lower edge of each outlet is formed by the outer periphery the bottom wall 50*b* of the button case 50.

For example, if the player spills beverage on the entertainment button 40 or over the vicinity of the entertainment button 40, the liquid as a foreign matter entering and flowing between the peripheral wall 42*b* of the button cover 42 and the peripheral wall 50*a* of the button case 50 is surely discharged directly from any of the plurality of outlets 51 to 53, or, after reaching the bottom wall 50*b* of the button case 50 once.

In addition, the outlets 51 to 53 also serve as a plurality of air inlets 51 to 53 for a sealed space which is enclosed by the entertainment button 40 and the button case 50 when the entertainment button 40 moves up and down. That is, when the entertainment button 40 moves up, the sealed space increases in volume, and therefore the plurality of air inlets 51 to 53 suck in the air from the outside. Meanwhile, when the entertainment button 40 moves down, the sealed space reduces in volume, and therefore the plurality of air inlets 51 to 53 discharge the air in the sealed space to the outside.

As shown in FIGS. 17 to 25, the button-up-and-down mechanism 60 includes: a button guide mechanism 61 that allows the entertainment button 40 to move up and down and that restricts the entertainment button 40 from rotating around the central axis; the pair of biasing members 55 that biases the entertainment button 40 in the moving-up direction; the shaft member 68 made of synthetic resin that extends in the moving direction of the entertainment button 40; a rotating mechanism 70 that rotates the shaft member 68; and an up-and-down operation mechanism 75 that moves the entertainment button 40 up and down in parallel with the shaft member 68 being rotated by the rotating mechanism 70.

The button guide mechanism 61 includes: a pair of front and back metal guide rods 62 extending in the moving direction; and a pair of front and back cylindrical parts into which the pair of guide rods 62 are fitted, respectively (not shown). The pair of cylindrical parts is formed integrally with the fixed annular part 43*a* of the entertainment button 40. The button guide mechanism 61 retains the posture of the entertainment button 40 and guides the entertainment button 40 to be able to move up and down but not to be able to rotate around the central axis.

While its base ends are fixed to the upper base 58, the pair of guide rods 62 extends from the upper base 58 in the moving-up direction, penetrates the bottom wall 50*b* of the button case 50, penetrates the movable annular member 43*b* and the fixed annular member 43*a* of the entertainment button 40 in the button case 50. Then, the pair of guide rods 62 is inserted into the entertainment button 40 from the base end side. A discoid stopper plate 63 made of synthetic resin is fixed to the upper ends of the pair of guide rods 62 in the entertainment button 40.

Figure 22:
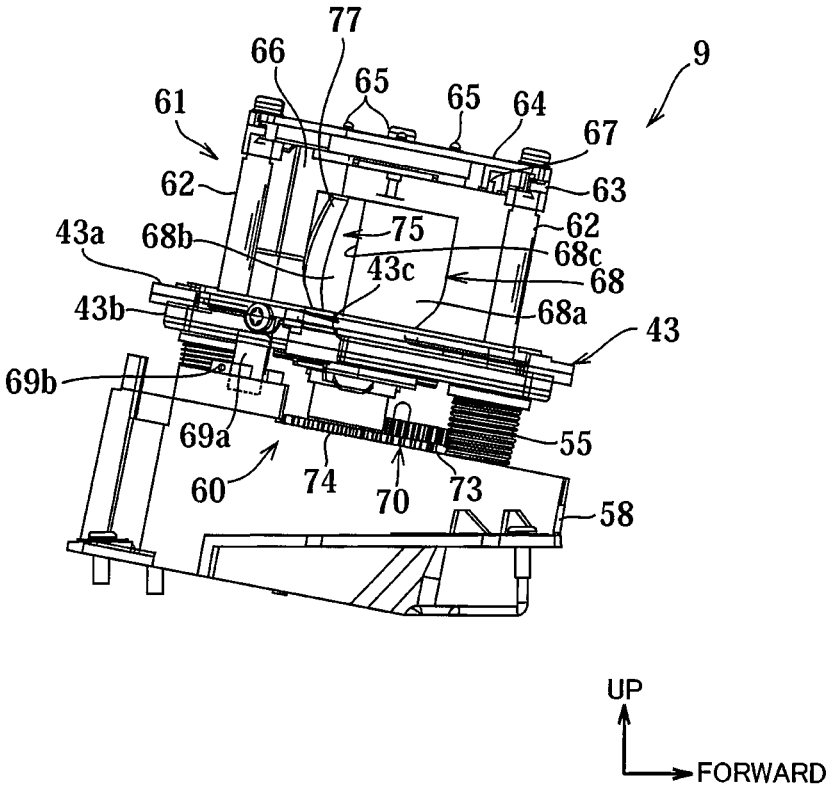
FIG. 22 is an exemplary left side view showing the entertainment button device in the pushed position and the main parts of the upper base.
Figure 23:
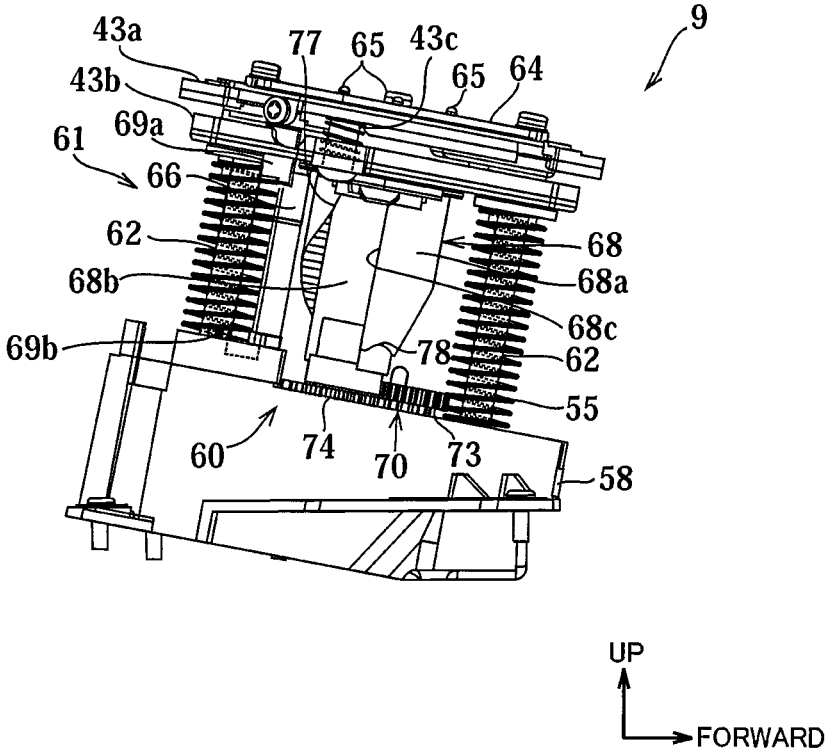
FIG. 23 is an exemplary left side view showing the entertainment button device in the protruding position and the main parts of the upper base.

As shown in FIG. 22, the entertainment button 40 is in the pushed position while the fixed annular member 43*a* contacts the movable annular member 43*b* and also the movable annular member 43*b* contacts the bottom wall 50*b* of the button case 50. On the other hand, as shown in FIG. 23, the entertainment button 40 is in the protruding position while the fixed annular member 43*a* contacts the lower surface of the stopper plate 63, and therefore is stopped by the stopper plate 63.

An LED board 64 is mounted on the upper surface of the stopper plate 63. A plurality of LEDs 65 are packaged on the upper surface of the LED board 64. Moreover, a first protruding position detecting part 67, which is an optical sensor such as a photo sensor and has a concave shape, is attached to the lower surface of the stopper plate 63.

A first push operation detecting part 69*a* and a second protruding position detecting part 43*d* are formed on the fixed annular member. The first push operation detecting part 69*a* protrudes to the movable annular member 43*b* and has a convex shape, and the second protruding position detecting part 43*d* protrudes to the stopper plate 63 and has a convex shape.

Figure 21:
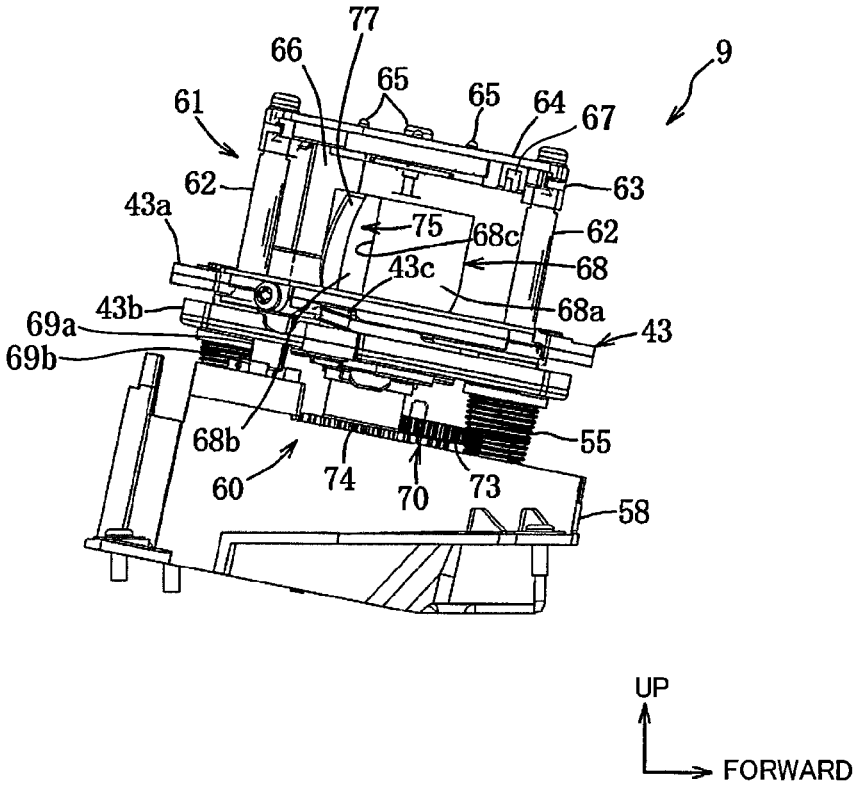
FIG. 21 is an exemplary left side view showing the entertainment button device in the normal operation position and the main parts of the upper base.

As shown in FIG. 21 and FIG. 22, a second push operation detecting part 69*b*, which is an optical sensor such as a photo sensor and has a concave shape, is mounted on the lower surface of the upper base 58.

As shown in FIG. 22, when the entertainment button 40 is in the pushed position, the first convex push operation detecting part 69*a* on the fixed annular member 43*a* enters (approaches) the concave second push operation detecting part 69*b* in the upper base 58 thereby to detect the entertainment button being pushed.

Moreover, as shown in FIG. 23, when the entertainment button 40 is in the protruding position, the second convex protruding position detecting part 43*d* on the fixed annular member 43*a* enters (approaches) the first concave protruding position detecting part 67 thereby to detect the entertainment button 40 being held in the protruding position.

Moreover, as shown in FIG. 23, when the entertainment button is in the protruding position, the second convex protruding position detecting part 43*d* on the fixed annular member 43*a* enters (approaches) the first convex protruding position detecting part 67 in the stopper plate 63 thereby to detect the entertainment button 40 being held in the protruding position.

The button body 41 including the upper wall 41*a* and the peripheral wall 41*b* is formed as a light-transmissive lens part. When the LEDs 65 emit light, the light transmits through the button body 41 (lens part) to illuminate the button body 41. Here, a plurality of conducting wires that allow the plurality of LEDs 65 to emit light extend upward from the upper base 58 side and are connected to the LED board 64. A rectangular cylindrical wiring accommodating member 66 that accommodates and guides these conducting wires extend in the moving direction to connect between the upper base 58 and the stopper plate 63 while penetrating the fixed annular member 43*a* and the movable annular member 43*b* of the entertainment button 40.

Here, the button cover 42 is provided to be able to rotate relative to the button body 41. Therefore, even if the player rotates the button cover 42, only the button cover 42 runs idle but any external load is not applied to rotate the button body 41, so that it is possible to reliably prevent the button body 41 and the button guide mechanism 61 from being damaged due to an external load.

In addition, a rounded portion 42*d* having an arc cross-section is formed at the boundary between the upper wall 42*a* and the peripheral wall 42*b* of the button cover 42. As shown in FIG. 3, the rounded portion 42*d* is formed to prevent the peripheral wall 42*b* of the button cover 42 from going beyond the unit main body 7*a* (ring-shaped convex portion 7*a*) when the entertainment button 40 is in the normal operation position. Therefore, when the entertainment button 40 is in the normal operation position, it is difficult for the player to take up the upper outer peripheral part (rounded portion 42*d*) of the button cover 42. Accordingly, it is possible to more reliably prevent the button body 41 and the button guide mechanism 61 as well as the button cover 42 from being damaged.

The pair of biasing members 55 is formed by a pair of coil springs. The pair of coil springs is put around the pair of guide rods 62 respectively in the button case 50. Here, the pair of coil springs 55 is compressed and set between the movable annular member 43*b* of the entertainment button 40 and the upper wall 58*b* of the upper base 58 (or the bottom wall 50*b* of the button case 50).

The shaft member 68 is provided to align its central axis with the central axis of the entertainment button 40. While its base end is supported by the upper base 58 to be able to rotate, the shaft member 68 extends from the upper base 58 in the moving-up direction and penetrates the bottom wall 50*b* of the button case 50. Then, the shaft member 68 penetrates the movable annular member 43*b* and the fixed annular member 43*a* of the entertainment button 40 and is inserted into the entertainment button 40 from the base end side of the entertainment button 40 in the button case 50. That is, the entertainment button 40 is provided with the annular member 43 which is arranged outside of the outer periphery of the shaft member 68.

The rotating mechanism 70 includes an electric motor 71, a driving gear 72, an intermediate two-stage gear 73 and a driven gear 74. The electric motor 71 is attached to the upper base 58 to face the moving-up direction. The driving gear 72 is mounted on an output shaft 71*a* of the electric motor 71. The driving gear 72, the intermediate two-stage gear 73 and the driven gear 74 engage with each other. The intermediate two-stage gear 73 is rotatably supported by the upper base 58 while the driven gear 74 is fixed to the base end of the shaft member 68.

The up-and-down operation mechanism 75 includes a pair of left and right engagement parts 76 that moves with the entertainment button 40 and a pair of spiral guide parts 77 provided on the outer periphery of the shaft member 68. The pair of engagement parts 76 engages with the pair of spiral guide parts 77, respectively, while the entertainment button 40 is biased by the biasing members 55 to the moving-up direction. Then, the rotating member 70 rotates the shaft member 68, so that the pair of spiral guide parts 77 can move the pair of engagement parts 76 in the moving direction. The pair of engagement parts 76 and the pair of spiral guide parts are symmetric with respect to the central axis.

Each of the engagement parts 76 is formed by a pin member. The pin members are mounted to the movable annular member 43*b* and protrude from the inner periphery of the movable annular member 43*b* to the shaft member 68 (to the central axis) in the direction orthogonal to the central axis. By this means, the engagement parts 76 can engage with the spiral guide parts 77 (see FIG. 25).

Figure 24:
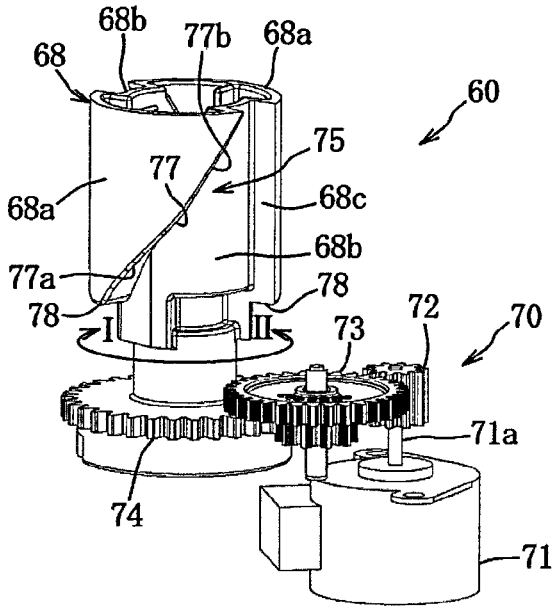
FIG. 24 is an exemplary perspective view showing a shaft member and a rotating mechanism.
Figure 25:
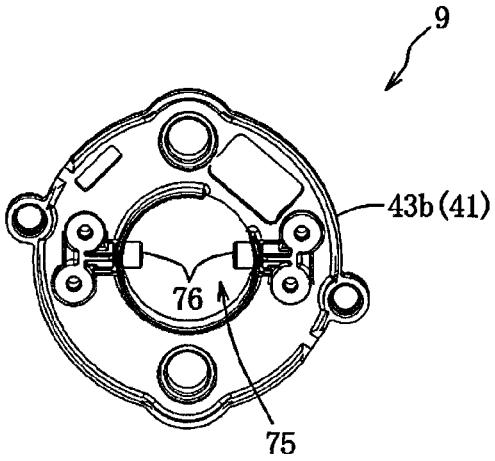
FIG. 25 is an exemplary plan view showing a movable annular member.

As shown in FIG. 24, each of the spiral guide parts 77 includes a first spiral guide portion 77*a* with a predetermined angle of inclination (about 45 degrees) and a second spiral guide portion 77*b*. The base end of the second spiral guide portion 77*b* continues to the front end of the first spiral guide portion 77*a*. The second spiral guide portion 77*b* has a greater angle of inclination (about 60 degrees) than of the first spiral guide portion 77*a*. The area in which the second spiral guide portion 77*b* is formed in the direction parallel to the central axis of the shaft member 68 is approximately the same or a little larger than the area in which the first spiral guide portion 77*a* is formed.

A pair of smoothing guide parts 78 are formed on the outer periphery of the shaft member 68, which continues to the base ends of the pair of spiral guide parts 77 (the first spiral guide portion 77*a*) and extends in parallel with the plane orthogonal to the central axis of the shaft member 68. The pair of the engagement parts 76 engages with the pair of the smoothing guide parts 78, respectively, to hold the entertainment button 40 in the normal operation position. The pair of smoothing guide parts 78 is also symmetric with respect to the central axis.

Here, a pair of convex portions 68*a* is formed symmetrically with respect to the central axis on the outer periphery of the shaft member 68. Meanwhile, a pair of concave portions 68*b* is formed between the pair of convex portions 68*a*, symmetrically with respect to the central axis. The surface of the pair of convex portions 68*a* forms part of a cylindrical surface around the central axis while the surface of the pair of convex portions 68*b* forms part of a cylindrical surface with a smaller diameter than of the surface of the convex portions 68*a*.

Each of the convex portions 68*a* has an inverted trapezoid shape. A spiral guide part 77 (including the first spiral guide portion 77*a* and the second spiral guide portion 77*b*) is formed in a step-like manner on one edge of the convex portion 68*a* in the circumference direction (the boundary with the concave portion 68*b*). Meanwhile a smoothing guide part 78 is formed on the base end of each convex portion 68*a* in a step-like manner. In addition, a straight part 68*c* extending in parallel with the direction of the central axis of the shaft member 68 is formed on the other edge of each convex portion 68*a* in the circumference direction (the boundary with the concave portion 68*b*).

When the entertainment button 40 is located between the normal operation position and the protruding position, and when the entertainment button 40 is located in the protruding position, each engagement part 76 provided in the entertainment button 40 is placed in the concave portion 68*b*. That is, each engagement part 76 is placed between the spiral guide part 77 of one convex portion 68*a* and the straight part 68*c* of the other convex portion 68*a*, and therefore can engage with the spiral guide part 77.

Figure 29:
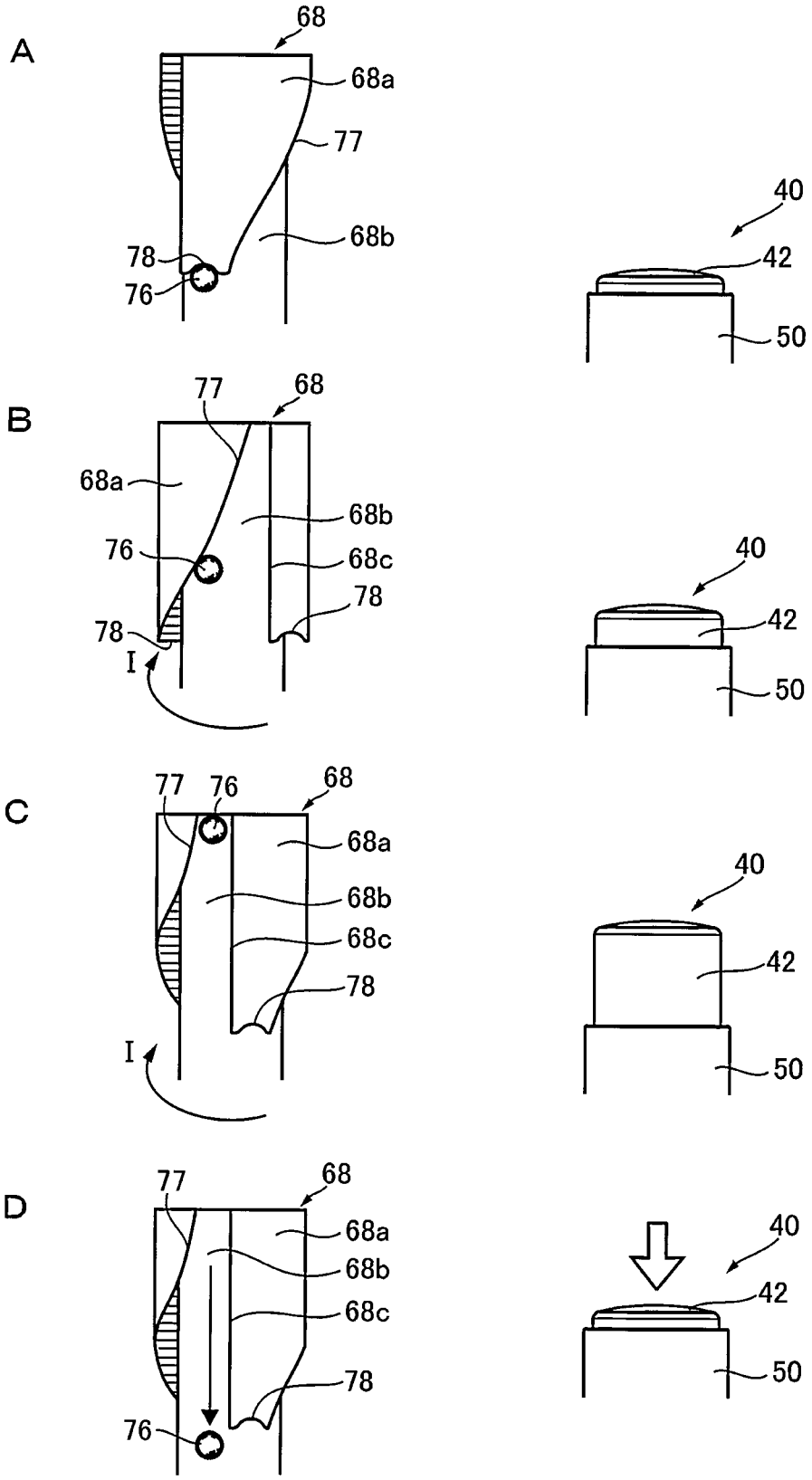
FIG. 29 is an exemplary schematic view showing the entertainment button moving when the shaft member is rotated in I direction.

As shown in FIG. 29A, when the entertainment button 40 is not pushed, the pair of engagement parts 76 of the entertainment button 40 engages with the pair of smoothing guide part 78 of the shaft member 68 to hold the entertainment button 40 in the normal operation position. From this state, the pair of engagement parts 76 may be moved to be placed apart from the pair of smoothing guide parts 78 in the moving-down direction, and therefore it is possible to push the entertainment button 40 to the pushed position. After that, when the entertainment button 40 is released from being pushed, the entertainment button 40 returns to the normal operation position and is held in this position.

In addition, as shown in FIG. 29B, when the entertainment button 40 is not pushed, the shaft member 68 is rotated in the direction of arrow I shown in FIG. 24 from the above-described state in which the entertainment button 40 is held in the normal operation position, the pair of engagement parts 76 of the entertainment button 40 is released from the engagement with the pair of smoothing guide parts 78 of the shaft member 68 and moves to and engages with the pair of spiral guide parts 77 (the first spiral guide portion 77*a*). As a result, the entertainment button 40 starts moving up from the normal operation position.

As shown in FIG. 29C, the shaft member 68 is rotated while the pair of engagement parts 76 of the entertainment button 40 engages with the pair of spiral guide parts 77 of the shaft member 68, and therefore the pair of engagement parts 76 is moved in the moving direction, that is, the entertainment button 40 moves up and down. The shaft member 68 is rotated in the direction of arrow I shown in FIG. 24, and, finally, the entertainment button 40 moves up. As a result, the fixed annular member 43*a* of the entertainment button 40 is stopped by the stopper plate 63 fixed to the front ends of the pair of guide rods 62 to hold the entertainment button 40 is held in the protruding position.

Here, when the rotating speed of the shaft member 68 is fixed, the moving speed of the entertainment button 40 is slower in a first case in which the engagement part 76 engages with the first spiral guide portion 77*a* than in a second case in which the engagement part 76 engages with the second spiral guide portion 77*b*. That is, the load on the shaft member 68 to move the entertainment button 40 up and down is smaller in the first case than in the second case.

As shown in FIGS. 29A to 29D, the pair of concave portions 68*b* allows the pair of engagement parts 76 to move to be placed apart from the pair of spiral guide parts 77 in the moving-down direction without collision with the pair of convex portions 68*a* while the entertainment button 40 is located in any position between the normal operation position and the protruding position. By this means, it is possible to push the entertainment button 40 to the pushed position. Also, from the state in which the entertainment button 40 is held in the protruding position, it is possible to push the entertainment button 40 to the pushed position.

After that, when the entertainment button 40 is released from being pushed, it returns to the position at which the push operation was started. To be more specific, when the entertainment button 40 moves up or down (the shaft member 68 rotates), the entertainment button 40 returns to a position near the position at which the push operation was started. Here, when the entertainment button 40 is pushed to the pushed position, the shaft member 68 is rotated to place the pair of smoothing guide parts 78 in the direction in which the pair of engagement parts 76 moves up. To be more specific, when the entertainment button 40 is pushed from the protruding position to the pushed position, the shaft member 68 is rotated a little in the direction of arrow I shown in FIG. 24. As a result, when the entertainment button 40 is released from being pushed, the pair of engagement parts engages with the pair of smoothing guide parts 78. Consequently, the entertainment button 40 returns to the normal operation position.

Figure 30:
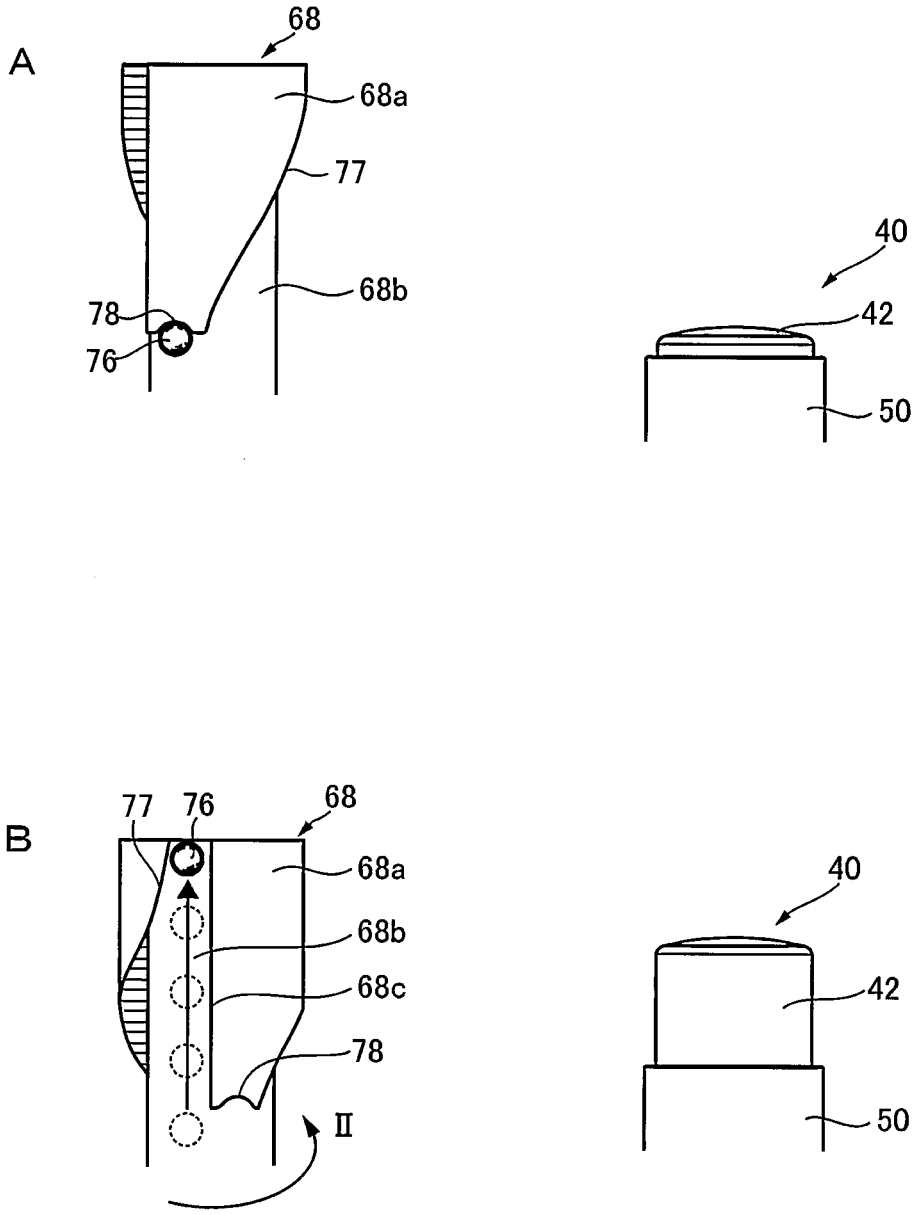
FIG. 30 is an exemplary schematic view showing the entertainment button moving when the shaft member is rotated in II direction.

On the other hand, as shown in FIGS. 30A and 30B, when the shaft member 68 is rotated in the direction of arrow II shown in FIG. 24 while the entertainment button 40 is not pushed and is held in the normal operation position as described above, the pair of engagement parts 76 of the entertainment button 40 is released from the engagement with the pair of smoothing guide parts 78 of the shaft member 68 to move in the moving-up direction along the pair of straight parts 68*c*. That is, the entertainment button 40 moves to the protruding position at a stretch.

As described above, the shaft member 68 is rotated in the direction of arrow I shown in FIG. 24 while the entertainment button 40 is held in the normal operation position, so that the pair of engagement parts 76 engages with the pair of spiral guide parts 77. As a result, it is possible to move the entertainment button 40 up to the protruding position at a speed according to the rotating speed of the shaft member 68 (for example, slowly). On the other hand, the shaft member 68 is rotated in the direction of arrow II shown in FIG. 24 while the entertainment button 40 is held in the normal operation position, so that the pair of concave portions 68*b* prevents the pair of engagement parts 76 from engaging with the pair of convex portions 68*a*. Therefore, it is possible to move the entertainment button 40 up to the protruding position at a high speed without engagement between the pair of the engagement parts 76 and the pair of spiral guide parts 77. That is, when the button-up-and-down mechanism 60 moves the entertainment button 40 from the normal operation position to the protruding position, the speed at which the entertainment button 40 moves up changes depending on the direction in which the rotating mechanism 70 rotates the shaft member 68.

Next, the discharge device 10 will be explained. As shown in FIG. 6, FIG. 12, FIG. 13, and FIG. 26 to FIG. 28, the discharge device 10 includes: a case member 80 made of synthetic resin; a discharge passage 81 formed in the case member 80; an opening and closing plate 82 made of synthetic resin that can open and close the discharge passage 81; an opening and closing mechanism 83 that allows the opening and closing plate 82 to open and close; an open retention mechanism 84 that can releasably keep the opening and closing plate 82 in the position in which the opening and closing plate 82 is open the discharge passage 81; and a closed lock mechanism 85 that releasably locks the opening and closing plate 82 in the position in which the opening and closing plate 82 closes the discharge passage 81 to prevent the opening and closing plate 82 from being touched directly to open the opening and closing plate 82.

The case member 80 has a rectangular shape in a plan view and has a predetermined thickness in the vertical direction. The opening and closing mechanism 83 is accommodated and mounted in the case member 80. This case member 80 is set from below in the lower end part of the device accommodating hole 7*d* formed in the unit main body 7*a* of the tray unit 7*a*. The outer peripheral part of the case member 80 is mounted to the reinforcing metal plate 39 attached to the unit main body 7*a*, with a plurality of bolts (not shown). A pedestal 80*a* is formed on the upper surface of the case member 80. The support leg 59*b* of the lower base 59 is fixedly placed on the pedestal 80*a*.

The discharge passage 81 is formed in the front part of the case member 80 in the left side. A ball introducing inlet 81*a* that opens into the left side to face the inside of the lower tray 8*b* is formed in the upstream of the discharge passage 81. A ball outlet 81*b* is formed in the downstream of the discharge passage 81*b*. This ball outlet 81*b* opens downward to face the outside and is formed on the right side of the ball introducing inlet 81*a*. The opening and closing plate 82 is supported to be able to slide right and left in the case member 80, and therefore can open and close the ball outlet 81*b*.

Figure 26:
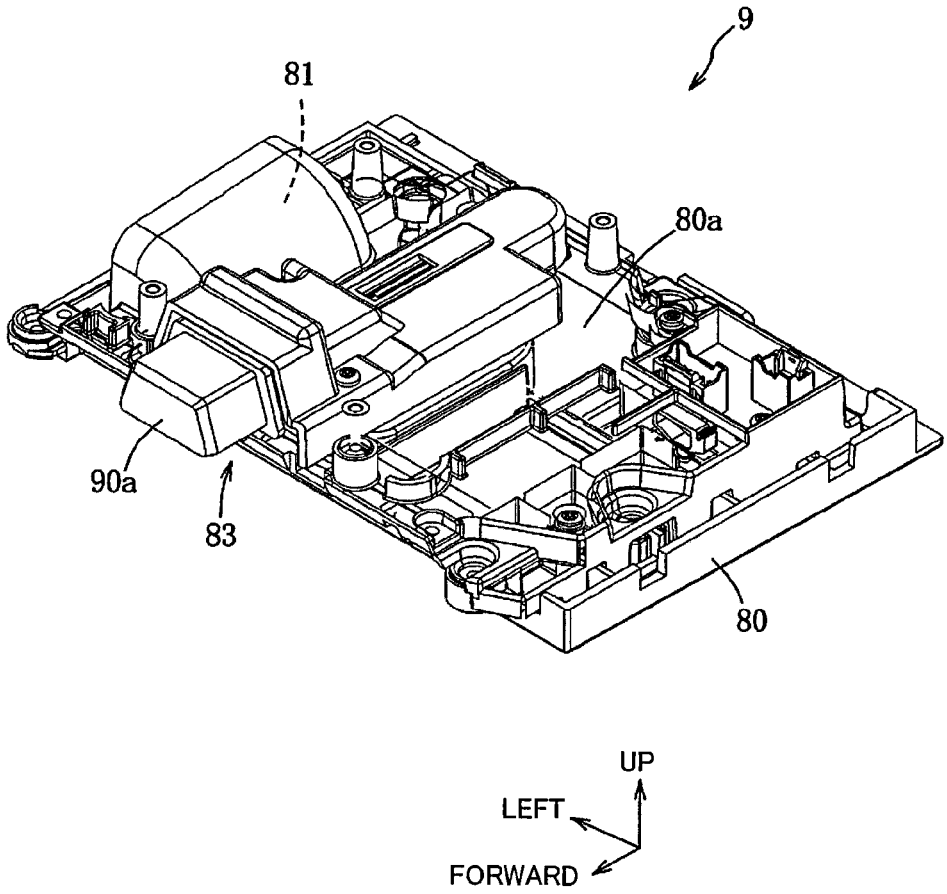
FIG. 26 is an exemplary perspective view showing a discharge device.

The opening and closing mechanism 83 includes: an operating member 90 supported in the case member 80 to be able to move forward and backward and also to be able to be locked in the forward movement retention position shown in FIG. 26; an arm member 91 supported in the case member 80 to be able to rotate about the vertical central axis; an operated member 92 formed integrally with the opening and closing plate 82 on the right side; a first spring 93 that biases the operating member 90 forward; and a second spring 94 that biases the opening and closing plate 82 (the operated member 92) to the left hand (closed position). Here, all the operating member 90, the arm member 91 and the operated member 92 are made of synthetic resin.

The operating member 90 is placed above the arm member 91 and the operated member 92 (the opening and closing plate 82). An operating portion 90*a* is provided in the front end of the operating part 90 to protrude forward from the case member 80 so that the player can operate the operating portion 90*a*. The arm member 91 is formed in a wedge shape in a plan view. The rear end part of the arm member 91 is rotatably supported in the case member 80.

A first engagement pin 90*b* provided at the rear end of the operating member 90 to protrude downward is movably fitted into a first elongate hole 91*a* formed in the length direction of the back part of the arm member 91. A second engagement pin 91*b* provided at the front end of the arm member 91 to protrude downward is movably fitted into a second elongate hole 92*a* formed in the operated member 92 in the longitudinal direction. In this way, the operating member 90, the arm member 91 and the operated member 92 are coupled to each other to operate together.

When the operating member 90 is pushed backward from the forward movement retention position, the pushing force allows the arm member 91 to rotate counterclockwise in a plan view, so that the opening and closing plate 82 is slid to the right hand (open position) with the operated member 92. After that, when released from being pushed, the operating member 90 returns to the forward movement retention position while the open retention mechanism 84 does not hold the opening and closing plate 82 in the open position. Meanwhile, the second spring 94 allows the opening and closing plate 82 to slide to the left hand (closed position) with the operated member 92 to rotate the arm member 91 clockwise in a plane view.

The open retention mechanism 84 includes a held portion 90*c* provided in the operating member 90 to protrude backward, and a holding mechanism part 96 mounted in the case member 80 to be able to hold the held portion 90*c*. When the operating member 90 is pushed up to the backward movement limit position, the held portion 90*c* switches the holding mechanism part 96 from a non-active state to an active state. Next, when the operating member 90 is released from being pushed, the held portion 90*c* is held by the holding mechanism part 96 in an active state, so that the operating member 90 is held in an operation retention position a little before the backward movement limit position and the opening and closing plate 82 is held in the open position.

After that, when the operating member 90 is pushed from the operation retention position to the backward movement limit position again, the held portion 90*c* switches the holding mechanism part 96 from the active state to the non-active state. Next, when the operating member 90 is released from being pushed, the operating member 90 moves forward to the forward movement retention position, so that the opening and closing plate 82 is closed in the closed position.

Figure 28:
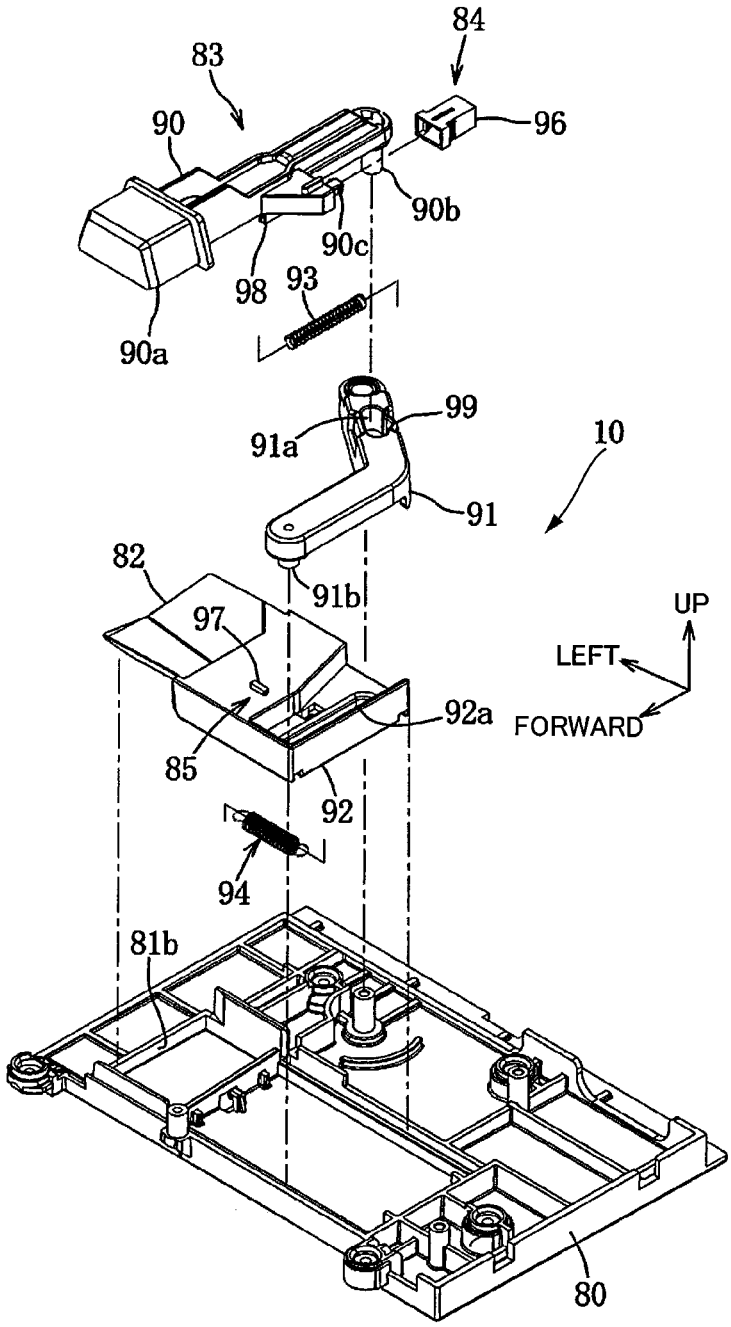
FIG. 28 is an exemplary exploded perspective view showing the discharge device without part of a case member.

The closed lock mechanism 85 includes a first engagement piece 97 provided in the operated member 92 to protrude upward; a second engagement piece 98 provided in the operating member 90 to protrude downward; and a pin escapement concave part 99 which is formed as a cutout and provided in the first elongate hole 91*a* of the arm member 91 (see FIG. 28).

When the operating member 90 is in the forward movement retention position and the opening and closing plate 82 is in the closed position, the first engagement piece 97 is positioned on the left side of the second engagement piece 98 to approach and face the second engagement piece 98. Therefore, even if the player touches the opening and closing plate 82 with one hand to take out playing balls from the lower tray 8 with the hand so that a force is applied to open the opening and closing plate 82, the first engagement piece 97 engages with the second engagement pieces 98. At this time, if there is no force to push the operating member 90 backward, the opening and closing plate 82 is locked in the closed position.

Meanwhile, if the operating member 90 is pushed backward while the operating member 90 is in the forward movement retention position and the opening and closing plate 82 is in the closed position, the first engagement pin 90*b* of the operating member 90 is inserted into the pin escapement concave part 99 of the arm member 91 while the operating member 90 moves back a little. As a result, the driving force is not transmitted from the operating member 90 to the arm member 91, so that the arm member 91 is not rotated, and therefore the opening and closing plate 82 is not slid to the right side but is held in the closed position.

In this period of time, the second engagement piece 98 of the operating member 90 moves backward from the right side of the first engagement piece 97 of the operated member 92. After that, if the operating member 90 continues to be pushed backward, the driving force is transmitted from the operating member 90 to the arm member 91, so that the arm member 91 is rotated. As a result, the opening and closing plate 82 is slid to the right hand without engagement between the first engagement piece 97 and the second engagement piece 98. Here, in a case in which the opening and closing plate 82 is slid leftward from the open position to the closed position, the operating member 90 reaches the forward movement retention position after the opening and closing plate 82 reaches the open position. Therefore, the second engagement piece 98 moves to the right side of the first engagement piece 97 without collision with the first engagement piece 97.

The pachinko game machine 1 described above can produce the following effects. The tray unit 7 is provided with the entertainment button device 9 having the entertainment button 40 that the player can push, and the discharge device 10 provided below the entertainment button device 9 to discharge the playing balls accumulated in the lower tray 8*b* to the outside. The entertainment button device 9 is configured to allow the entertainment button 40 to be pushed from the upper side of the tray unit 7 and is placed on and supported by the discharge device 10.

The discharge device 10 is set in the unit main body 7*a* of the tray unit 7, and the entertainment button device 9 is placed on and supported by the discharge device 10. By this means, the unit main body 7*a* can accept the load (impact load) applied from the entertainment button 40 being pushed, from the entertainment button device 9 through the discharge device 10. Therefore, it is possible to omit a separate structure to firmly mount the entertainment button device 9 to the unit main body 7*a*, and consequently simplify the mounting structure for the entertainment button device 9 and the discharge device 10 in whole.

A large-sized entertainment button device 9 is provided with the large-sized entertainment button 40 moving up and down in a long stroke. The entertainment button device 9 is placed to approach the discharge device 10 below the entertainment button device 9. With this arrangement, the entertainment button device 9 can be placed on and supported by the discharge device 10. The arrangement and the mounting structure of the entertainment button device 9 and the discharge device 10 is appropriate for the large-sized entertainment button device 9.

The discharge device 10 is fixed to the lower part of the unit main body 7*a* of the tray unit 7 via the reinforcing metal plate 39. By this means, it is possible to improve the strength of the mounting structure of the discharge device 10. Moreover, the plate pieces 39*a* and 39*b* of the reinforcing metal plate 39 are placed on and attached to the surface of the plate supporting portions 7*b*1 and 7*b*2 formed in the lower part of the unit main body 7*a*. The discharge device 10 is attached to the reinforcing metal plate 39. Therefore, it is possible to disperse the load applied to the reinforcing metal plate 39, which is generated at the time the entertainment button 40 is pushed, and apply the load to the unit main body 7*a*.

Particularly, the entertainment button 40 of the entertainment button device 9 is large, and therefore the impact load generated at the time the entertainment button 40 is pushed is large. Moreover, the stroke of the entertainment button 40 being pushed from the protruding position to the pushed position is long, so that the impact load generated in the period of time for the stroke is likely to increase. However, with the mounting structure of the discharge device 10, it is possible to reliably prevent the mounting structure itself and the unit main body 7*a* from being damaging.

It is possible to easily mount the entertainment button device 9 and the discharge device 10 to the tray unit 7 by the following steps: coupling the entertainment button device 9 and the discharge device 10 to integrate them; inserting the integrated entertainment button device 9 and discharge device 10 into the device accommodating hole 7*d* of the unit main body 7*a* of the tray unit 7 from underneath; and mounting the discharge device 10 to the unit main body 7*a*. That is, it is possible to reduce the burden of installation of the entertainment button device 9 and the discharge device 10.

The entertainment button device 9 has the button case 50 including the peripheral wall 50*a* and the bottom wall 50*b* that accommodate the entertainment button 40 to be able to move up and down. The button case 50 includes a plurality of (three) outlets 51 to 53 that discharge foreign matters between the outer periphery of the entertainment button 40 and the peripheral wall 50*a* of the button case 50, to the outside of the button case 50.

By this means, it is possible to protect the entertainment button 40 by accommodating the entertainment button 40 to be able to move up and down in the button case 50. In addition, if the player spills beverage on the entertainment button 40 or over the vicinity of the entertainment button 40, and the liquid as a foreign matter enters and flows between the outer periphery of the entertainment button 40 and the peripheral wall 50*a* of the button case 50, the foreign matter is discharged from any of the plurality of outlets 51 to 53 of the button case 50. By this means, the entertainment button 40 can normally move up and down without the interference from the foreign matter.

A plurality of outlets 51 to 53 also serve as air inlets for the space enclosed by the entertainment button 40 and the button case 50 when the entertainment button 40 moves up and down. Therefore, with the plurality of outlets 51 to 53, it is possible to produce an effect of discharging the foreign matter between the outer periphery of the entertainment button 40 and the peripheral wall 50*a* of the button case 50 to the outside of the button case, as described above. Moreover, since the plurality of the outlets 51 to 53 also serve as the air inlets, it is possible to smoothly move the entertainment button 40 up and down. Particularly, thanks to the long stroke of the entertainment button 40, it is possible to produce a great effect of smoothly moving the entertainment button 40 up and down.

The bottom wall 50*b* of the button case 50 is provided to lean forward. The plurality of outlets 51 to 53 are formed in the lower edge of the peripheral wall 50*a* of the button case 50. The central outlet 51 is formed in the lower edge of the front part of the peripheral wall 50*a* of the button case 50. Therefore, the liquid as a foreign matter entering and flowing between the peripheral wall 42*b* of the button cover 42 and the peripheral wall 50*a* of the button case 50 is surely discharged from any of the plurality of outlets 51 to 53 directly, or, after reaching the bottom wall 50*b* of the button case 50 once.

The plurality of outlets 51 to 53 are formed apart from each other in the circumference direction in the lower edge of the peripheral wall 50*a* of the button case 50. Therefore, it is possible to ensure the coupling (connection) between the peripheral wall 50*a* and the bottom wall 50*b* of the button case 50, that is, the button case 50 is robustly constructed, and then it is possible to form the plurality of outlets 51 to 53 in the button case 50.

The button-up-and-down mechanism 60 includes: the button guide mechanism 61 that allows the entertainment button 40 to move up and down and that restricts the entertainment button 40 from rotating; the pair of biasing members 55 that biases the entertainment button 40 in the moving-up direction; the shaft member 68 that extends in the moving direction of the entertainment button 40; the rotating mechanism 70 that rotates the shaft member 68; the pair of engagement parts 76 provided in the entertainment button 40; and the pair of spiral guide parts 77 provided in the outer periphery of the shaft member 68. The pair of engagement parts 76 engages with the pair of spiral guide parts 77, respectively, while the entertainment button 40 is biased by the pair of biasing members 55, and the shaft member 68 is rotated by the rotating mechanism 70 so that the pair of spiral guide parts 77 moves the pair of engagement part 76 in the moving-down direction.

In this way, the rotating mechanism 70 rotates the shaft member 68, and therefore it is possible to smoothly move the entertainment button 40 up and down; allow the entertainment button 40 to desirably move up and down (stop temporarily, and move up and down repeatedly); and freely change the speed at which the entertainment button 40 moves up and down. As a result, it is possible to improve the effect of the entertainment of the game with the up-and-down movement of the entertainment button 40. Particularly, a large-sized entertainment button device 9 can be provided with the large-sized entertainment button 40 moving up and down in a long stroke.

The button-up-and-down mechanism 60 moves the entertainment button 40 between a predetermined normal operation position and the protruding position in which the entertainment button 40 protrudes upward from the normal operation position. The button-up-and-down mechanism 60 allows the entertainment button 40 to be pushed from any position including the normal operation position and the protruding position to the pushed position in which the entertainment button 40 retracts from the normal operation position.

That is, the button-up-and-down mechanism 60 can be configured not to interfere with the entertainment button 40 being pushed to the pushed position whenever the player pushes the entertainment button 40, for example, when the entertainment button 40 is held in the normal operation position or the protruding position, or when the entertainment button 40 is moved up and down by the button-up-and-down mechanism 60. Therefore, it is possible to ensure the degree of freedom of the entertainment button 40 being operated, and therefore improve operability.

The shaft member 68 is configured to be inserted into the entertainment button 40 from the base end side of the entertainment button 40. Therefore, the shaft member 68 can be provided in the entertainment button 40 not to be exposed to the outside. In addition, the entertainment button 40 is provided with the movable annular member 43*b* placed outside the outer periphery of the shaft member 68, and the pair of engagement parts 76 protrudes from the inner periphery of the movable annular member 43*b* to the shaft member 68 side to be able to engage with the pair of spiral guide parts 77. Accordingly, it is possible to reliably engage the pair of engagement parts 76 with the pair of spiral guide parts 77 to steadily move the entertainment button 40 up and down.

Each spiral guide part 77 includes the first spiral guide portion 77*a* and the second spiral guide portion 77*b*. The second spiral guide portion 77*b* continues to the front end of the first spiral guide portion 77*a* and has a greater angle of inclination than of the first spiral guide portion 77*b*. Therefore, when the rotating speed of the shaft member 68 is fixed, the speed at which the entertainment button 40 moves up and down is slower in a first case in which the pair of engagement parts 76 engages with the pair of first spiral guide portions 77*a* than in a second case in which the pair of engagement parts 76 engages with the pair of second spiral guide portions 77*b*. That is, the load on the shaft member 68 to move the entertainment button 40 up and down is smaller in the first case than in the second case.

In addition, the rotating mechanism 70 rotate and move the shaft member 68 up and down while the load on the shaft member 68 to move the entertainment button 40 up and down is reduced, that is, the pair of engagement parts 76 engages the pair of the first spiral guide portions 77*a*. By this means, it is possible to allow the entertainment button 40 to repeatedly move up and down smoothly. It is preferable to move the entertainment button 40 up and down in a position in which the entertainment button 40 moves up a little from the normal operation position. By this means, it is possible to perform an entertainment to excite the player about whether or not the entertainment button 40 moves to the protruding position.

The pair of smoothing guide parts 78 is formed on the outer periphery of the shaft member 68. The pair of smoothing guide parts 78 continues to the base ends of the pair of spiral guide parts 77 and extends in parallel with the plane orthogonal to the central axis of the shaft member 78. The pair of engagement parts 76 engages with the pair of smoothing guide parts 78 to hold the entertainment button 40 in the normal operation position. Accordingly, it is possible to reliably hold the entertainment button 40 in the normal operation position. In addition, when the button-up-and-down mechanism 60 moves the entertainment button 40 down, the pair of engagement parts 76 is smoothly moved from the pair of spiral parts 77 to the pair of smoothing parts 78, and therefore it is possible to smoothly move the entertainment button 40 down to the normal operation position.

With the pair of engagement parts 76 and the pair of spiral guide parts 77, the button-up-and-down mechanism 60 can more smoothly and stably move the entertainment button 40. Here, although an arrangement has been described where one pair of engagement parts 76 and one pair of spiral guide parts 77 are provided, three or more pairs are possible.

The structure of the entertainment button device 9 has been explained so far, and then the control of the pachinko game machine 1 will be explained.

Figure 31:
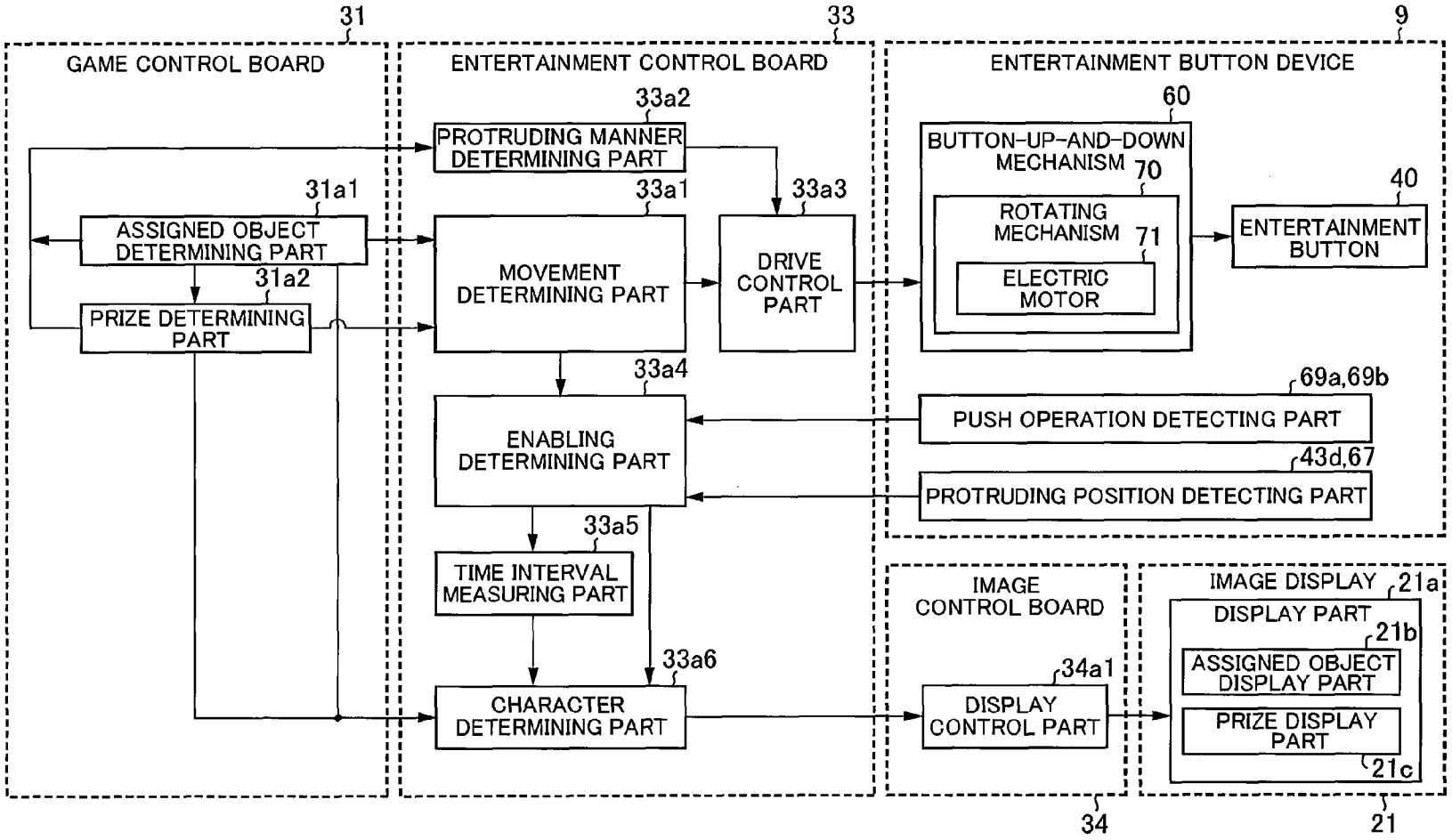
FIG. 31 is an exemplary block diagram showing the typical functions of a pachinko game machine.

FIG. 31 is an exemplary block diagram showing the typical functions of a pachinko game machine. Here, the pachinko game machine 1 has various functions as well as the functions shown in FIG. 31.

As shown in FIG. 31, the entertainment button device 9 includes the button-up-and-down mechanism 60, the entertainment button 40, the push operation detecting parts 69*a* and 69*b*, and the protruding position detecting parts 43*d* and 67 as described above. As described above, the push operation detecting part includes the first push operation detecting part 69*a* and the second push operation detecting part 69*b*. Meanwhile, the protruding position detecting part includes the first protruding position detecting part 67 and the second protruding position detecting part 43*d*. The button-up-and-down mechanism 60 includes the rotating mechanism 70 having the electric motor 71.

The game control board 31 includes an assigned object determining part 31*a*1 and a prize determining part 31*a*2.

The assigned object determining part 31*a*1 performs processing to determine an assigned object that defines the result of a bonus game lottery.

When the assigned object determining part 31*a*1 determines a certain assigned object, the prize determining part 31*a*2 performs processing to determine a prize to be given to the player.

The entertainment control board 33 includes a movement determining part 33*a*1, a drive control part 33*a*3, a protruding manner determining part 33*a*2, an enabling determining part 33*a*4, a time interval measuring part 33*a*5 and a character determining part 33*a*6.

The movement determining part 33*a*1 performs processing to determine whether or not to move the entertainment button 40 from the normal operation position to the protruding position, based on the assigned object determined by the assigned object determining part 31*a*1 or the prize determined by the prize determining part 31*a*2. To be more specific, when the assigned object determining part 31*a*1 determines an assigned object, the movement determining part 33*a*1 performs processing to determine whether or not to move the entertainment button 40 from the normal operation position to the protruding position, based on the assigned object determined by the assigned object determining part 31*a*1, before the assigned object display part 21*b* finally stops and displays the assigned object symbol corresponding to the assigned object determined by the assigned object determining part 31*a*1. Moreover, when the prize determining part 31*a*2 determining a prize, the movement determining part 33*a*1 performs processing to determine whether or not to move the entertainment button 40 from the normal operation position to the protruding position, based on the prize determined by the prize determining part 31*a*2, before the prize display part 21*c* finally stops and displays the prize symbol corresponding to the prize determined by the prize determining part 31*a*2.

The protruding manner determining part 33*a*2 performs processing to determine a protruding manner in which the entertainment button 40 moves from the normal operation position to the protruding position, based on the assigned object determined by the assigned object determining part 31*a*1, or the prize determined by the prize determining part 31*a*2.

When the movement determining part 33*a*1 determines to move the entertainment button 40 from the normal operation position to the protruding position, the drive control part 33*a*3 performs drive processing to move the entertainment button 40 from the normal operation position to the protruding position in the protruding manner determined by the protruding manner determining part 33*a*2. To be more specific, in order to move the entertainment button 40 in the direction of the protruding position, the drive control part 33*a*3 controls the electric motor 71 of the rotating mechanism 70 to rotate the shaft member 68 in a specific direction. Meanwhile, in order to move the entertainment button 40 in the direction of the normal operation position, the drive control part 33*a*3 controls the electric motor 71 of the rotating mechanism 70 to rotate the shaft member 68 in the direction opposite to the specific direction. Moreover, when the protruding position detecting parts 43*d* and 67 detect the entertainment button 40 being held in the protruding position until a predetermined time has elapsed, the drive control part 33*a*3 controls the electric motor 71 of the rotating mechanism 70 to rotate the shaft member 68 in the direction opposite to the specific direction thereby to move the entertainment button 40 in the direction of the normal operation position.

When the push operation detecting parts 69*a* and 69*b* detect the entertainment button 40 being pushed, the enabling determining part 33*a*4 determines whether or not the detected push operation on the entertainment button 40 is enabled. To be more specific, when the movement determining part 33*a*1 determines to move the entertainment button 40 from the normal operation position to the protruding position, the enabling determining part 33*a*4 performs processing to determine that the push operation on the entertainment button 40, which has been detected by the push operation detecting parts 69*a* and 69*b*, is disabled, until the protruding position detecting parts 43*d* and 67 detect the entertainment button 40 being held in the protruding position.

When the protruding position detecting parts 43*d* and 67 detect the entertainment button 40 being held in the protruding position, the time interval measuring part 33*a*5 performs processing to measure the time interval until the push operation detecting parts 69*a* and 69*b* detect the entertainment button 40 being pushed since the protruding position detecting parts 43*d* and 67 no longer have detected the entertainment button 40 being held in the protruding position.

The character determining part 33*a*6 performs processing to determine a character to be displayed on the display part 21*a*.

In addition, when the protruding position detecting parts 43*d* and 67 detect the entertainment button 40 being held in the protruding position, the character detecting part 33*a*6 performs processing to determine a specific character. In addition, when the push operation detecting parts 69*a* and 69*b* detect the entertainment button 20 being pushed, and the enabling determining part 33*a*4 determines that the push operation on the entertainment button 40 is enabled, the character determining part 33*a*6 performs processing to determine a character, based on the time interval measured by the time interval measuring part 33*a*5.

Here, "character" refers to an image or an object to be displayed on the display part 21*a*, which includes the assigned object symbol corresponding to the assigned object determined by the assigned object determining part 31*a*1, and the prize symbol corresponding to the prize determined by the prize determining part 31*a*2.

Then, in order to display an assigned object symbol, the character determining part 33*a*6 determines the character for the assigned object symbol, based on the assigned object determined by the assigned object determining part 31*a*1. Meanwhile, in order to display a prize symbol, the character determining part 33*a*6 determines the character for the prize symbol based on the prize determined by the prize determining part 31*a*2.

The image control board 34 includes a display control part 34*a*1 that controls the display of a character on the image display 21. To be more specific, the display control part 34*a*1 controls the display of the character determined by the character determining part 33*a*6 on the image display 21.

The image display 21 includes a display part 21*a* to display characters related to the contents of a game.

In addition, the display part 21*a* includes an assigned object display part 21*b* and a prize display part 21*c*. The assigned object display part 21*b* displays the assigned object symbol corresponding to the assigned object determined by the assigned object determining part 31*a*1. The prize display part 21*c* displays the prize symbol corresponding to the prize determined by the prize determining part 31*a*2.

To be more specific, when the push operation detecting parts 69*a* and 69*b* detect the entertainment button 40 being pushed, the assigned object display part 21*b* performs processing to display the assigned object symbol corresponding to the assigned object determined by the assigned object determining part 31*a*1.

Meanwhile, when the push operation detecting parts 69*a* and 69*b* detect the entertainment button 40 being pushed, the prize display part 21*c* performs processing to display the prize symbol corresponding to the prize determined by the prize determining part 31*a*2.

Next, with reference to FIG. 32 to FIG. 34, each table stored in the ROM 31*b* of the game control board 31 will be explained in detail.

<First Assigned Object Determination Table>

FIG. 32 shows a first assigned object determination table used in bonus game lottery.

As shown in FIG. 32, the first assigned object determination table includes random number values for bonus game determination and the results of a bonus game lottery, which are associated with each other.

Here, a random number value for bonus game determination is obtained by the CPU 31*a* of the game control board 31 at the time a playing ball enters one of the first start-up hole 13 and the second start-up hole 14, as described later.

The assigned object determining part 31*a*1 (the CPU 31*a* of the game control board 31) refers to the first assigned object determination table shown in FIG. 32, and determines "jackpot" or "loss", based on the obtained random number value for bonus game determination.

For example, with the first assigned object determination table shown in FIG. 32, one random number value for bonus game determination "7" is selected as "jackpot" among the random number values for bonus game determination 0 to 299. On the other hand, the random number values for bonus game determination other than "7" are determined as "loss." The range of the random number values for bonus game determination is 0 to 299, and therefore the probability that jackpot is determined is 1/300.

<Second Assigned Object Determination Table>

FIG. 33 shows a second assigned object determination table to determine the special symbol to be stopped, which corresponds to the result of a bonus game lottery.

As shown in FIG. 33, the second assigned object determination table includes the results of a bonus game lottery, the random number values for bonus game symbol and the data on the special symbol to be stopped, which are associated with each other. Here, with the present embodiment, when the result of a bonus game lottery is loss, random number values for bonus game symbol are not regarded, but the loss is associated with the data on the special symbol to be stopped one-on-one.

Here, like a random number value for bonus game determination, a random number value for bonus game symbol is obtained by the CPU 31*a* of the game control board 31 at the time a playing ball enters one of the first start-up hole 13 and the second start-up hole 14*a*.

The assigned object determining part 31*a*1 (the CPU 31*a* of the game control board 31) refers to the second assigned object determination table shown in FIG. 33, and determines data on the special symbol to be stopped, based on the result of a bonus game lottery and the random number value for bonus game symbol.

Then, at the time of the start of blinking the special symbol, the assigned object determining part 31*a*1 (the CPU 31*a* of the game control board 31) creates an assigned object command, as special symbol information, based on the determined data on the special symbol to be stopped, and transmits the created assigned object command to the entertainment control board 33. Here, an assigned object command is composed of 2 bytes of data. To be more specific, an assigned object command is composed of 1 byte of MODE data to identify the class of the control command, and 1 byte of DATA data to represent the contents of the control command to be executed. The same applies to a round number command and so forth described later.

Here, the round number (see FIG. 34) of a bonus game is determined based on the data on the special symbol to be stopped, so that it is understood that a prize is determined by the data on the special symbol to be stopped.

<Prize Determination Table>

FIG. 34 shows a prize determination table to determine the round number of a bonus game, as a prize to be given to the player.

Here, the round number means how many times one of the first and second bonus game holes 16*a* and 17*a* opens in a bonus game.

The prize determination table shown in FIG. 34 includes the data on the special symbol to be stopped and the round numbers, which are associated with each other.

The prize determining part 31*a*2 (the CPU 31*a* of the game control board 31) refers to the prize determination table shown in FIG. 34, and determines the round number based on the data on the special symbol to be stopped.

Then, if 16R is determined as the round number, one of the first bonus game hole 16*a* and the second bonus game hole 17*a* opens sixteen times. Therefore, the player can get a greater prize than when 4R is determined as the round number.

At the time of the start of a bonus game, the prize determining part 31*a*2 (the CPU 31*a* of the game control board 31) creates a round number command, as round number information, based on the determined round number, and transmits the created round number command to the entertainment control board 33.

Next, the details of each table stored in the ROM 33*b* in the entertainment control board 33 will be explained with reference to FIG. 35 to FIG. 37.

<First Movement Determination Table>

FIG. 35A shows a first movement determination table to determine whether or not to move the entertainment button 40 from the normal operation position to the protruding position, based on the assigned object determined by the assigned object determining part 31*a*1.

The first movement determination table shown in FIG. 35A includes assigned object data, random number values for movement determination, and movement data, which are associated with each other.

Here, "random number value for movement determination" is a random number value obtained when movement data is determined. In addition, "movement data" is data representing that the entertainment button 40 is moved from the normal operation position to the protruding position.

Then, the movement determining part 33*a*1 (the CPU 33*a* of the entertainment control board 33) refers to the first movement determination table shown in FIG. 35A, and determines movement data based on the assigned object data and the random number value for movement determination.

With the present embodiment, the first movement determination table shown in FIG. 35A represents that the assigned object data "jackpot" has a higher probability that movement data is determined than the assigned object data "loss", by the assignment of the random number values for movement determination.

Therefore, when the entertainment button 40 moves from the normal operation position to the protruding position, it is possible to give the player an expectation that "jackpot" is determined as the assigned object.

<Second Movement Determination Table>

FIG. 35B shows a second movement determination table to determine whether or not to move the entertainment button 40 from the normal operation position to the protruding position, based on the prize determined by the prize determining part 31*a*2.

The second movement determination table shown in FIG. 35B includes round number data, random number values for movement determination and movement data, which are associated with each other.

Then, the movement determining part 33*a*1 (the CPU 33*a* of the entertainment control board 33) refers to the second movement determination table shown in FIG. 35B, and determines movement data based on the round number data and the random number value for movement determination.

With the present embodiment, the second movement determination table shown in FIG. 35B represents that the round number data "16R" has a higher probability that movement data is determined than the round number data "10R", by the assignment of the random number values for movement determination. Moreover, no movement data is determined for "4R" and "8R", which are small numbers.

By this means, when the entertainment button 40 moves from the normal operation position to the protruding position, it is possible to inform that the round number data is one of "10R" and "16R." Here, even if the entertainment button 40 does not move from the normal operation position to the protruding position, the round number data is one of "4R", "8R", "10R" or "16R." Therefore, it is possible to prevent the player who wishes that a great prize has been determined from being disappointed.

<First Protruding Manner Determination Table>

FIG. 36A shows a first protruding manner determination table to determine a protruding manner in which the entertainment button 40 moves from the normal operation position to the protruding position, based on the assigned object determined by the assigned object determining part 31*a*1.

The first protruding manner determination table shown in FIG. 36A includes assigned object data, random number values for protrusion and protruding manner data, which are associated with each other.

Here, "random number value for protrusion" is a random number value obtained when protruding manner data is determined.

"Protruding manner 1" shown in FIG. 36A is used to rotate the shaft member 68 in II direction in order to move the entertainment button 40 to the protruding position at a stretch. "Protruding manner 2" is used to rotate the shaft member 68 in I direction at a constant rate to slowly move the entertainment button 40 to the protruding position. "Protruding manner 3" is used to alternately rotate and stop the shaft member 68 in I direction to alternately move and stop the entertainment button 40 to get the entertainment button 40 to the protruding position.

Then, the protruding manner determining part 33*a*2 (the CPU 33*a* of the entertainment control board 33) refers to the first protruding manner determination table shown in FIG. 36A, and determines protruding manner data, based on the assigned object data and the random number value for protrusion.

With the present embodiment, the first protruding manner determination table shown in FIG. 36A represents that the assigned object data "jackpot" has a higher probability that "protruding manner 2" is determined than the assigned object data "loss", by the assignment of the random number values for protrusion. Moreover, "protruding manner 3" is determined only for the assigned object data "jackpot."

By this means, it is possible to give the player an expectation that "jackpot" is determined as the assigned object depending on the protruding manner in which the entertainment button 40 moves to the protruding position.

<Second Protruding Manner Determination Table>

FIG. 36B shows a second protruding manner determination table to determine a protruding manner in which the entertainment button 40 moves from the normal operation position to the protruding position, based on the prize determined by the prize determining part 31*a*2.

The second protruding manner determination table shown in FIG. 36B includes round number data, random number values for protrusion and protruding manner data, which are associated with each other.

"Random number values for protrusion" and "protruding manner data" are the same as the data in the first protruding manner determination table shown in FIG. 36A.

Then, the protruding manner determining part 33*a*2 (the CPU 33*a* of the entertainment control board 33) refers to the second protruding manner determination table shown in FIG. 36B, and determines protruding manner data, based on the round number data and the random number value for protrusion.

With the present embodiment, the second protruding manner determination table shown in FIG. 36B represents that the round number data "16R" has a higher probability that "protruding manner 2" is determined than the round number data "10R", by the assignment of the random number values for protrusion. Moreover, "protruding manner 3" is determined only for the round number data "16R". In this way, it is possible to give the player an expectation that the large number of rounds is determined, depending on the protruding manner in which the entertainment button 40 moves to the protruding position.

<First Regular Character Determination Table>

FIG. 37A shows a first regular character determination table to determine a character to be displayed on the image display 21 (the assigned object display part 21*b*), based on the assigned object determined by the assigned object determining part 31*a*1, at the time the push operation detecting parts 69*a* and 69*b* detect the entertainment button 40 in the normal operation position being pushed.

The first regular character determination table includes assigned object data and character data, which are associated with each other.

"Character data" shown in FIG. 37A is also used in a first special character determination table shown in FIG. 37B described later. "Character 02" is used to display the assigned object as "jackpot" in the second display manner. "Character 05" is used to display the assigned object as "loss" in the second display manner.

Then, a character determining part 33*a*6 (the CPU 33*a* of the entertainment control board 33) refers to the first regular character determination table shown in FIG. 37A, and determines character data based on the assigned object data.

<First Special Character Determination Table>

FIG. 37B shows the first special character determination table to determine a character to be displayed on the image display 21 (the assigned object display part 21*b*), based on the assigned object determined by the assigned object determining part 31*a*, at the time the push operation detecting parts 69*a* and 69*b* detect the entertainment button 40 in the protruding position being pushed.

The first special character determination table shown in FIG. 37B includes assigned object data, time intervals and character data, which are associated with each other.

"Characters 01 to 03" shown in FIG. 37B are used to display the first assigned object symbol for jackpot. Here, "character 01" is used to display the first assigned object symbol in the first display manner. "Character 02" is used to display the first assigned object symbol in the second display manner. "Character 03" is used to display the first assigned object symbol in the third display manner. "Characters 04 to 06" are used to display the second assigned object symbol for loss. Here, "character 04" is used to display the second assigned object symbol in the first display manner. "Character 05" is used to display the second assigned object symbol in the second display manner. "Character 06" is used to display the second assigned object symbol in the third display manner.

Figure 58:
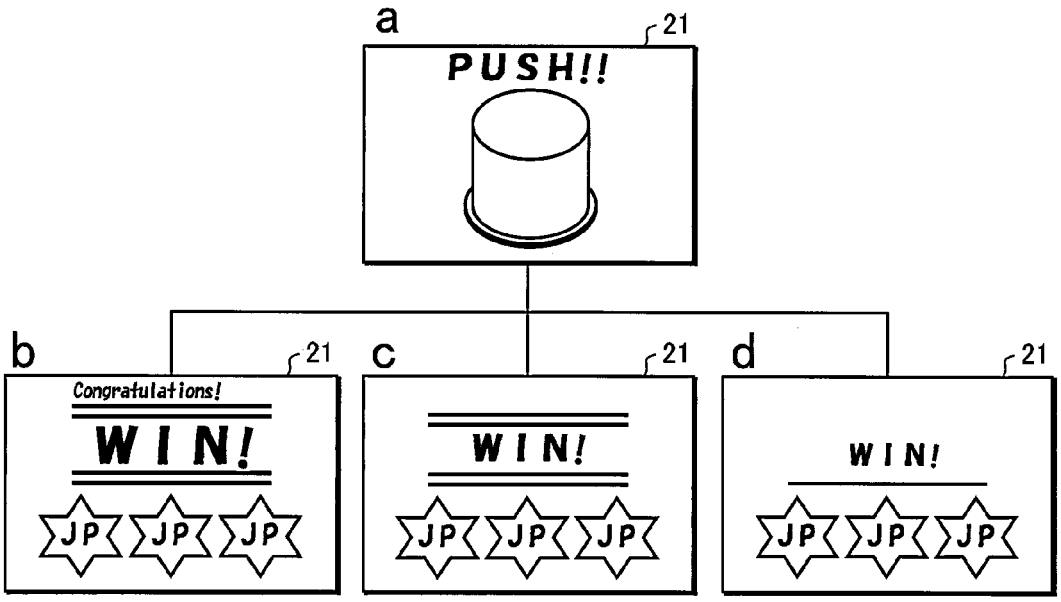
FIG. 58 shows examples of a display screen 1 of an image display each displaying an assigned object symbol.

With the present embodiment, for example, a large prominent decorative image is displayed in the first display manner, a normal decorative image is displayed in the second display manner, and a small decorative image is displayed in the third display manner, in addition to the first assigned object symbol or the second assigned object symbol (see FIG. 58).

Then, the character determining part 33*a*6 (the CPU 33*a* of the entertainment control board 33) refers to the first special character determination table shown in FIG. 37B, and determines character data based on the assigned object data and the time interval.

By this means, it is possible to change the display manner depending on the speed at which the player pushes the entertainment button 40.

<Second Regular Character Determination Table>

FIG. 37C shows a second regular character determination table to determine a character to be displayed on the image display 21 (the prize display part 21*c*), based on the prize determined by the prize determining part 31*a*2, at the time the push operation detecting parts 69*a* and 69*b* detect the entertainment button 40 in the normal operation position being pushed down.

The second regular character determination table shown in FIG. 37C includes round number data and character data, which are associated with each other.

"Character data" shown in FIG. 37C is also used in a second special character determination table shown in FIG. 35D described later. Here, "character 12" is used to display "16R" in the second display manner; "character 15" is used to display "10R" in the second display manner; "character 18" is used to display "8R" in the second display manner; and "character 21" is used to display "4R" in the second display manner.

Then, the character determining part 33*a*6 (the CPU 33*a* of the entertainment control board 33) refers to the second regular character determination table shown in FIG. 37C, and determines character data based on the round number data.

<Second Special Character Table>

FIG. 37D shows a second special character determination table to determine a character to be displayed on the image display 21 (prize display part 21*c*), based on the prize determined by the prize determining part 31*a*2, at the time the push operation detecting parts 69*a* and 69*b* detect the entertainment button 40 in the protruding position being pushed.

The second special character determination table shown in FIG. 37D includes round number data, time intervals and character data, which are associated with each other.

"Character 11" is used to display "16R" in the first display manner; "character 12" is used to display "16R" in the second display manner; and "character 13" is used to display "16R" in the third display manner. In addition, "character 14" is used to display "10R" in the first display manner; "character 15" is used to display "10R" in the second display manner; and "character 16" is used to display "10R" in the third display manner. In addition, "character 17" is used to display "8R" in the first display manner; "character 18" is used to display "8R" in the second display manner; and "character 19" is used to display "8R" in the third display manner. Moreover, "character 20" is used to display "4R" in the first display manner; "character 21" is used to display "4R" in the second display manner; and "character 22" is used to display "4R" in the third display manner.

Figure 60:
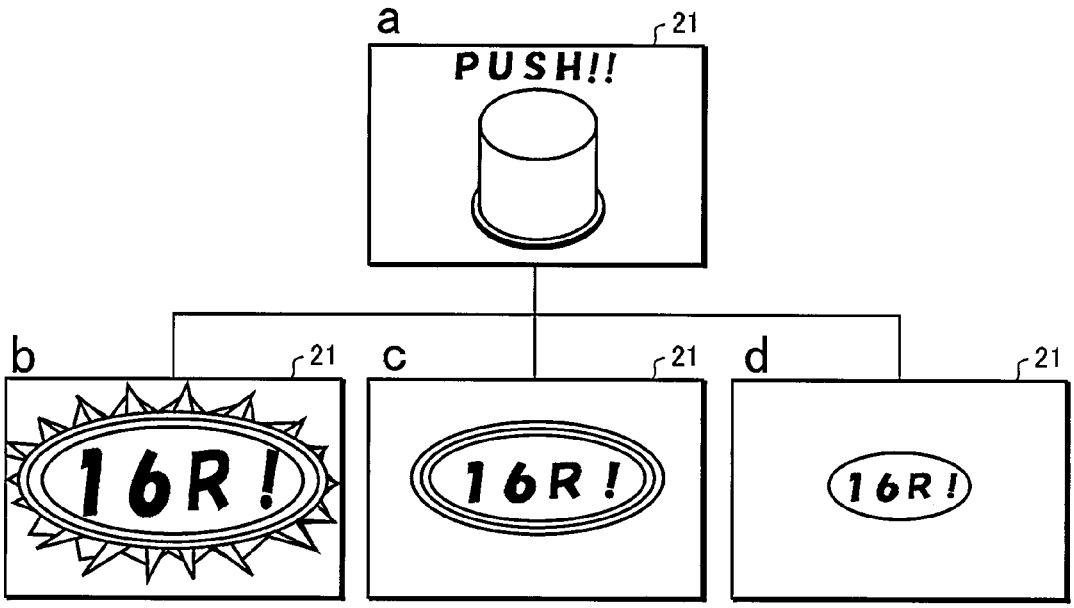
FIG. 60 shows examples of the display screen 1 of the image display, each displaying a prize symbol.

With the present embodiment, for example, in the first display manner, a round number is displayed in larger letters with a large prominent decoration; in the second display manner, a round number is displayed in normal-sized letters with a normal decoration; and in the third display manner, a round number is displayed in smaller letters with a small decoration (see FIG. 60).

Then, the character determining part 33*a*6 (the CPU 33*a* of the entertainment control board 33) refers to the second special character determination table shown in FIG. 37D, and determines character data based on the round number data and the time interval.

By this means, it is possible to change the display manner depending on the speed at which the player pushes the entertainment button 40.

Next, the progress of a game on the pachinko game machine 1 will be explained by using flowcharts. First, processing performed by the CPU 31*a* of the game control board 31 will be explained.

<Main Processing on the Game Control Board>

Figure 38:
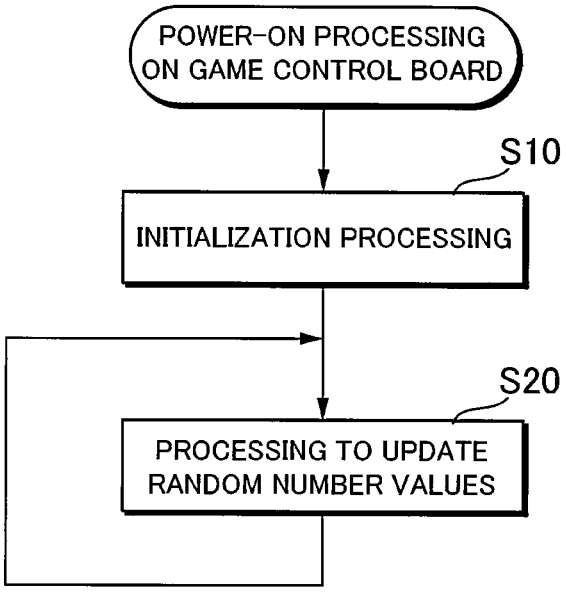
FIG. 38 shows exemplary main processing on a game control board.

With reference to FIG. 38, power-on processing will be explained, which is started at the time the game control board 31 is turned on.

When the pachinko game machine 1 is turned on, the CPU 31*a* of the game control board 31 is reset and performs the following power-on processing.

First, in step S10, the CPU 31*a* of the game control board 31 performs initialization processing. In this processing, the CPU 31*a* of the game control board 31 reads a boot program from the ROM 31*b* of the game control board 31 in response to the power-on, and performs processing to initialize flags and so forth stored in the RAM 31*c* of the game control board 31.

In step S20, the CPU 31*a* of the game control board 31 performs processing to update random number values including: the random number value used to determine the blinking manner (blinking period of time) of the special symbol; the random number value for bonus game determination, which is used in a bonus game lottery; the random number value to determine data on the special symbol to be stopped; and the random number value for regular symbol determination used in a lottery.

This processing to update these random number values is performed by incrementing each random number value by one and updating the value. Then, when a preset range of random number values is exceeded, processing to reset to 0 is performed.

After that, processing of step S20 is repeatedly performed until a predetermined interrupt processing is performed.

<Timer Interrupt Processing on the Game Control Board>

Figure 39:
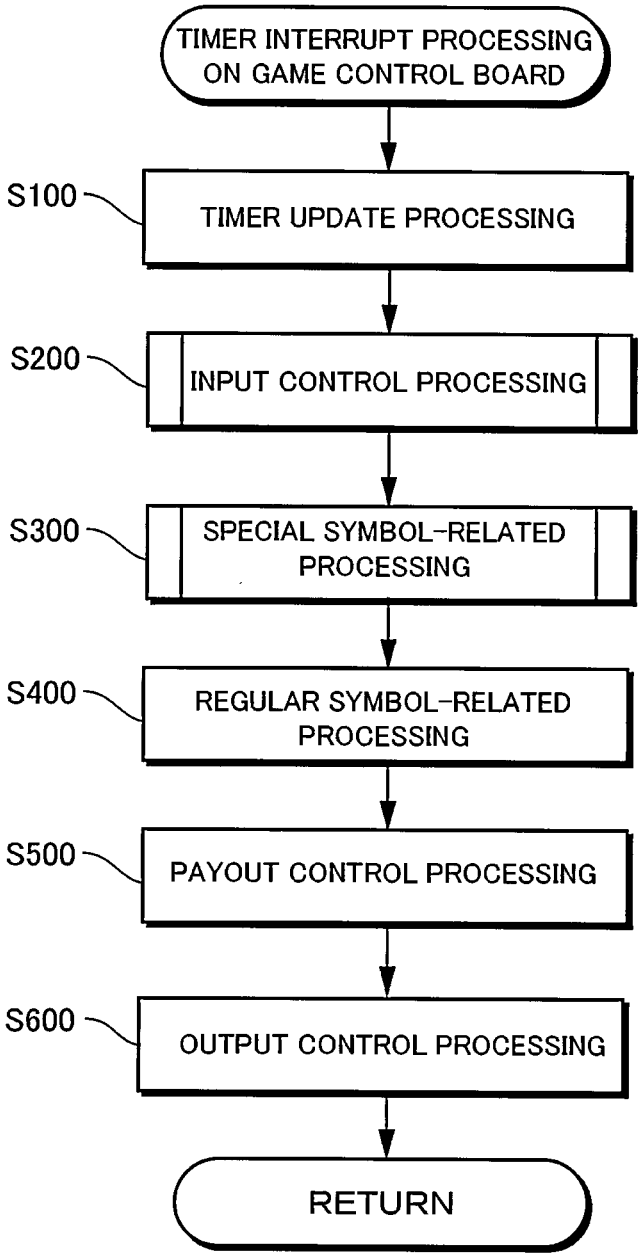
FIG. 39 shows exemplary timer interrupt processing on the game control board.

With reference to FIG. 39, timer interrupt processing on the game control board 31 will be explained.

The following timer interrupt processing is performed every time a reset clock pulse generating circuit provided on the game control board 31 generates a clock pulse with a predetermined period (4 ms).

In step S100, the CPU 31*a* of the game control board 31 performs timer update processing to update each timer counter in the RAM 31*c*.

This timer update processing is performed by decrementing, by one, each timer counter that counts, for example, the period of time for which the special symbol is blinking; the period of time for which the bonus game hole is open; the period of time for which the bonus game hole is closed; the time interval until a bonus game starts; the period of time until a bonus game ends; the period of time for which a regular symbol is changing; and the period of time for which the second start-up hole is open.

In step S200, the CPU 31*a* of the game control board 31 performs input control processing.

In this input control processing, the CPU 31*a* of the game control board 31 determines whether or not each of the winning hole SW 18*a*, the first bonus game hole SW 16*c*, the second bonus game hole SW 17*c*, the first start-up hole SW 13*a*, the second start-up hole SW 14*c* and the gate SW 15*a* receives a signal as input, and, if each switch receives the signal as input, the CPU 31*a* performs input control processing to set a predetermined data.

<Input Control Processing on the Game Control Board>

Figure 40:
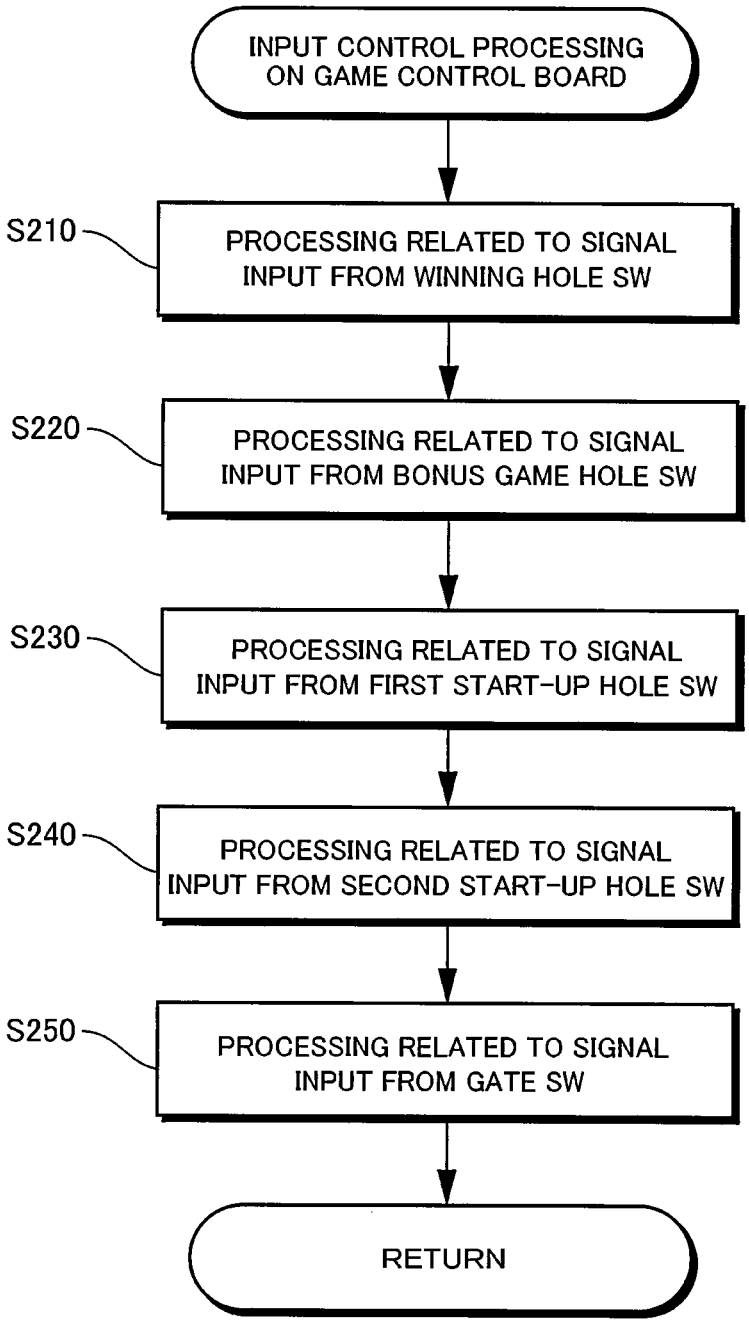
FIG. 40 shows exemplary input control processing on the game control board.

With reference to FIG. 40, input control processing on the game control board 31 will be explained.

In step S210, the CPU 31*a* of the game control board 31 performs processing related to signal input from the winning hole SW. To be more specific, the CPU 31*a* determines whether or not a detection signal has been received from a winning hole SW 18*a*, as input. If no detection signal has been received from the winning hole SW 18*a* as input, the step moves directly to the next step. On the other hand, when a detection signal has been inputted from the winning hole SW. 18*a*, first payout data is added to a prize ball counter of the RAM 31*c* and updated in order to pay out a first number (e.g. ten) of playing balls, and then the step moves to the next step.

In step S220, the CPU 31*a* of the game control board 31 performs processing related to signal input from the bonus game hole SW. To be more specific, the CPU 31*a* determines whether or not a detection signal has been received from the first bonus game hole SW 16*c* or the second bonus game hole SW 17*c*, as input. If no detection signal has been received from the first bonus game hole SW 16*c* or the second bonus game hole SW 17*c* as input, the step moves directly to the next step. On the other hand, when a detection signal has been received from the first bonus game hole SW 16*c* or the second bonus game hole SW 17*c* as input, second payout data is added to the prize ball counter of the RAM 31*c* and updated in order to pay out a second number (e.g. fifteen) of playing balls. Moreover, the CPU 31*a* increments the value stored in the storage area for the number of playing balls entering the bonus game holes in the RAM 31*c* by one and updates the value in order to count the number of playing balls having entered the first bonus game hole 16*a* or the second bonus game hole 17*a*, and then moves the step to the next step.

In step S230, the CPU 31*a* of the game control board 31 performs processing related to signal input from the first start-up hole SW. To be more specific, the CPU 31*a* determines whether or not a detection signal has been received from the first start-up hole SW 13*a*. If no detection signal has been received from the first start-up hole SW 13*a*, as input, the step moves directly to the next step. On the other hand, when a detection signal has been received from the first start-up hole SW 13*a*, third payout data is added to the prize ball counter of the RAM 31*c* and updated in order to pay out a third number (e.g. five) of playing balls. Then, when the data set in the storage area for first special symbol reserve number (U1) is smaller than four, the CPU 31 increments the value stored in the storage area for first special symbol reserve number (U1) by one, obtains the random number value for bonus game determination, the random number value for bonus game symbol and the random number value for blinking, and stores the obtained random number values in predetermined storage parts (zero to fourth storage parts) in a first storage area for random number value of special symbol in the RAM 31*c*, and after that, the step moves to the next step.

In step S240, the CPU 31*a* of the game control board 31 performs processing related to signal input from the second start-up hole SW. To be more specific, the CPU 31*a* determines whether or not a detection signal has been received from the second start-up hole SW 14*c*, as input. If no detection signal has been received from the second start-up hole SW 14*c*, the step moves directly to the next step. On the other hand, a detection signal has been received from the second start-up hole SW 14*c*, third payout data is added to the prize ball counter and updated in order to pay out a third number (e.g. five) of playing balls. Then, when the data set in the storage area for second special symbol reserve number (U2) is smaller than four, the CPU 31 increments the value stored in the storage area for second special symbol reserve number (U2) by one, obtains the random number value for bonus game determination, the random number value for bonus game symbol and the random number value for blinking, and stores the obtained random number values in predetermined storage parts (zero to fourth storage parts) in a second storage area for random number value of special symbol in the RAM 31*c*, and after that, the step moves to the next step.

In step S250, the CPU 31*a* of the game control board 31 performs processing related to signal input from gate SW. To be more specific, the CPU 31*a* determines whether or not a detection signal has been received from the gate SW 15*a* as input. If no detection signal has been received from the gate SW 15*a* as input, the step moves directly to the next step. On the other hand, in a case where a detection signal is received from the gate SW 15*a* as input, when the data set in the storage area for regular symbol reserve number (G) in the RAM 31*c* is smaller than four, the CPU 31*a* increments the value stored in the storage area for regular symbol reserve number (G) by one, obtains the random number value for regular symbol determination and stores the obtained random number value for regular symbol determination in predetermined storage parts (zero to fourth storage parts) in a storage area for random number value of regular symbol in the RAM 31*c*, and after that, ends this input control processing.

Now, the descriptions of the input control processing on the game control board 31 is stopped, and then, the timer interrupt processing shown in FIG. 39 will be explained again.

In step S300, the CPU 31*a* of the game control board 31 performs processing related to the special symbol in order to, for example, display the blinking special symbol, hold a bonus game lottery, and open and close the bonus game hole. Detailed descriptions will be explained later, with reference to FIG. 41.

In step S400, the CPU 31*a* of the game control board 31 performs processing related to regular symbols to perform, for example, to display changing regular symbols, hold a lottery and open and close the second start-up hole 14*a*.

In the processing related to regular symbols, the CPU 31*a* first determines whether or not one or more data elements are set in the storage area for regular symbol reserve number (G) in the RAM 31*c*, and, if one or more data elements are not set, the CPU 31*a* ends this regular symbol-related processing. On the other hand, when one or more data elements are set in the storage area for regular symbol reserve number (G) in the RAM 31*c*, the CPU 31*a* decrements, by one, the value stored in the storage area for regular symbol reserve number (G) in the RAM 31*c*, and then shifts the random number value for regular symbol determination stored in the first storage part to the fourth storage part in the storage area for random number value of regular symbol in the RAM 31 to the previous one storage part. At this time, the random number value for regular symbol determination already having been written in the zero storage part is overwritten and deleted. Then, the CPU 31*a* holds a lottery to determine whether or not the random number value for regular symbol determination stored in the zero storage part in the storage area for random number value of regular symbol in the RAM 31*c* corresponds to the specific random number value, and determines data used to stop the regular symbol corresponding to the result of the lottery. Then, the changing regular symbol is displayed on the regular symbol display 23*c*. Then, after the period of time for which the regular symbol is changing has elapsed, the regular symbol corresponding to the data used to stop the regular symbol is stationarily displayed. Then, when the regular symbol corresponding to "winning number" is stationarily displayed, the CPU 31*a* drives the second start-up hole SOL 14*a* to control the second start-up hole 14*a* to open for a predetermined open period of time in a predetermine opening manner.

In step S500, the CPU 31*a* of the game control board 31 performs payout control processing. To be more specific, the CPU 31*a* of the game control board 31 refers to each prize ball counter, creates a command to make the payout control board 32 pay out a predetermined number of playing balls and summits the created command to the payout control board 32.

In step S600, the CPU 31*a* of the game control board 31 performs output control processing, based on the results of the special symbol-related processing in step S300 and the regular symbol-related processing in step S400.

To be more specific, the CPU 31*a* performs port-related processing to output signals to drive the start-up SOL 14*d*, the first bonus game hole SOL 16*d* and the second bonus game hole SOL 17*d*. In addition, the CPU 31*a* performs display-related processing to output signals to display the symbols on the first special symbol display 23*a*, the second special symbol display 23*b* and the regular symbol display 23*c*, respectively. Moreover, the CPU 31*a* performs processing to transmit the command set in the storage area for entertainment transmission data in the RAM 31*c*.

<Special Symbol-Related Processing on the Game Control Board>

Figure 41:
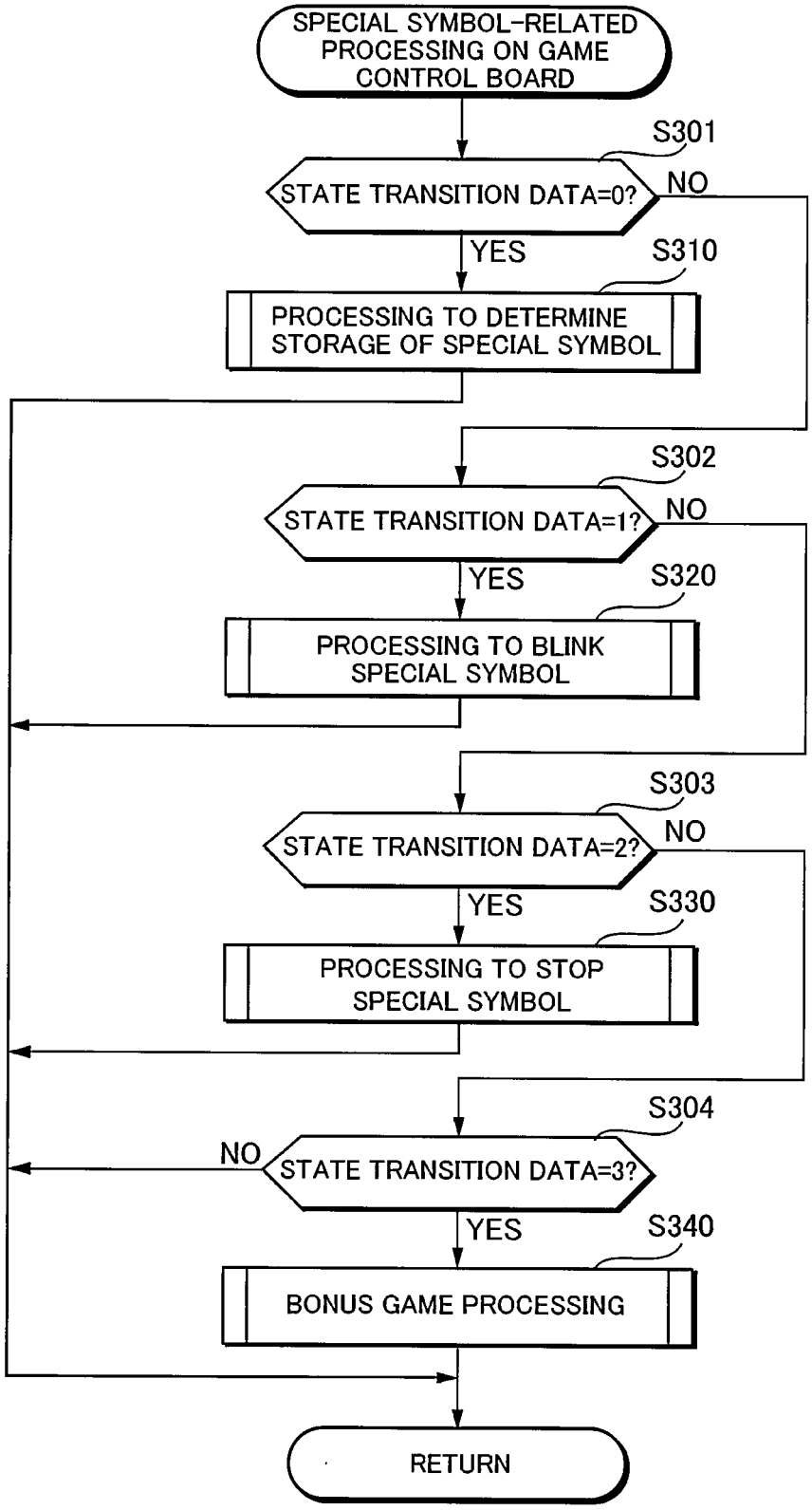
FIG. 41 shows exemplary special symbol related-processing on the game control board.

With reference to FIG. 41, special symbol-related processing on the game control board 31 will be explained. This processing is performed based on state transition data.

To be more specific, the CPU 31*a* of the game control board 31 loads the value of transition state data, and, moves the step as follows: if the state transition data=0, the step moves to processing to determine the storage of the special symbol (step S301, S310); if the transition data=1, the step moves to processing to blink the special symbol (step S302, S320); if the state transition data=2, the step moves to processing to stop the special symbol (step S303, S330); and if the transition data=3, the step moves to bonus game processing (step S304, S340).

This "state transition data" is set in each subroutine in the special symbol-related processing as described later, and therefore the subroutine required for the current play is processed accordingly.

In the processing to determine the storage of the special symbol in step S310, the CPU 31*a* of the game control board 31 performs processing, for example, to determine a bonus game, to determine a special symbol to be stationarily displayed, and to determine a period of time for which the special symbol is blinking.

In the processing to blink the special symbol in step S320, the CPU 31*a* of the game control board 31 performs processing, for example, to determine whether or not the special symbol stops blinking.

In the processing to stop blinking the special symbol in step S330, the CPU 31*a* of the game control board 31 performs processing, for example, to prepare to move to a bonus game when the special symbol is stopped blinking.

In the bonus game processing in the step S340, the CPU 31*a* of the game control board 31 performs processing, for example, to open and close the bonus game hole.

The processing to determine the storage of the special symbol (FIG. 42), the processing to blink the special symbol (FIG. 44), the processing to stop blinking the special symbol (FIG. 45) and the bonus game processing (FIG. 47) will be described in detail later.

<Processing to Determine the Storage of the Special Symbol>

Figure 42:
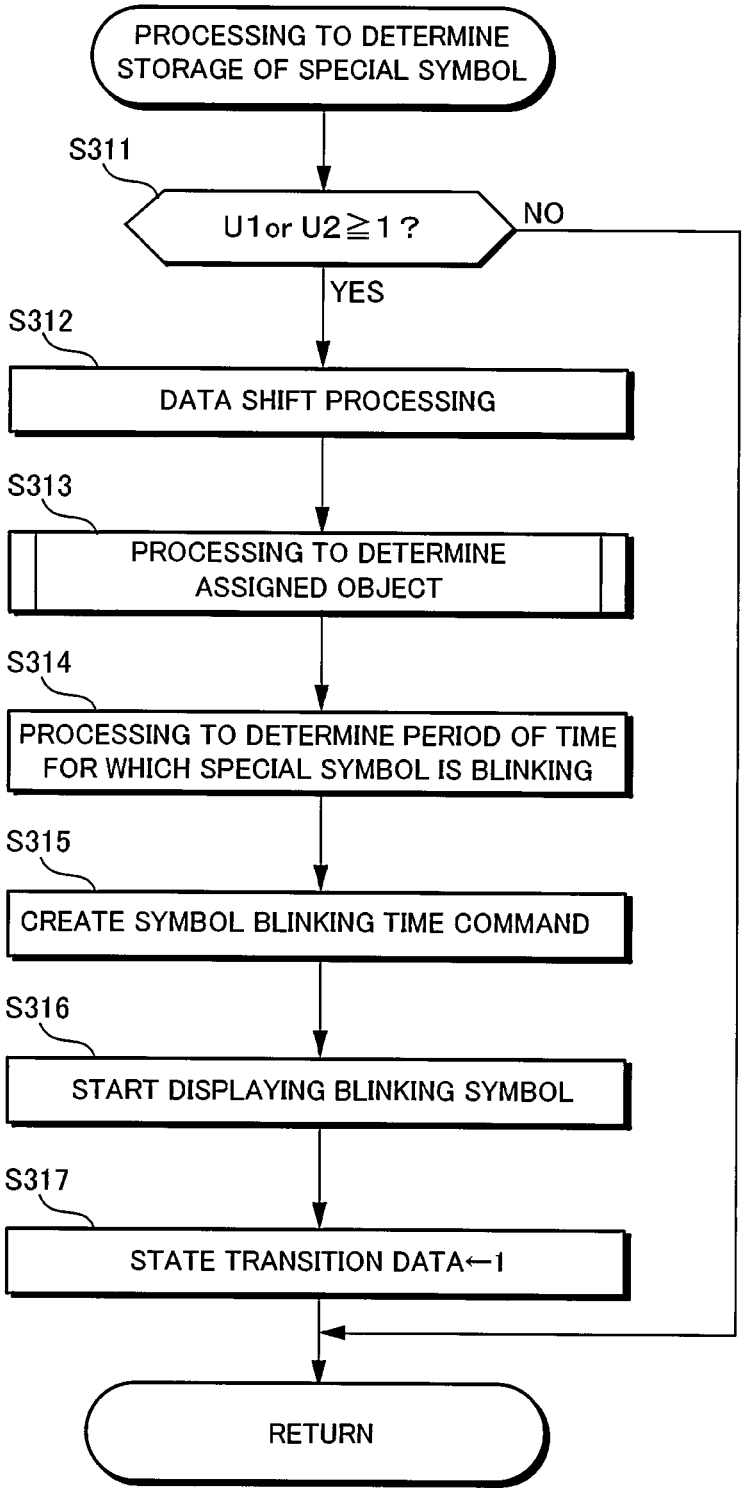
FIG. 42 shows exemplary processing to determine the storage of a special symbol on the game control board.

FIG. 42 shows processing to determine the storage of the special symbol on the game control board 31.

First, in step S311, the CPU 31*a* of the game control board 31 determines whether or not one or more data elements are set in the storage area for first special symbol reserve number (U1) or the storage area for second special symbol reserve number (U2). Then, one or more data elements are set in neither the storage area for first special symbol reserve number (U1) nor the storage area for second special symbol reserve number (U2), the processing to blink the special symbol is ended while "state transition data=0" is kept. On the other hand, if one or more data is set in one of the storage area for first special symbol reserve number (U1) and the storage area for second special symbol reserve number (U2), the step moves to step S312.

In step S312, the CPU 31*a* of the game control board 31 performs decrement processing on the storage area for first special symbol reserve number (U1) or the storage area for second special symbol reserve number (U2), and shift processing on the data stored in the first storage area for random number value of special symbol or the second storage area for random number value of special symbol.

To be more specific, when one or more data elements are set in the storage area for second special symbol reserve number (U2), the CPU 31*a* decrements the value stored in the storage area for second special symbol reserve number (U2) by one, and then shifts each of the random number values (the random number value for bonus game determination, the random number value for bonus game symbol and the random number value for blinking) stored in the first storage part to the fourth storage part in the second storage area for random number value of special symbol, to the previous one storage part. At this time, each random number value already having been written in the zero storage part is overwritten and deleted. Meanwhile, when one or more data elements are not set in the storage area for second special symbol reserve number (U2), but set in the storage area for first special symbol reserve number (U1), the CPU 31*a* decrements the value stored in the storage area for first special symbol reserve number (U1), and then shifts each of the random number values (the random number value for bonus game determination, the random number value for bonus game symbol and the random number value for blinking) stored in the first storage part to the fourth storage part in the first storage area for random number value of special symbol, to the previous one storage part. Also at this time, each random number value already having written in the zero storage part is overwritten and deleted.

With the present embodiment, the random number value stored in the second storage area for random number value of special symbol is shifted preferentially over the random number value stored in the first storage area for random number value of special symbol. However, it is by no means limiting. The random number value may be shifted in the order of entering a start-up hole, or the random number value stored the first storage area for random number value of special symbol may be shifted preferentially over the random number value stored in the second storage area for random number value of special symbol.

In step S313, the CPU 31*a* of the game control board 31 performs processing to determine an assigned object.

<Processing to Determine an Assigned Object on the Game Control Board>

Figure 43:
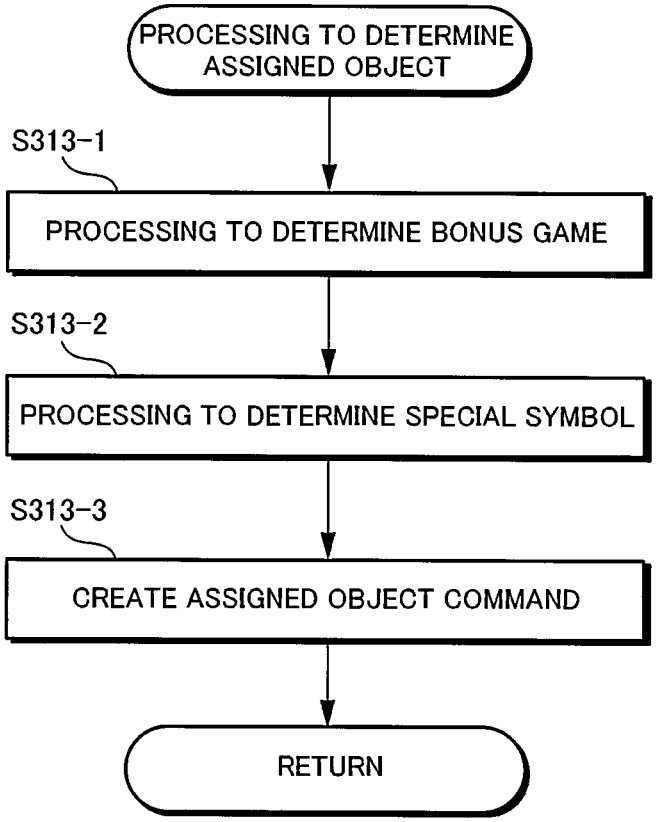
FIG. 43 shows exemplary processing to determine an assigned object on the game control board.

FIG. 43 shows processing to determine an assigned object on the game control board 31.

In step S313-1, the CPU 31*a* of the game control board 31 refers to the first assigned object determination table shown in FIG. 32, and determines whether the random number value for bonus game determination, which is stored in the zero storage part in this processing, corresponds to "jackpot" or "loss."

In step S313-2, the CPU 31*a* of the game control board 31 performs processing to determine data on the special symbol to be stopped. To be more specific, the CPU 31*a* of the game control board 31 refers to the second assigned object determination table shown in FIG. 33, and determines data on the special symbol to be stopped, based on the random number value for bonus game symbol stored in the zero storage part in this processing. Then, the determined data on the special symbol to be stopped is stored in the storage area for data on the special symbol to be stopped.

In step S313-3, the CPU 31*a* of the game control board 31 creates an assigned object command based on the data on the special symbol to be stopped, which is determined in step S313-2, and performs processing to store the created assigned object command in the storage area for entertainment transmission data in the RAM 31*c* in order to transmit the assigned object command to the entertainment control board 33.

Now, the descriptions of the processing to determine an assigned object is stopped, and then the processing to determine the storage of the special symbol shown in FIG. 42 will be described again.

In step S314, the CPU 31*a* of the game control board 31 performs processing to determine the period of time for which the special symbol is blinking. To be more specific, the CPU 31*a* determines the period of time for which the special symbol is blinking, based on the random number value for blinking, which is stored in the zero storage part in this processing. Then, the CPU 31*a* performs processing to set the counter corresponding to the determined period of time for which the special symbol is blinking, in the special symbol time counter in the RAM 31*c*. Here, the special symbol time counter is decremented by one every 4 ms and updated in the above-described step S100.

In step S315, the CPU 31*a* of the game control board 31 creates a command indicating the period of time for which the special symbol is blinking (hereinafter "blinking time command"), based on the period of time for the special symbol is blinking, which is determined in step S314, and performs processing to store the created blinking time command in the storage area for entertainment transmission data in the RAM 31*c*, in order to transmit the blinking time command to the entertainment control board 33.

In step S316, the CPU 31*a* of the game control board 31 sets data used to display the blinking special symbol on the first special symbol display 23*a* or the second special symbol display 23*b*, in a storage area for display in the RAM 31*c*. This data used to display the blinking symbol is outputted in step S600, and the blinking special symbol is displayed on the first special symbol display 23*a* or the second special symbol display 23*b*.

In step S317, the CPU 31*a* of the game control board 31 sets 1 in the state transition data to prepare to progress to the subroutine of the processing to blink the special symbol, and ends the processing to determine the storage of the special symbol.

<Processing to Blink the Special Symbol on the Game Control Board>

Figure 44:
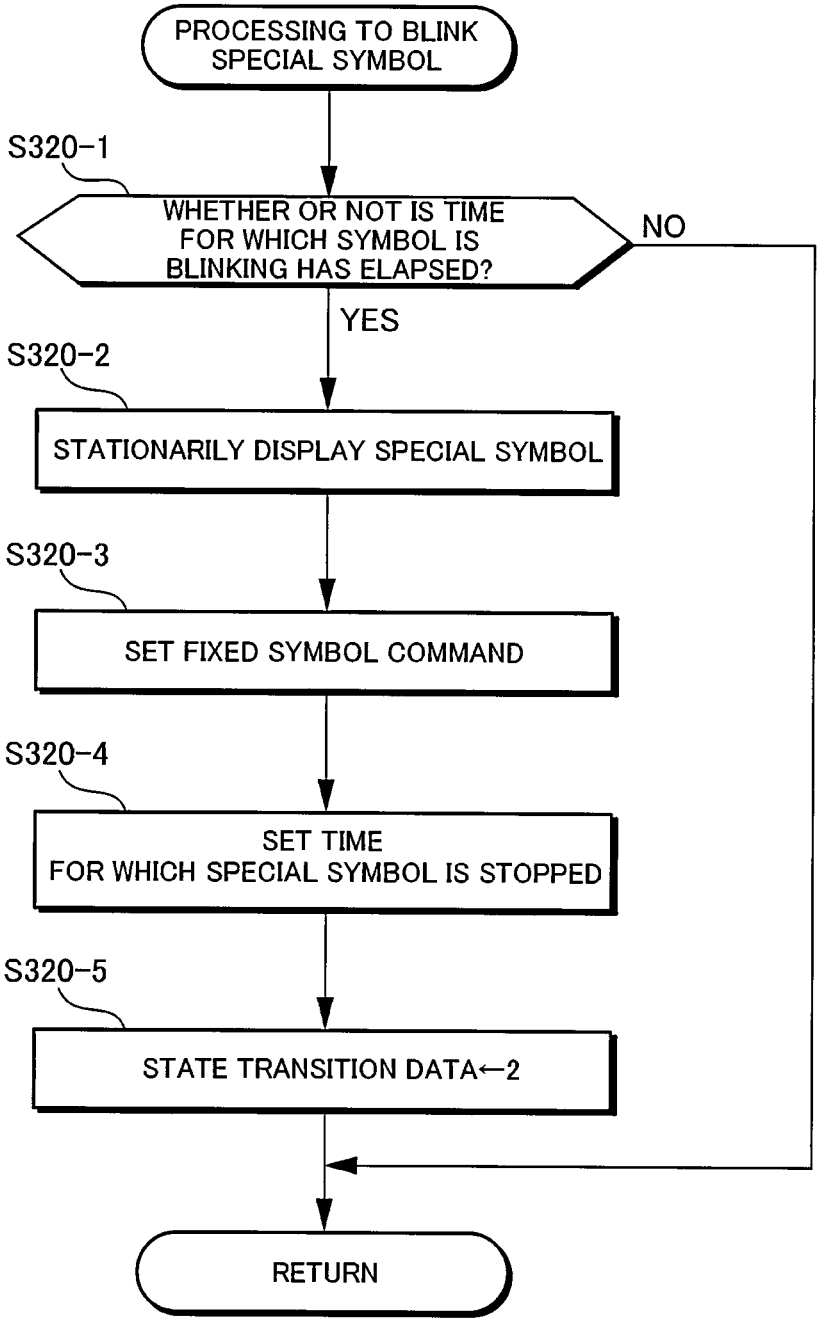
FIG. 44 shows exemplary processing to blink the special symbol on the game control board.

With reference to FIG. 44, processing to blink the special symbol on the game control board 31 will be explained.

In step S320-1, the CPU 31*a* of the game control board 31 determines whether or not the period of time for which the special symbol is blinking, which is set in step S314, has elapsed (that is, whether or not the special symbol time counter is zero). As a result, when the period of time has not elapsed, the CPU 31*a* ends the processing to blink the special symbol, and performs the next subroutine.

In step S320-2, when determining that the set period of time for which the special symbol is blinking has elapsed, the CPU 31*a* of the game control board 31 clears the data used to display the blinking symbol, which is set in step S316, and sets the data on the special symbol to be stopped stored in the storage area for stop symbol data in the RAM 31*c*. Here, "data on the special symbol to be stopped" refers to data that is used to stationarily display the special symbol determined in step S313-2 on the first special symbol display 23*a* or the second special symbol display 23*b*. By this means, the special symbol is stationarily displayed on the first special display 23*a* or the second special symbol display 23*b*, and the player is informed of the result of the bonus game lottery.

In step S320-3, the CPU 31*a* of the game control board 31 sets a fixed symbol command to indicate that the special symbol is stationarily displayed, in the storage area for entertainment transmission data in the RAM 31*c*, in order to make the entertainment control board 33 recognize that the special symbol is stationarily displayed.

In step S320-4, upon starting to display the stationary special symbol, the CPU 31*a* of the game control board 31 sets the period of time for which the special symbol is stopped (0.5 seconds=125 counters) in the special symbol time counter. Here, the special symbol time counter is decremented by one every 4 ms and updated in the above-described step S100.

In step S320-5, the CPU 31*a* of the game control board 31 sets 2 in the state transition data to prepare to progress to the subroutine of the processing to stop blinking the special symbol, and ends the processing to blink the special symbol.

<Processing to Stop Blinking the Special Symbol on the Game Control Board>

Figure 45:
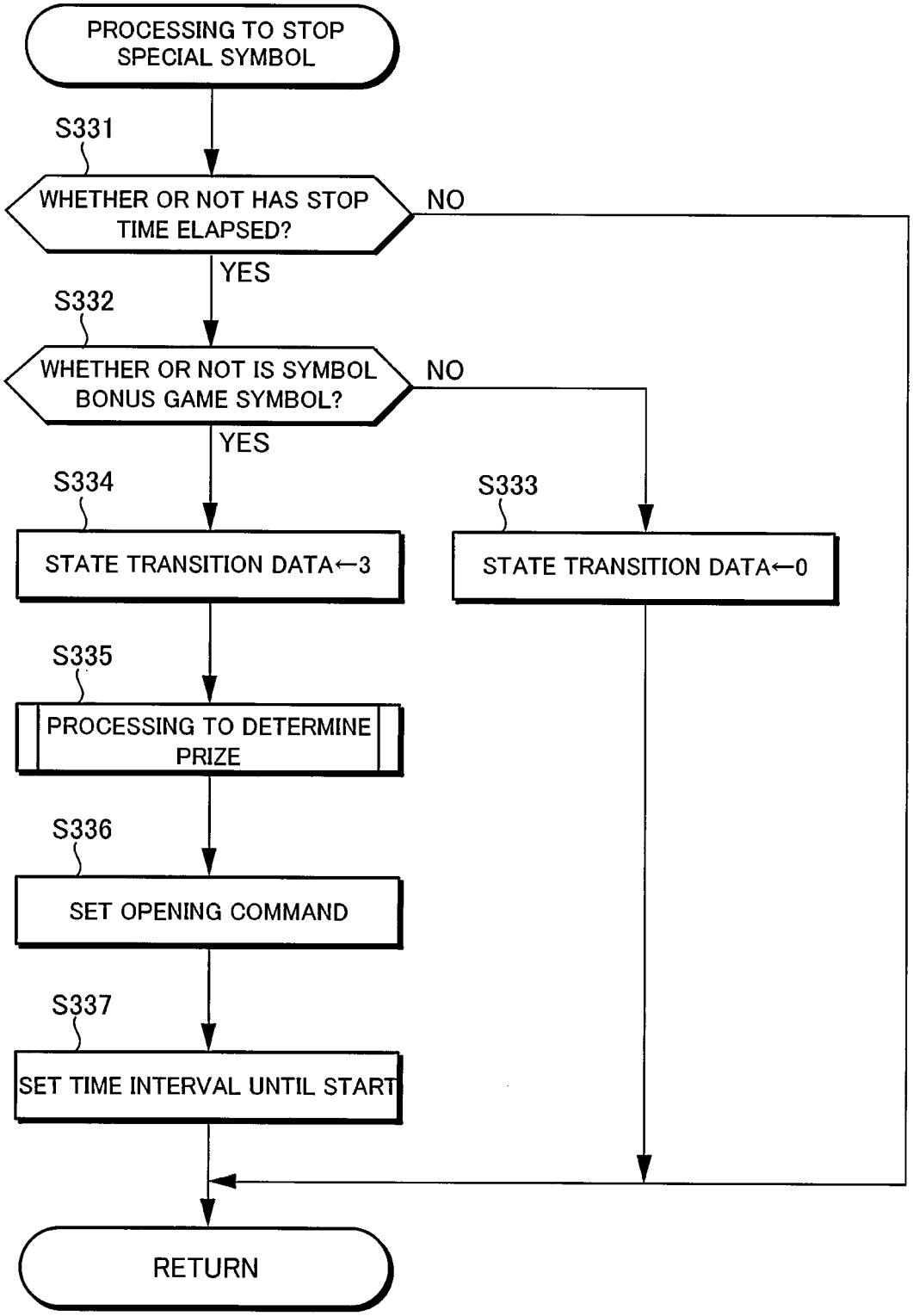
FIG. 45 shows exemplary processing to stop blinking the special symbol on the game control board.

With reference to FIG. 45, processing to stop blinking the special symbol on the game control board 31 will be explained.

In step S331, the CPU 31*a* of the game control board 31 determines whether or not the period of time for which the special symbol is stopped, which is set in step S320-4, has elapsed (that is, whether or not the special symbol time counter is zero). As a result, when determining that the period of time for which the special symbol is stopped has not elapsed, the CPU 31*a* ends the processing to stop blinking the special symbol and performs the next subroutine.

In step S332, the CPU 31*a* of the game control board 31 determines whether or not the stationary special symbol corresponds to a bonus game symbol. To be more specific, the CPU 31*a* determines whether or not the data on the special symbol to be stopped, which is stored in the storage area for stop symbol data in the RAM 31*c*, is for a bonus game symbol (that is, whether or not the stop symbol data is 01 to 04). Here, when determining that the data is for a bonus game symbol, the CPU 31*a* moves the step to step S334. On the other hand, when determining that the data is not for a bonus game symbol, the CPU 31*a* moves the step to step S333.

In step S333, the CPU 31*a* of the game control board 31 sets 0 in the state transition data to prepare to progress to the processing to determine the storage of the special symbol shown in FIG. 42, and ends this processing to stop blinking the special symbol.

Figure 47:
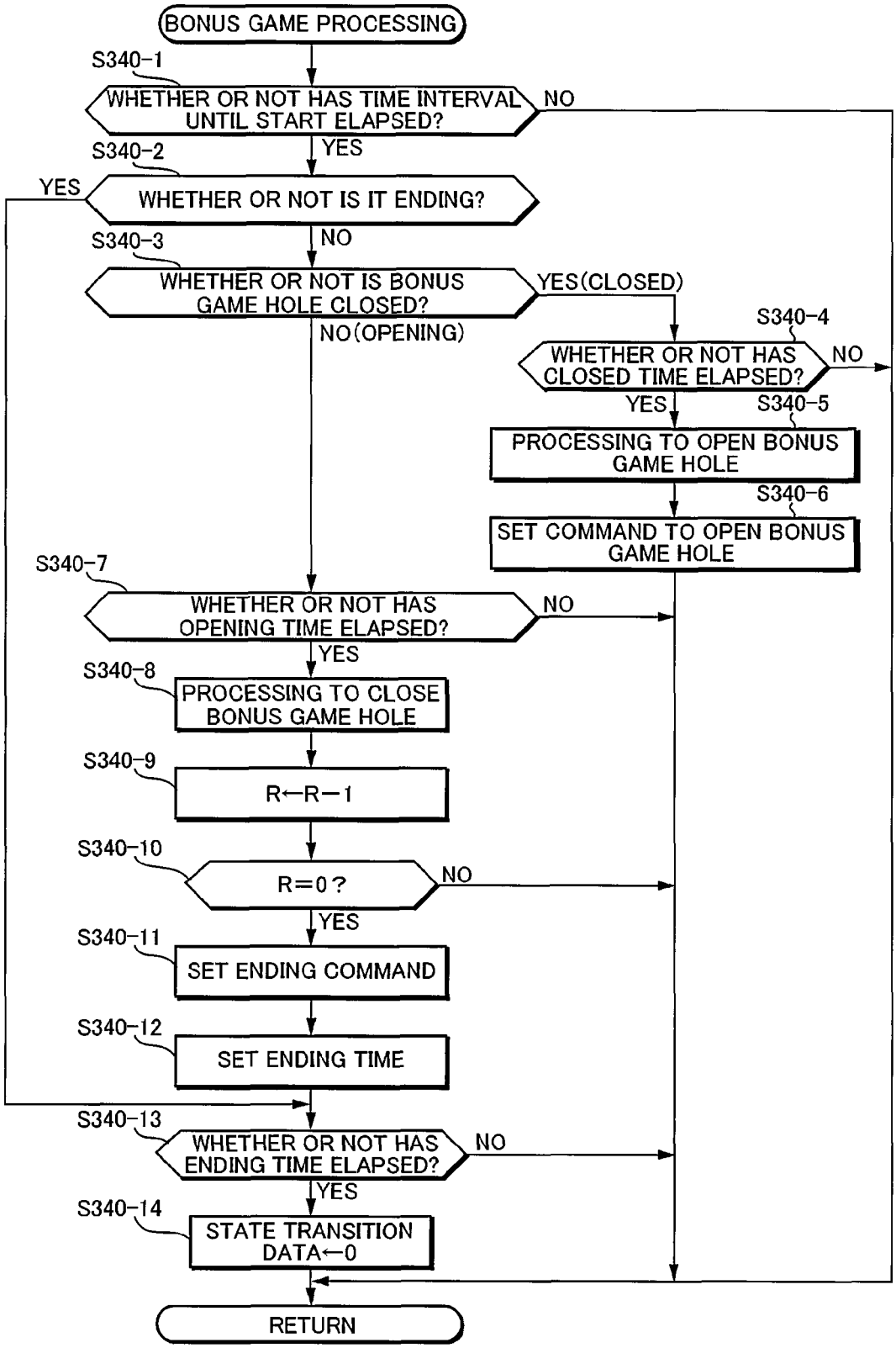
FIG. 47 shows exemplary bonus game processing on the game control board.

In step S334, the CPU 31*a* of the game control board 31 sets 3 in the state transition data to prepare to progress to the bonus game processing shown in FIG. 47.

In step S335, the CPU 31*a* of the game control board 31 performs processing to determine a prize.

<Processing to Determine a Prize on the Game Control Board>

Figure 46:
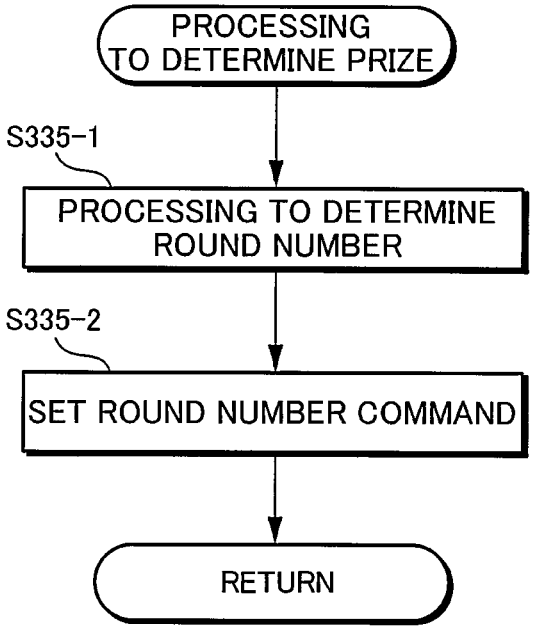
FIG. 46 shows exemplary processing to determine a prize on the game control board.

FIG. 46 shows processing to determine a prize on the game control board 31.

In step S335-1, the CPU 31*a* of the game control board 31 refers to the prize determination table shown in FIG. 34, and determines the round number based on the data on the special symbol to be stopped, which is stored in the storage area for stop symbol data in the RAM 31*c*. Then, the determined round number is stored in the round number storage area (R) in the RAM 31*c*.

In step S335-2, the CPU 31*a* of the game control board 31 creates a round number command based on the round number determined in step S335-1, and performs processing to store the created round number command in the storage area for entertainment transmission data in the RAM 31*c*, in order to transmit the round number command to the entertainment control board 33.

Now, the descriptions of the processing to determine a prize are stopped, and the processing to stop blinking the special symbol shown in FIG. 45 will be explained again.

In step S336, the CPU 31*a* of the game control board 31 sets an opening command to indicate the start of a bonus game in the storage area for entertainment transmission data in the RAM 31*c*, in order to make the entertainment control board 33 recognize that a bonus game is started.

In step S337, the CPU 31*a* of the game control board 31 sets the time interval until the start of a bonus game in a bonus game timer counter. Here, the bonus game timer counter is decremented by one every 4 ms in the above-described step S100. Upon ending this processing, the CPU 31*a* ends this processing to stop blinking the special symbol.

<Bonus Game Processing on the Game Control Board>

With reference to FIG. 47, bonus game processing on the game control board 31 will be explained.

In step S340-1, the CPU 31*a* of the game control board 31 determines whether or not the time interval until the start of a bonus game, which is determined in step S337, has elapsed. That is, the CPU 31*a* determines whether or not the bonus game timer counter is zero, and, if so, determines that the time interval until the start of a bonus game has elapsed. As a result, when determining that the time interval until the start of a bonus game has elapsed, the CPU 31*a* moves the step to the step S340-2, and, on the other hand, when determining that the time interval until the start has not elapsed, ends this bonus game processing.

In step S340-2, the CPU 31*a* of the game control board 31 determines whether or not the bonus game is ending. To be more specific, the CPU 31*a* refers to the storage area for round number (R) in the RAM 31*c* and determines whether or not the round number is zero. As a result, when determining that the bonus game is ending, the CPU 31*a* moves the step to step S340-13, and, on the other hand, when determining that the bonus game is not ending, moves the step to step S340-3.

In step S340-3, the CPU 31*a* of the game control board 31 determines whether or not the bonus game hole is closed. To be more specific, the CPU 31*a* determines whether or not conductive data used to conduct the first bonus game hole SOL16*d* or the second bonus game hole SOL17*d* is set. As a result, when determining that the bonus game hole is closed, the CPU 31*a* moves the step to step S340-4, and, on the other hand, when determining that the bonus game hole is not closed, moves the step to step S340-7.

In step S340-4, the CPU 31*a* of the game control board 31 determines whether or not the closing time set in step S340-8 described later has elapsed. To be more specific, the CPU 31*a* determines whether or not a closing time counter is zero. As a result, when determining that the closing time has elapsed, the CPU 31*a* moves the step to step S340-5. On the other hand, when determining that the closing time has not elapsed, the CPU 31*a* ends this bonus game processing. Here, at the start of the bonus game (after the time interval until the start of the bonus game has elapsed), the value of the closing time counter is zero as the initial value, the CPU 31*a* moves the step to step S340-5.

In step S340-5, the CPU 31*a* of the game control board 31 performs processing to open the bonus game hole. In the processing to open the bonus game hole, the CPU 31*a* sets conductive data used to conduct the first bonus game hole SOL 16*d* or the second bonus game hole SOL 17*d* to open the first bonus game hole 16*a* or the second bonus game hole 17*a*, and also sets the period of time for which the first bonus game hole 16*a* or the second bonus game hole 17*b* is open in an opening time counter in RAM 31*c*. Here, the opening time counter is decremented every 4 ms and is finally cut to zero in the above-described step S100.

In step S340-6, the CPU 31*a* of the game control board 31 sets a command indicating that the bonus game hole is open in the storage area for entertainment transmission data in order to transmit information that the bonus game hole is open to the entertainment control board 33.

In step S340-7, the CPU 31*a* of the game control board 31 determines whether or not the opening time set in step S340-5 has elapsed. To be more specific, the CPU 31*a* determines whether or not the opening time counter in the RAM 31*c* is zero. As a result, when determining that the opening time has elapsed, the CPU 31*a* moves the step to step S340-8. On the other hand, when determining that the open time has not elapsed, the CPU 31*a* ends this bonus game processing.

In step S340-8, the CPU 31*a* of the game control board 31 performs processing to close the bonus game hole. In the processing to close the bonus game hole, the CPU 31*a* stop the conductive data used to conduct the first bonus game hole SOL 16*d* or the second bonus game hole SOL 17*d* in order to close the first bonus game hole 16*a* or the second bonus game hole 17*b*. Next, the CPU 31*a* sets the period of time for which the first bonus game hole 16*a* or the second bonus game hole 17*a* is closed in the closing time counter in the RAM 31*c*. By this means, the bonus game hole is closed. Here, the closing time counter is decremented every 4 ms and is finally cut to zero in the above-described step S100.

In step S340-9, the CPU 31*a* of the game control board 31 decrements the current round game count (R) by "one", which is stored in the storage area for) round game count (R) in the RAM 31*c* and updates the round game count (R).

In step S340-10, the CPU 31*a* of the game control board 31 refers to the storage area for round game count (R) in the RAM 31*c*, and determines whether or not the round game count (R) is zero. As a result, when determining that the round game count (R) is zero, the CPU 31*a* moves the step to step S340-11. On the other hand, when determining that the round game count (R) is not zero, the CPU 31*a* ends this bonus game processing.

In step S340-11, the CPU 31*a* of the game control board 31 sets an ending command in the storage area for entertainment transmission data in order to transmit information that the bonus game is ended to the entertainment control board 33.

In step S340-12, the CPU 31*a* of the game control board 31 sets the time of ending the bonus game to an ending time counter in the RAM 31*c*. Here, the ending time counter is decremented every 4 ms and is finally cut to zero in the above-described step S100.

In step S340-13, the CPU 31*a* of the game control board 31 determines whether or not the ending time set in step S340-12 has elapsed. To be more specific, the CPU 31*a* determines whether or not the ending time counter is zero. As a result, when determining that the ending time has elapsed, the CPU 31*a* moves the step to step S340-14. On the other hand, when determining that the ending time has not elapsed, the CPU 31*a* ends this bonus game processing.

In step S340-14, the CPU 31*a* of the game control board 31 sets zero in the state transition data, prepares to progress to the processing to determine the storage of the special symbol, and then ends this bonus game processing.

Next, processing performed by the CPU 33*a* of the entertainment control board 33 will be explained.

<Main Processing on the Entertainment Control Board>

Figure 48:
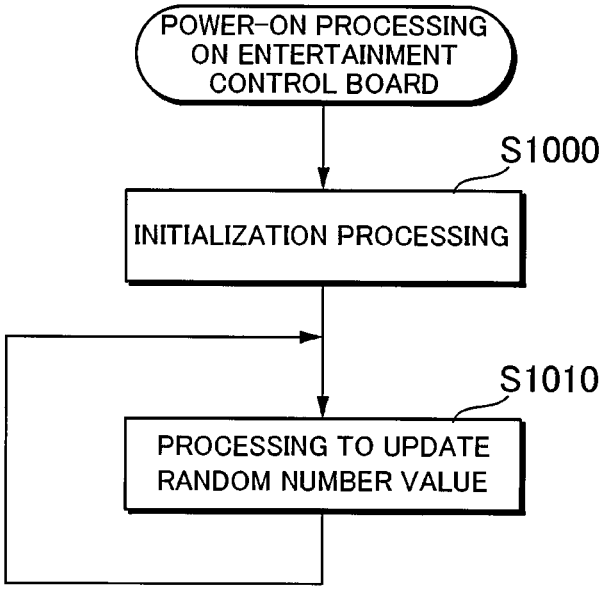
FIG. 48 shows exemplary main processing on an entertainment control board.

With reference to FIG. 48, power-on processing that is started at the time the entertainment control board 33 is turned on will be explained.

In step S1000, the CPU 33*a* of the entertainment control board 33 performs initialization processing. In this processing, the CPU 33*a* of the entertainment control board 33 reads a main processing program from the ROM 33*b* in response to the power-on, and performs processing to initialize and set flags and so forth stored in the RAM 33*c*.

In step S1010, the CPU 33*a* of the entertainment control board 33 performs processing to update the random number values for entertainment. In this processing, the CPU 33*a* of the entertainment control board 33 performs processing to update the random number values such as the random number value for movement determination, the random number value for protrusion and so forth.

After that, the processing in step S1010 is repeatedly performed until a predetermined interrupt processing is performed.

<Timer Interrupt Processing on the Entertainment Control Board>

Figure 49:
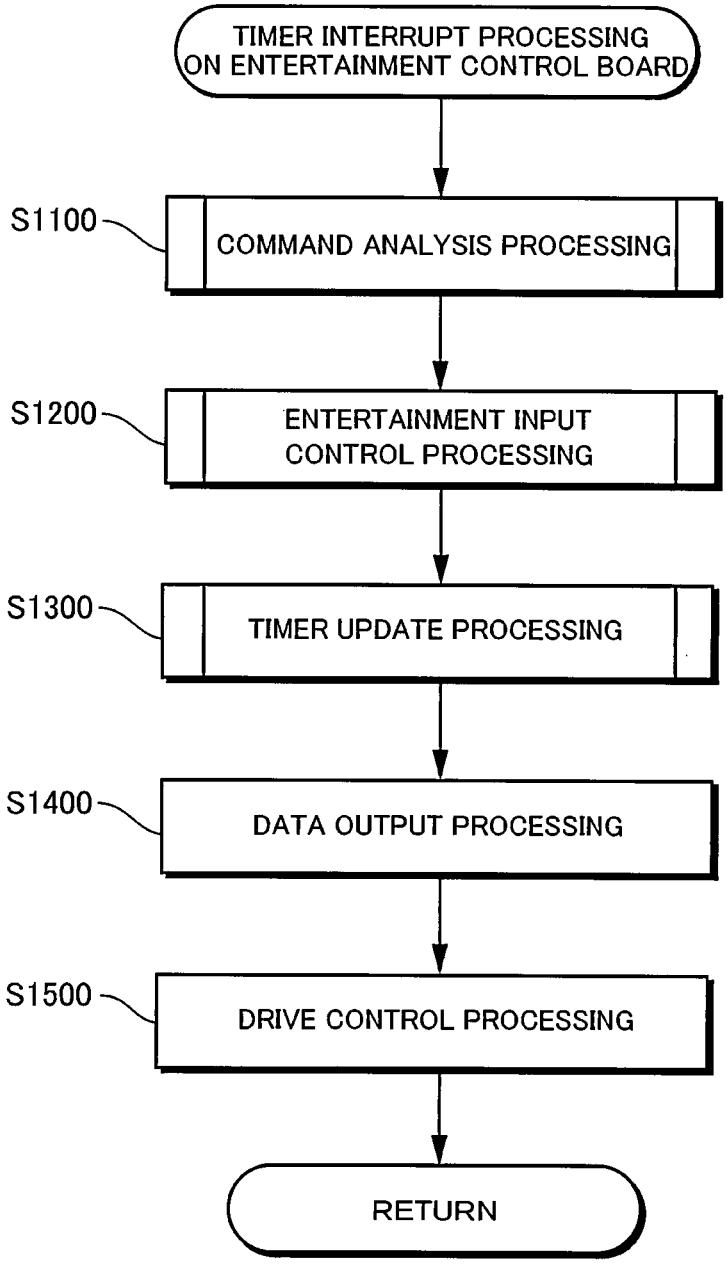
FIG. 49 shows exemplary timer interrupt processing on the entertainment control board.

With reference to FIG. 49, timer interrupt processing on the entertainment control board 33 will be explained. Clock pulses are generated by a reset clock pulse generating circuit (not shown) provided in the entertainment control board 33 every predetermined period (2 ms), a timer interrupt processing program is read, and timer interrupt processing is performed on the entertainment control board.

In step S1100, the CPU 33*a* of the entertainment control board performs command analysis processing. In this command analysis processing, the CPU 33*a* of the entertainment control board 33 performs processing to analyze the command stored in a receiver buffer in the RAM 33*c*. This command analysis processing will be described in detail later, with reference to FIG. 50 and FIG. 51.

Here, on the entertainment control board 33, when the command transmitted from the game control board 31 is received, command interrupt processing (not shown) occurs, and the received command is stored in the receiver buffer. After that, processing to analyze the received command is performed in step S1100.

In step S1200, the CPU 33*a* of the entertainment control board 33 checks if the push operation detecting parts 69*a* and 69*b*, and the protruding position detecting parts 43*d* and 67 receive signals as input, and performs processing to control the input related to the entertainment button 40. This processing to control the input related to the entertainment button 40 will be described in detail later, with reference to FIG. 54.

In step S1300, the CPU 33*a* of the entertainment control board 33 performs processing to update each timer counter used in the entertainment control board 33. This timer update processing will be described in detail later, with reference to FIG. 57.

In step S1400, the CPU 33*a* of the entertainment control board 33 performs data output processing to transmit each command set in the transmission buffer in the RAM 33*c* to the image control board 34 and the lamp control board 35.

In step S1500, the CPU 33*a* of the entertainment control board 33 performs drive control processing to output the drive data on the electric motor 71 generated based on the processing in step S1100 to S1300, to the electric motor 71.

<Command Analysis Processing on the Entertainment Control Board>

Figure 50:
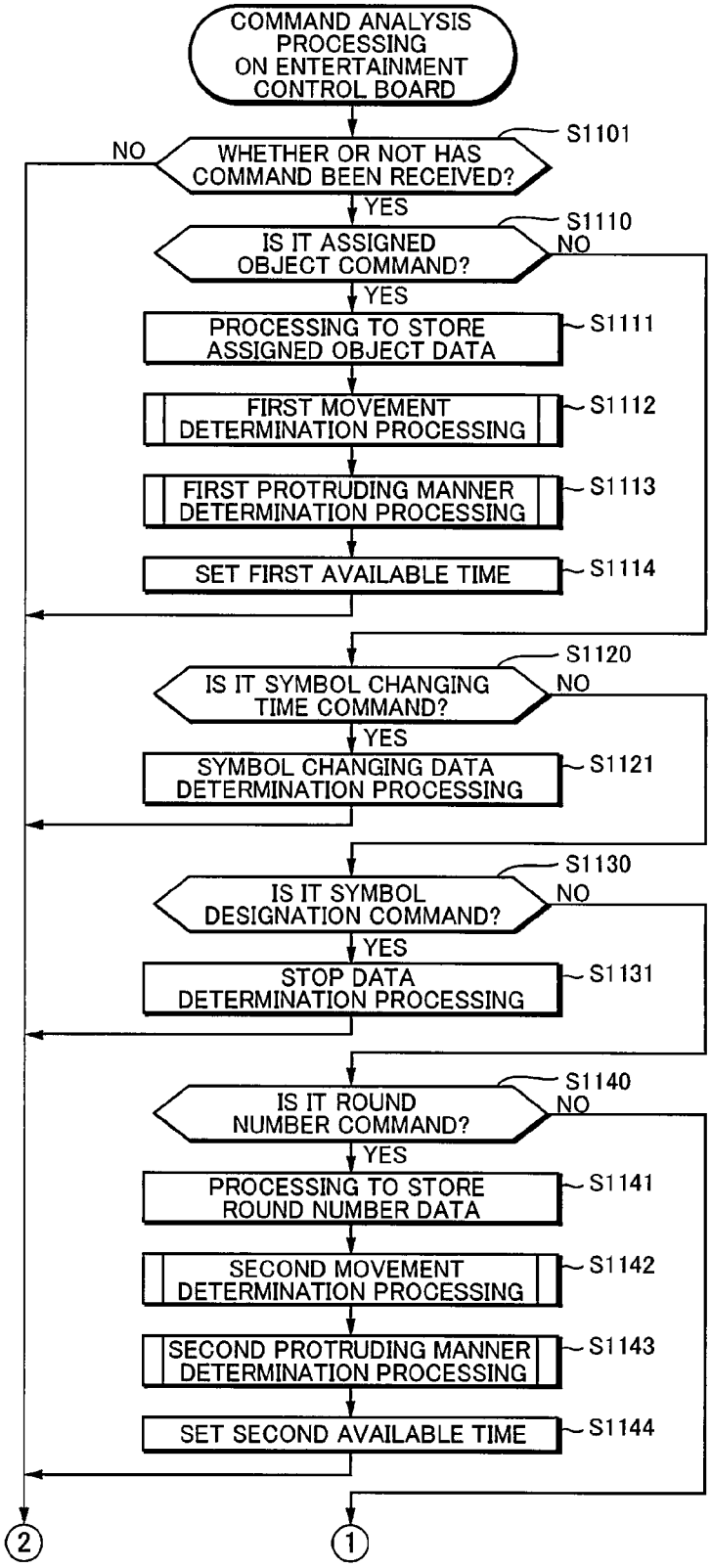
FIG. 50 shows exemplary command analysis processing 1 on the entertainment control board.
Figure 51:
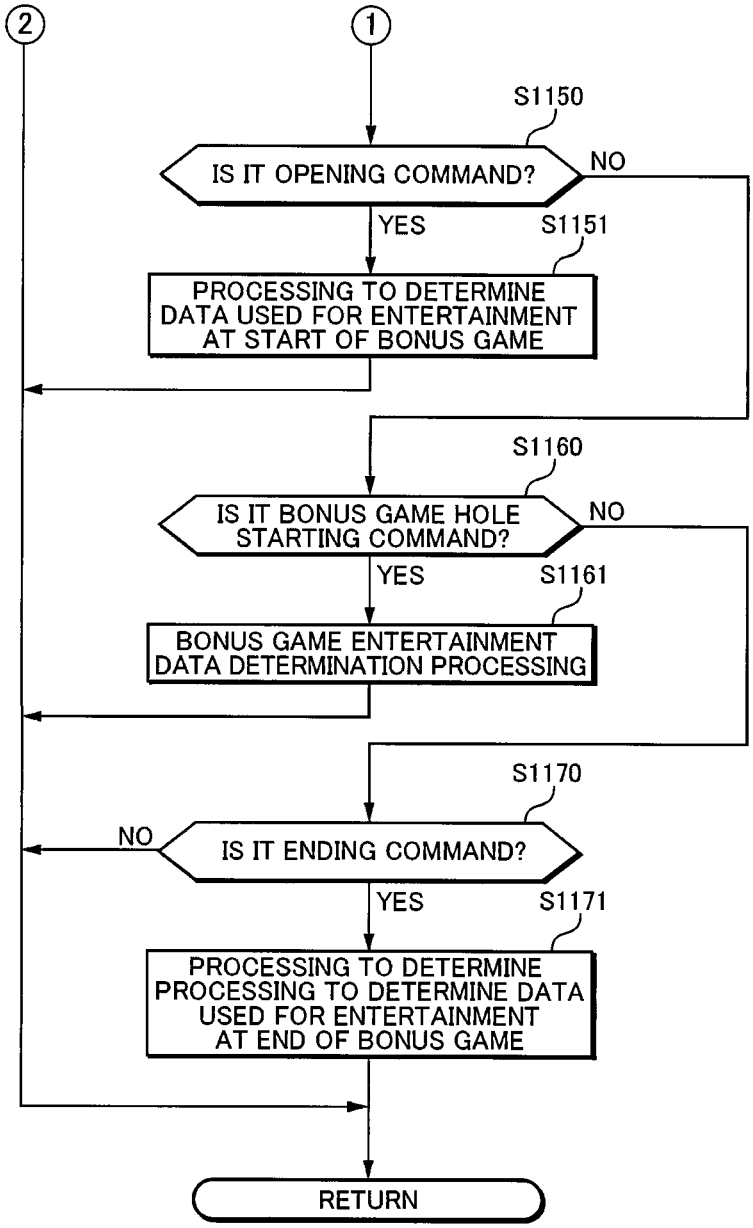
FIG. 51 shows exemplary command analysis processing 2 on the entertainment control board.

With reference to FIG. 50 and FIG. 51, command analysis processing on the entertainment control board 33 will be explained. Here, command analysis processing 2 shown in FIG. 51 is performed following command analysis processing 1 shown in FIG. 50.

Step S1101, the CPU 33*a* of the entertainment control board 33 checks if there is a command in the receiver buffer to check if a command has been received. When there is no command in the receiver buffer, the CPU 33*a* of the entertainment control board 33 ends the command analysis processing, and, on the other hand, when there is a command in the receiver buffer, the CPU 31*a* moves the step to step S1110.

In step S1110, the CPU 33*a* of the entertainment control board 33 checks if the command stored in the receiver buffer is an assigned object command. When the command stored in the receiver buffer is an assigned object command, the CPU 33*a* of the entertainment control board 33 moves the step to step S1111, and, on the other hand, when the command is not an assigned object command, the CPU 31*a* moves the step to step S1120.

In step S1111, the CPU 33*a* of the entertainment control board 33 analyzes assigned object data from the received assigned object command, and stores the analyzed assigned object data in the storage area for assigned object data in the RAM 33*c*. For example, when receiving assigned object command "E0H01H" shown in FIG. 33, the CPU 33*a* stores bonus game data in the storage area for assigned object data. Meanwhile, when receiving assigned object command "E0H00H", the CPU 33*a* stores loss data in the storage area for assigned object data.

In step S1112, the CPU 33*a* of the entertainment control board 33 performs first movement determination processing to determine whether or not to move the entertainment button 40 to the protruding position, based on the assigned object data.

In step S1113, the CPU 33*a* of the entertainment control board 33 performs first protruding manner determination processing to determine a protruding manner in which the entertainment button 40 moves to the protruding position, based on the assigned object data.

In step S1114, the CPU 33*a* of the entertainment control board 33 sets a first available time of the entertainment button 40, which corresponds to the assigned object data, in a first available time counter in the RAM 33*c*. Here, the first available time counter is decremented by one every 2 ms and updated in step S1300.

Here, the first available time set in the first available time counter is set shorter than the period of time for which the special symbol is blinking, in order to enable the operation of the entertainment button 40 to inform of the assigned object by the time the assigned object symbol is finally stationarily displayed on the image display 21.

<First Movement Determination Processing on the Entertainment Control Board>

Figure 52:
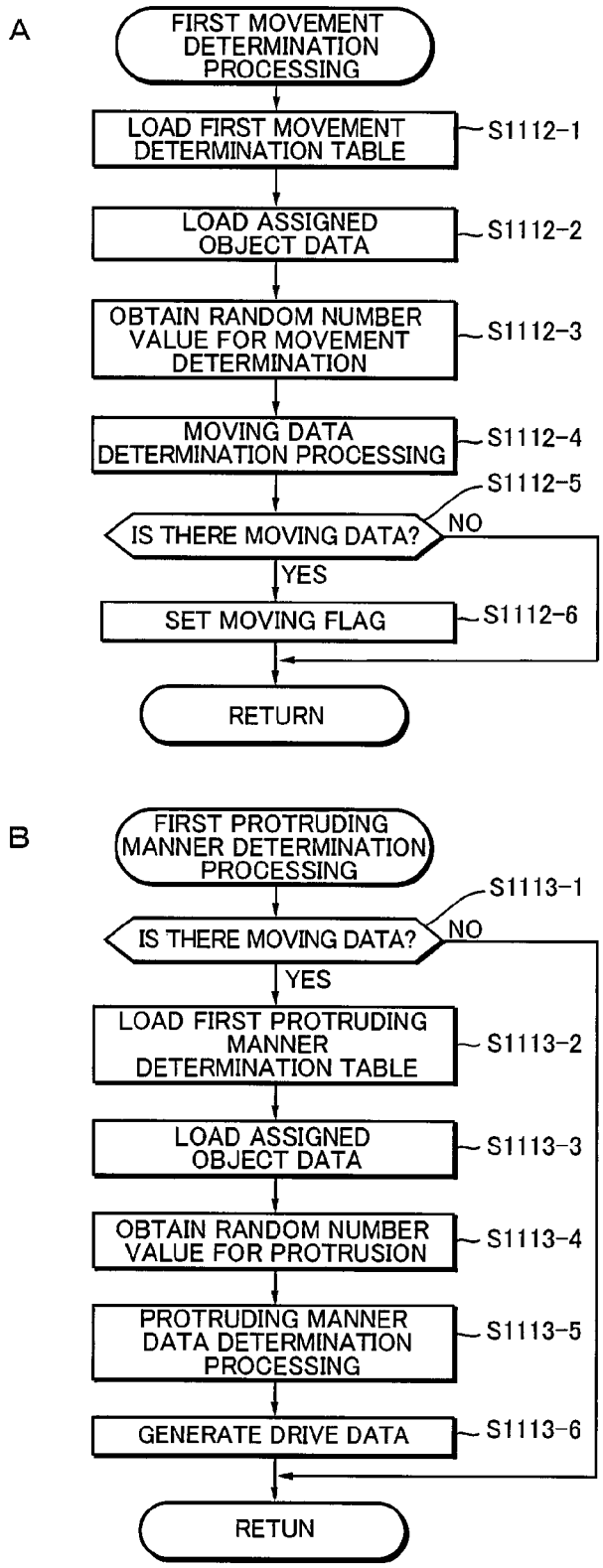
FIG. 52A shows first movement determination processing on the entertainment control board.
FIG. 52B shows first protruding manner determination processing on the entertainment control board.

With reference to FIG. 52A, first movement determination processing on the entertainment control board 33 will be explained.

In step S1112-1, the CPU 33*a* of the entertainment control board 33 loads the first movement determination table shown in FIG. 35A, from the ROM 33*b*.

In step S1112-2, the CPU 33*a* of the entertainment control board 33 loads the assigned object data from the storage area for assigned object data in the RAM 33*c*.

In step S1112-3, the CPU 33*a* of the entertainment control board 33 obtains one of the random number values for movement determination, which have been updated in S1010.

In step S1112-4, the CPU 33*a* of the entertainment control board 33 refers to the first movement determination table shown in FIG. 35A, and performs processing to determine movement data, based on the assigned object data and the random number value for movement determination.

In step S1112-5, the CPU 33*a* of the entertainment control board 33 determines whether or not movement data has been determined in step S1112-4. When determining that movement data is determined, the CPU 33*a* of the entertainment control board 33 moves the step to step S1112-6, and, on the other hand, when determining that movement data has not been determined, the CPU 33*a* ends this first movement determination processing.

In step S1112-6, the CPU 33*a* of the entertainment control board 33 sets a moving flag in a storage area for moving flag in the RAM 33*c* (that is, turns on a moving flag).

This "moving flag" is data held in the period of time for which the entertainment button 40 moves from the normal operation position to the protruding position. The moving flag is cleared at the time the entertainment button 40 reaches the protruding position (that is, the moving flag is turned off), as described later.

<First Protruding Manner Determination Processing on the Entertainment Control Board>

With reference to FIG. 52B, first protruding manner determination processing on the entertainment control board 33 will be explained.

In step S1113-1, the CPU 33*a* of the entertainment control board 33 refers to the storage area for moving flag in the RAM 33*c*, and determines whether or not the moving flag is set (that is, the moving flag is turned on).

In step S1113-2, the CPU 33*a* of the entertainment control board 33 loads the first protruding manner determination table shown in FIG. 36A, from the ROM 33*b*.

In step S1113-3, the CPU 33*a* of the entertainment control board 33 loads the assigned object data from the storage area for assigned object data in the RAM 33*c*.

In step S1113-4, the CPU 33*a* of the entertainment control board 33 obtains one of the random number values for protrusion, which have been updated in step S1010.

In step S1113-5, the CPU 33*a* of the entertainment control board 33 refers to the first protruding manner determination table shown in FIG. 36A, and determines protruding manner data, based on the assigned object data and the random number value for protrusion.

In step S1113-6, the CPU 33*a* of the entertainment control board 33 creates drive data on the electric motor 71, based on the protruding manner data determined in step S1113-5. This drive data is outputted in step S1500, so that the shaft member 68 rotates to move the entertainment button 40.

Now, the descriptions of the first movement determination processing and the first protruding manner determination processing on the game control board 31 are stopped, and then, the command analysis processing shown in FIG. 50 will be described again.

In step S1120, the CPU 33*a* of the entertainment control board 33 checks if the command stored in the receiver buffer is a symbol changing time command. When the command stored in the receiver buffer is a symbol changing time command, the CPU 33*a* of the entertainment control board 33 moves the step to step S1121. On the other hand, when the command is not a symbol changing time command, the CPU 33*a* moves the step to step S1130.

In step S1121, the CPU 33*a* of the entertainment control board 33 performs symbol changing data determination processing to determine data used to display the changing assigned object symbol that corresponds to the assigned object (hereinafter "changing symbol display data"), based on the symbol changing time command, which has been received, until the result of the assigned object is informed. In the changing data determination processing, when determining changing symbol display data, the CPU 33*a* sets the determined changing symbol display data in a transmission buffer in order to transmit the determined changing data to the image control board 34 and the lamp control board 35. After that, the image control board 34 having received the changing symbol display data displays the assigned object symbol, which is changing, and controls the speaker 37. Likewise, when receiving the changing symbol display data, the lamp control board 35 controls the light emitting device 6, the frame lamp 38*a*, the board lamp 38*b* and the movable object device 22.

In step S1130, the CPU 33*a* of the entertainment control board 33 checks if the command stored in the receiver buffer is a symbol designation command. When the command stored in the receiver buffer is a symbol designation command, the CPU 33*a* of the entertainment control board 33 moves the step to step S1131. On the other hand, when the command is not a symbol designation command, the CPU 33*a* moves the step to step S1140.

In step S1131, the CPU 33*a* of the entertainment control board 33 performs stop data determination processing to set the data used to finally stationarily display the assigned object symbol in the transmission buffer in the RAM 33*c*, in order to inform the result of the assigned object.

In step S1140, the CPU 33*a* of the entertainment control board 33 determines whether or not the command stored in the receiver buffer is a round number command. When the command stored in the receiver buffer is a round number command, the CPU 33*a* of the entertainment control board 33 moves the step to step S1141. On the other hand, when the command is not a round number command, the CPU 33*a* moves the step to step S1150.

In step S1141, the CPU 33*a* of the entertainment control board 33 analyzes round number data from the received round number command, and stores the analyzed round number data in a storage area for round number data in the RAM 33*c*. For example, when receiving the round number command "E1H01H", the CPU 33*a* stores 16R data in the storage area for round number data. Meanwhile, when receiving the round number command "E1H02H", the CPU 33*a* stores 10R data in the storage area for round number data.

In step S1142, the CPU 33*a* of the entertainment control board 33 performs second movement determination processing to determine whether or not to move the entertainment button 40 to the protruding position, based on the round number data.

In step 1143, the CPU 33*a* of the entertainment control board 33 performs second protruding manner determination processing to determine a protruding manner in which the entertainment button 40 to the protruding position, based on the round number data.

In step S1144, the CPU 33*a* of the entertainment control board 33 sets a second available time to enable the operation of the entertainment button 40, corresponding to the rand number data, in a second available time counter in the RAM 33*c*. Here, the second available time counter is decremented by one every 2 ms and updated in step S1300.

Here, the second available time set in the second available time counter is set shorter than the time interval until the start of a bonus game, in order to enable the operation of the entertainment button 40 to inform of the round number during the period of time until the bonus game hole is open after the assigned object symbol is finally stationarily displayed on the image display 21.

<Second Movement Determination Processing on the Entertainment Control Board>

Figure 53:
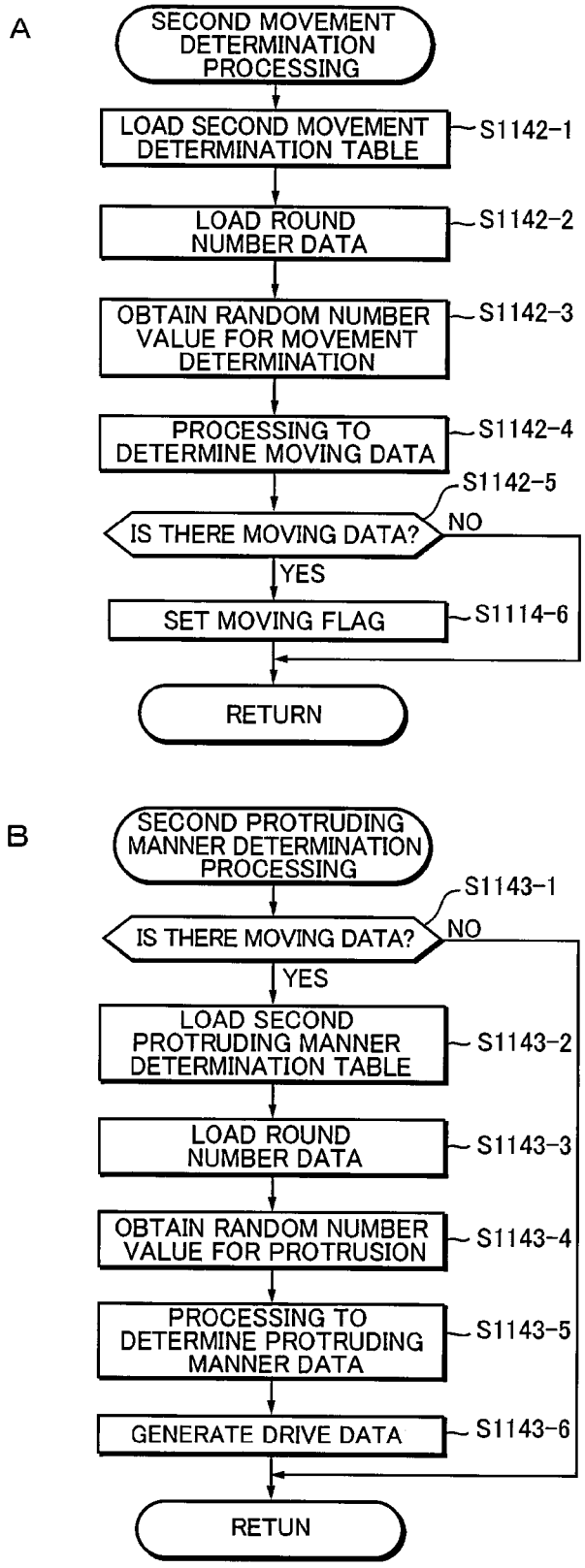
FIG. 53A shows second movement determination processing on the entertainment control board.
FIG. 53B shows second protruding manner determination processing on the entertainment control board.

With reference to FIG. 53A, second movement determination processing on the entertainment control board 33 will be explained.

In step S1142-1, the CPU 33*a* of the entertainment control board 33 loads the second movement determination table shown in FIG. 35B, from the ROM 33*b*.

In step S1142-2, the CPU 33*a* of the entertainment control board 33 loads round number data from the storage area for round number data in the RAM 33*c*.

In step S1142-3, the CPU 33*a* of the entertainment control board 33 obtains one of the random number values for movement determination, which have been updated in step S1010.

In step S1142-4, the CPU 33*a* of the entertainment control board 33 refers to the second movement determination table shown in FIG. 35B and performs movement data determination processing to determine movement data, based on the round number data and the random number value for movement determination.

In step S1142-5, the CPU 33*a* of the entertainment control board 33 performs whether or not movement data has been determined in step S1112-4. When determining that movement data is determined, the CPU 33*a* of the entertainment control board 33 moves the step to step S1142-6. On the other hand, when determining that movement data has not been determined, the CPU 33*a* ends this second movement determination processing.

In step S1142-6, the CPU 33*a* of the entertainment control board 33 sets a moving flag in the storage area for moving flag in the RAM 33*c* (that is, turns on a moving flag).

<Second Protruding Manner Determination Processing on the Entertainment Control Board>

With reference to FIG. 53B, second protruding manner determination processing on the entertainment control board 33 will be explained.

In step S1143-1, the CPU 33*a* of the entertainment control board 33 refers to the storage area for moving flag and determines whether or not a moving flag is set (that is, a moving flag is turned on).

In step S1143-2, the CPU 33*a* of the entertainment control board 33 loads the second protruding manner determination table shown in FIG. 36B, from the ROM 33*b*.

In step S1143-3, the CPU 33*a* of the entertainment control board 33 loads round number data from the storage area for round number data in the RAM 33*c*.

In step S1143-4, the CPU 33*a* of the entertainment control board 33 obtains one of the random number values for protrusion, which have been updated in step S1010.

In step S1143-5, the CPU 33*a* of the entertainment control board 33 refers to the second protruding manner determination table shown in FIG. 36B, and determines protruding manner data, based on the round number data and the random number value for protrusion.

In step S1143-6, the CPU 33*a* of the entertainment control board 33 creates drive data on the electric motor 71, based on the protruding manner data determined in step S1143-5. This drive data is outputted in step S1500, so that the shaft member 68 rotates to move the entertainment button 40.

Now, the descriptions of the second movement determination processing and the second protruding manner determination processing on the entertainment control board 33 are stopped, and then the command analysis processing shown in FIG. 51 will be described again.

In step S1150, the CPU 33*a* of the entertainment control board 33 checks if the command stored in the receiver buffer is an opening command. When the command stored in the receiver buffer is an opening command, the CPU 33*a* of the entertainment control board 33 moves the step to step S1151. On the other hand, when the command is not an opening command, the CPU 33*a* moves the step to step S1160.

In step S1151, the CPU 33*a* of the entertainment control board 33 performs processing to determine data used for entertainment at the start of a bonus game to inform the start of a bonus game. To be more specific, the CPU 33*a* determines data used for entertainment at the start of a bonus game to inform the start of a bonus game, and sets this data in the transmission buffer in the RAM 33*c*, in order to transmit the determined data to the image control board 34 and the lamp control board 35.

In step S1160, the CPU 33*a* of the entertainment control board 33 checks if the command stored in the receiver buffer is a bonus game hole opening command. When the command stored in the receiver buffer is a bonus game hole opening command, the CPU 33*a* of the entertainment control board 33 moves the step to step S1161. On the other hand, when the command is not a bonus game hole opening command, the CPU 33*a* moves the step to step S1170.

In step S1161, the CPU 33*a* of the entertainment control board 33 performs processing to determine data used for bonus game entertainment in order to perform entertainment for bonus game. To be more specific, the CPU 33*a* determines bonus game entertainment data to perform entertainment for bonus game, and sets the determined bonus game entertainment data in the transmission buffer in the RAM 33*c*, in order to transmit the determined bonus game entertainment data to the image control board 34 and the lamp control board 35.

In step S1170, the CPU 33*a* of the entertainment control board 33 checks if the command stored in the receiver buffer is an ending command. When the command stored in the receiver buffer is an ending command, the CPU 33*a* of the entertainment control board 33 moves the step to step S1171. On the other hand, when the command is not an ending command, the CPU 33*a* ends this command analysis processing.

In step S1171, the CPU 33*a* of the entertainment control board 33 performs processing to determine data used for entertainment at the end of the bonus game in order to inform that the bonus game is end. To be more specific, the CPU 33*a* determines data used for entertainment at the end of the bonus game to inform that the bonus game is ended, and sets the data used for entertainment at the end of the bonus game in the transmission buffer in the RAM 33*c*, in order to transmit the determined data to the image control board 34 and the lamp control board 35. Upon ending this processing, the command analysis processing is ended.

As described above, the lamp control board 35 and the image control board 34 having received each command from the entertainment control board 33 control the light emitting device 6, controls the audio output from the speaker 37, and controls the image display on the image display 21 according to each received data.

<Processing to Control Input Related to Entertainment on the Entertainment Control Board>

Figure 54:
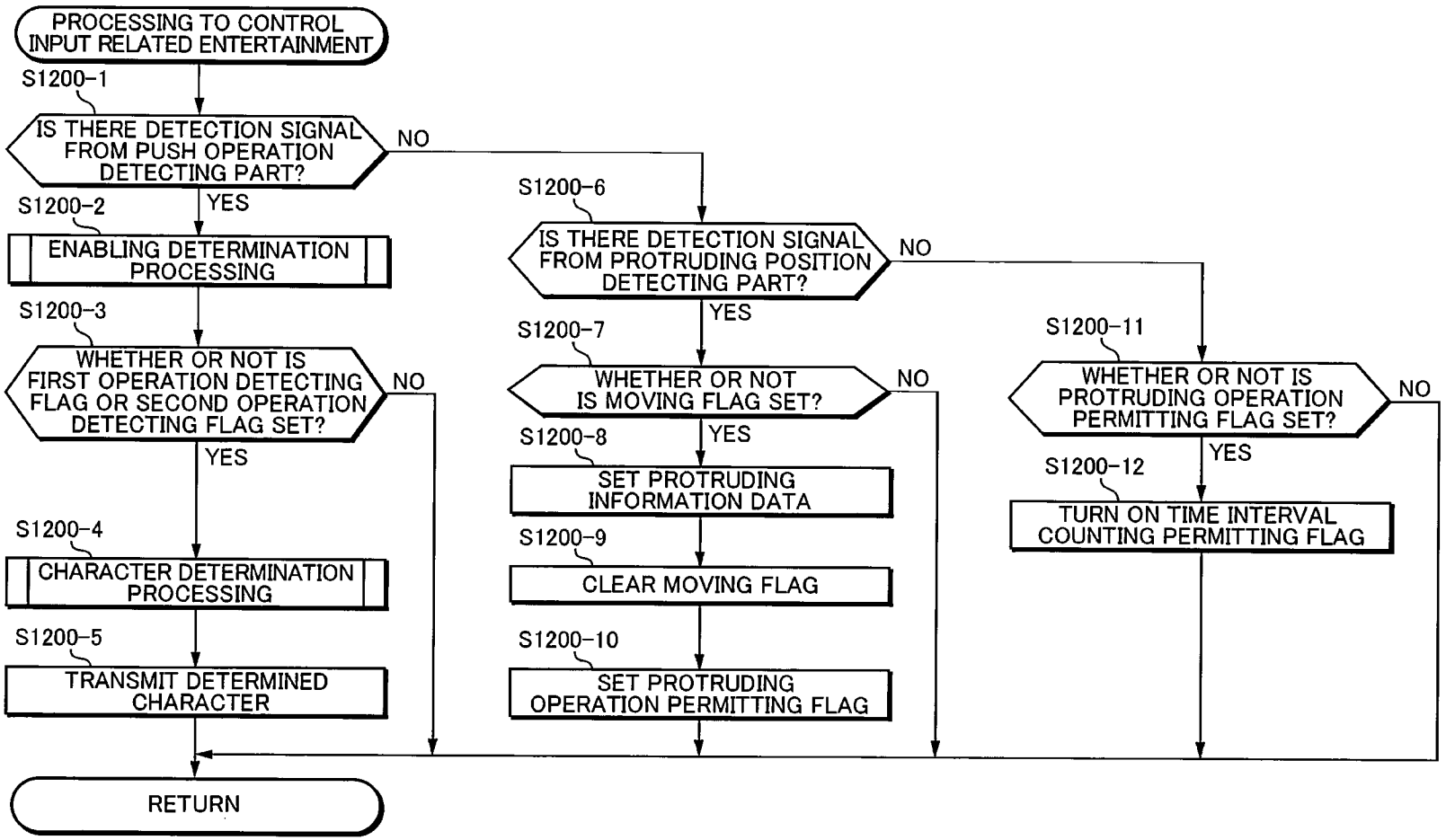
FIG. 54 shows exemplary processing to control the input related to entertainment on the entertainment control board.

With reference to FIG. 54, processing to control the input related to entertainment on the entertainment control board 33 will be explained.

In step S1200-1, the CPU 33*a* of the entertainment control board 33 determines whether or not there is a detection signal from the push operation detecting parts 69*a* and 69*b*. When there is a detection signal from the push operation detecting parts 69*a* and 69*b*, the CPU 33*a* of the entertainment control board 33 moves the step to step S1200-2. On the other hand, when there is no detection signal from the push operation detecting parts 69*a* and 69*b*, the CPU 33*a* moves the step to step S1200-6.

In step S1200-2, the CPU 33*a* of the entertainment control board 33 performs enabling determination processing to determine whether or not the detection signal from the push operation detection parts 69*a* and 69*b* is enabled. This enabling determination processing will be described in detail later, with reference to FIG. 55.

In step S1200-3, the CPU 33*a* of the entertainment control board 33 determines whether or not one of a first operation detecting flag and a second operation detecting flag is set. When determining that one of the operation detecting flags is set, the CPU 33*a* of the entertainment control board 33 moves the step to step S1200-4. On the other hand, when determining that no operation detection flag is set, the CPU 33*a* ends this processing to control the input related to entertainment.

Here, "first operation detecting flag" is data used to allow a character to be determined based on the assigned object data and is set when the detection signal from the push operation detecting parts 69*a* and 69*b* is enabled in the enabling determination processing in step S1200-2. Meanwhile, as described later, "second operation detecting flag" is data used to allow a character to be determined based on the round number data, and is set when the detection signal from the push operation detecting parts 69*a* and 69*b* is enabled in the enabling determination processing in step S1200-2.

In step S1200-4, the CPU 33*a* of the entertainment control board 33 refers to the character determination table shown in FIG. 37A to FIG. 37D, and performs character determination processing to determine character data. This character determination processing will be described in detail, with reference to FIG. 56.

In step S1200-5, the CPU 33*a* of the entertainment control board 33 sets the determined character data, which has been determined in step S1200-4, in the transmission buffer in the RAM 33*c*, in order to transmit the character data to the image control board 34 and the lamp control board 35.

In step S1200-6, the CPU 33*a* of the entertainment control board 33 determines whether or not there is a signal from the protruding position detecting parts 43*d* and 67. When determining that there is a detection signal from the protruding position determining parts 43*d* and 67, the CPU 33*a* of the entertainment control board 33 moves the step to step S1200-7. On the other hand, when determining that there is no detection signal from the protruding position detecting parts 43*d* or 67, the CPU 33*a* moves the step to step S1200-11.

In step S1200-7, the CPU 33*a* of the entertainment control board 33 refers to the storage area for moving flag in the RAM 33*c*, and determines whether or not a moving flag is set. When determining that a moving flag is set, the CPU 33*a* of the entertainment control board 33 moves the step to step S1200-8. On the other hand, when determining that a moving flag is not set, the CPU 33*a* ends this processing to control the input related to entertainment.

In step S1200-8, the CPU 33*a* of the entertainment control board 33 determines protrusion information data to inform that the entertainment button 40 reaches the protruding position, and sets the determined protrusion information data in the transmission buffer in the RAM 33*c*, in order to transmit the protrusion information data to the image control board 34 and the lamp control board 35.

In step S1200-9, the CPU 33*a* of the entertainment control board 33 clears the movement flag stored in the storage area for moving flag in the RAM 33*c*.

In step S1200-10, the CPU 33*a* of the entertainment control board 33 sets a protruding operation permitting flag in a storage area for protruding operation permitting flag in the RAM 33*c*.

This "protruding operation permitting flag" is data used to recognize that the entertainment button 40 is held in the protruding position.

In step S1200-11, the CPU 33*a* of the entertainment control board 33 determines whether or not the protruding operation permitting flag is set in the storage area for protruding operation permitting flag in the RAM 33*c*. When determining that the protruding operation permitting flag is set, the CPU 33*a* of the entertainment control board 33 moves the step to step S1200-12. On the other hand, when determining that the protruding operation permitting flag is not set, the CPU 33*a* ends this processing to control the input related to entertainment.

Here, in a case in which a protruding operation permitting flag is set in step S1200-11 though there is no detection signal from the protruding position detecting parts 43*d* and 67 in step S1200-6, the entertainment button 40 in the protruding position is pushed down, and therefore moves to the normal operation position.

In step S1200-12, the CPU 33*a* of the entertainment control board 33 sets a flag to permit time interval counting (herein after "time interval counting permitting flag") in the storage area for time interval counting permitting flag in RAM 33*c*.

Here, "time interval counting permitting flag" is data used to recognize that the entertainment button 40 in the protruding position is pushed down, and is cleared when the entertainment button 40 reaches the normal operation position, as described later. In addition, the time interval for which the time interval counting permitting flag is set is measured.

<Enabling Determination Processing on Entertainment Control Board>

Figure 55:
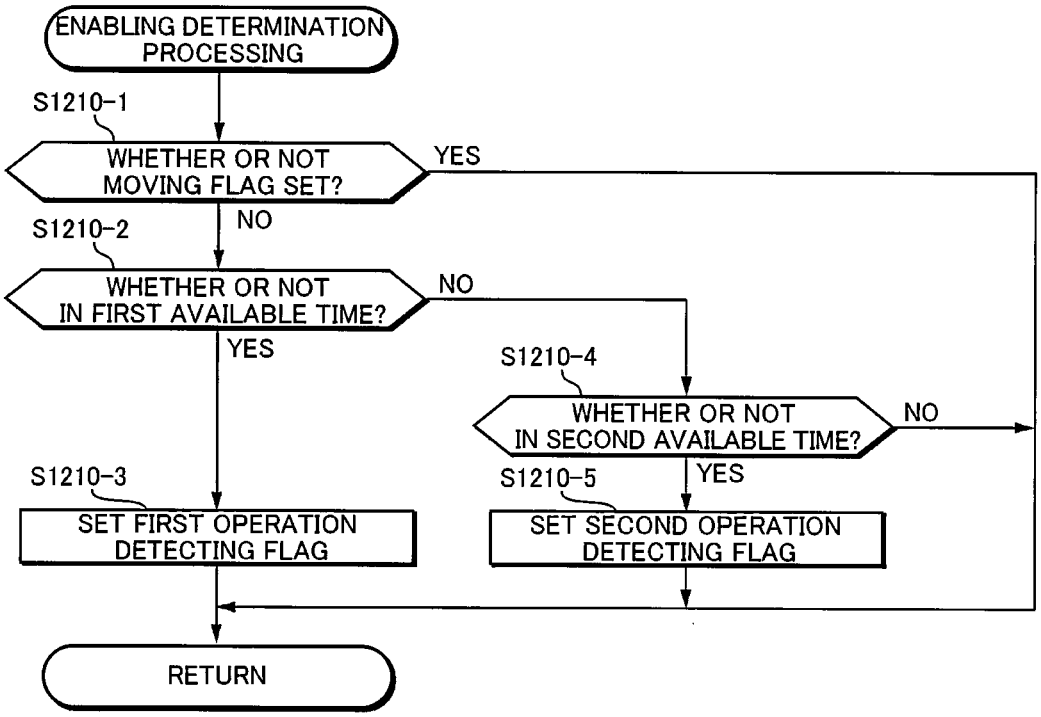
FIG. 55 shows exemplary enabling determination processing on the entertainment control board.

With reference to FIG. 55, enabling determination processing on the entertainment control board 33 will be explained.

In step S1210-1, the CPU 33*a* of the entertainment control board 33 refers to the storage area for moving flag in the RAM 33*c*, and determines whether or not a moving flag is set. When determining that no moving flag is set, the CPU 33*a* of the entertainment control board 33 moves the step to step S1210-2. On the other hand, when determining that a moving flag is set, the CPU 33*a* ends this enabling determination processing.

By this means, when a moving flag is set, any detection signal from the push operation detecting parts 69*a* and 69*b* is disabled.

In step S1210-2, the CPU 33*a* of the entertainment control board 33 refers to the first available time counter in the RAM 33*c*, and determines whether or not the time is in the first available time. That is, the CPU 33*a* determines whether or not the first available time counter is zero. When determining that the time is in the first available time, the CPU 33*a* of the entertainment control board 33 moves the step to step S1210-3. On the other hand, when determining that the time is not in the first available time, the CPU 33*a* moves the step to step S1210-4.

In step S1210-3, the CPU 33*a* of the entertainment control board 33 sets the first operation detecting flag in a storage area for first operation detecting flag in the RAM 33*c*.

In step S1210-4, the CPU 33*a* of the entertainment control board 33 refers to the second available time counter, and determines whether or not the time is in the second available time. That is, the CPU 33*a* determines whether or not the second available time counter is zero. When determining that the time is in the second available time, the CPU 33*a* of the entertainment control board 33 moves the step to step S1210-5. On the other hand, when determining that the time is not in the second available time, the CPU 33*a* ends this enabling determination processing.

In step S1210-5, the CPU 33*a* of the entertainment control board 33 sets the second operation detecting flag in a storage area for second operation detecting flag.

<Character Determination Processing on the Entertainment Control Board>

Figure 56:
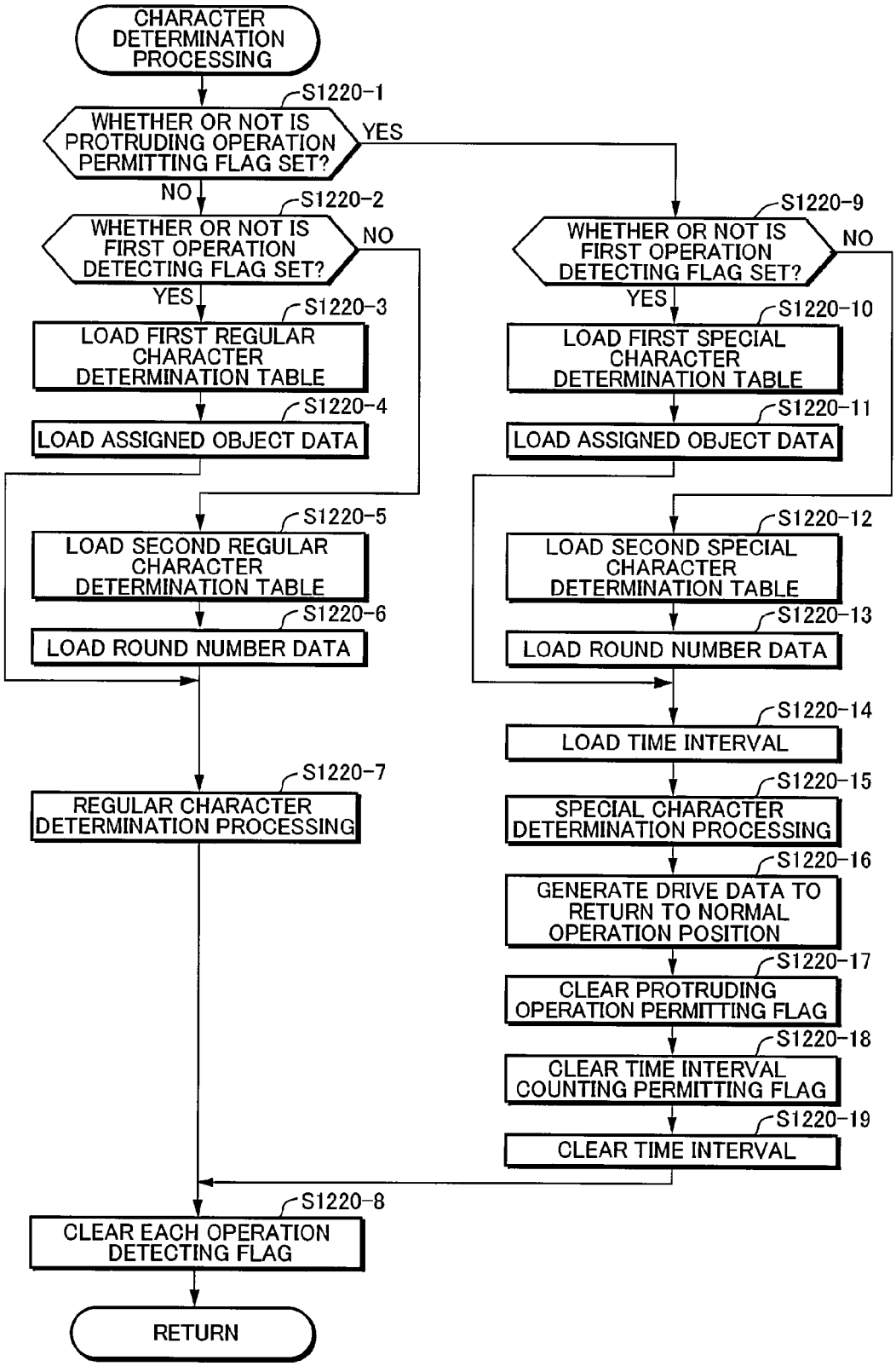
FIG. 56 shows exemplary character determination processing on the entertainment control board.

With reference to FIG. 56, character determination processing on the entertainment control board 33 will be explained.

In step S1220-1, the CPU 33*a* of the entertainment control board 33 refers to the storage area for protruding operation permitting flag in the RAM 33*c*, and determines whether or not a protruding operation permitting flag is set. When determining that the protruding operation permitting flag is set, the CPU 33*a* of the entertainment control board 33 moves the step to step S1220-9. On the other hand, when determining that the protruding operation permitting flag is not set, the CPU 33*a* moves the step to step S1220-2.

In step S1220-2, the CPU 33*a* of the entertainment control board 33 refers to the storage area for first operation detecting flag in the RAM 33*c*, and determines whether or not a first operation detecting flag is set. When determining that the first operation detecting flag is set, the CPU 33*a* of the entertainment control board 33 moves the step to step S1220-3. On the other hand, when determining that the first operation detecting flag is not set, the CPU 33*a* moves the step to step S1220-5.

In step S1220-3, the CPU 33*a* of the entertainment control board 33 loads the first regular character determination table shown in FIG. 37A, from the ROM 33*b*.

In step S1220-4, the CPU 33*a* of the entertainment control board 33 loads the assigned object data from the storage area for assigned object data in the RAM 33*c*.

In step S1220-5, the CPU 33*a* of the entertainment control board 33 loads the second regular character determination table shown in FIG. 37C, from the ROM 33*b*.

In step S1220-6, the CPU 33*a* of the entertainment control board 33 loads the round number data from the storage area for round number data in the RAM 33*c*.

In step S1220-7, the CPU 33*a* of the entertainment control board 33 performs regular character determination processing to determine character data, based on the loaded tables (the first and second regular character determination tables) and the data (the assigned object data or the round number data). Then, in order to transmit the determined character data to the image control board 34 and the lamp control board 35, the CPU 33*a* sets the character data in the transmission buffer in the RAM 33*c*.

In step S1220-8, the CPU 33*a* of the entertainment control board 33 clears the first operation detecting flag and the second operation detecting flag.

In step 1220-9, the CPU 33*a* of the entertainment control board 33 refers to the storage area for first operation detecting flag in the RAM 33*c*, and determines whether or not the first operation detecting flag is set. When determining that the first operation detecting flag is set, the CPU 33*a* of the entertainment control board 33 moves the step to step S1220-10. On the other hand, when determining that the first operation detecting flag is not set, the CPU 33*a* moves the step to step S1220-12.

In step S1220-10, the CPU 33*a* of the entertainment control board 33 loads the first special character determination table shown in FIG. 37B, from the ROM 33*b*.

In step S1220-11, the CPU 33*a* of the entertainment control board 33 loads assigned object data from the storage area for assigned object data in the RAM 33*c*.

In step S1220-12, the CPU 33*a* of the entertainment control board 33 loads the second special character determination table shown in FIG. 37D, from the ROM 33*b*.

In step S1220-13, the CPU 33*a* of the entertainment control board 33 loads the round number data from the storage area for round number data in the RAM 33*c*.

In step S1220-14, the CPU 33*a* of the entertainment control board 33 loads the time interval stored in a time interval counter in the RAM 33*c*.

Here, "time interval counter" is incremented every 2 ms while the time interval counting permitting flag is set, as described later with reference to FIG. 57.

In step S1220-15, the CPU 33*a* of the entertainment control board 33 performs special character determination processing to determine character data, based on the loaded tables (the first and second special character determination tables), the data (the assigned object data or the round number data) and the time interval. Then, in order to transmit the determined character data to the image control board 34 and the lamp control board 35, the CPU 33*a* sets the character data in the transmission buffer in the RAM 33*c*.

In step S1220-16, the CPU 33*a* of the entertainment control board 33 creates drive data on the electric motor 71 to return the entertainment button 40 to the normal operation position. By this means, the entertainment button 40 can be held in the normal operation position by pushing down the entertainment button 40 in the protruding position.

In step 1220-17, the CPU 33*a* of the entertainment control board 33 clears the protruding operation permitting flag from the storage area for protruding operation permitting flag in the RAM 33*c*.

In step S1220-18, the CPU 33*a* of the entertainment control board 33 clears the time interval counting permitting flag from the storage area for time interval counting permitting flag in the RAM 33*c*.

In step S1220-19, the CPU 33*a* of the entertainment control board 33 clears the time interval stored in the time interval counter in the RAM 33.

<Timer Update Processing on the Entertainment Control Board>

Figure 57:
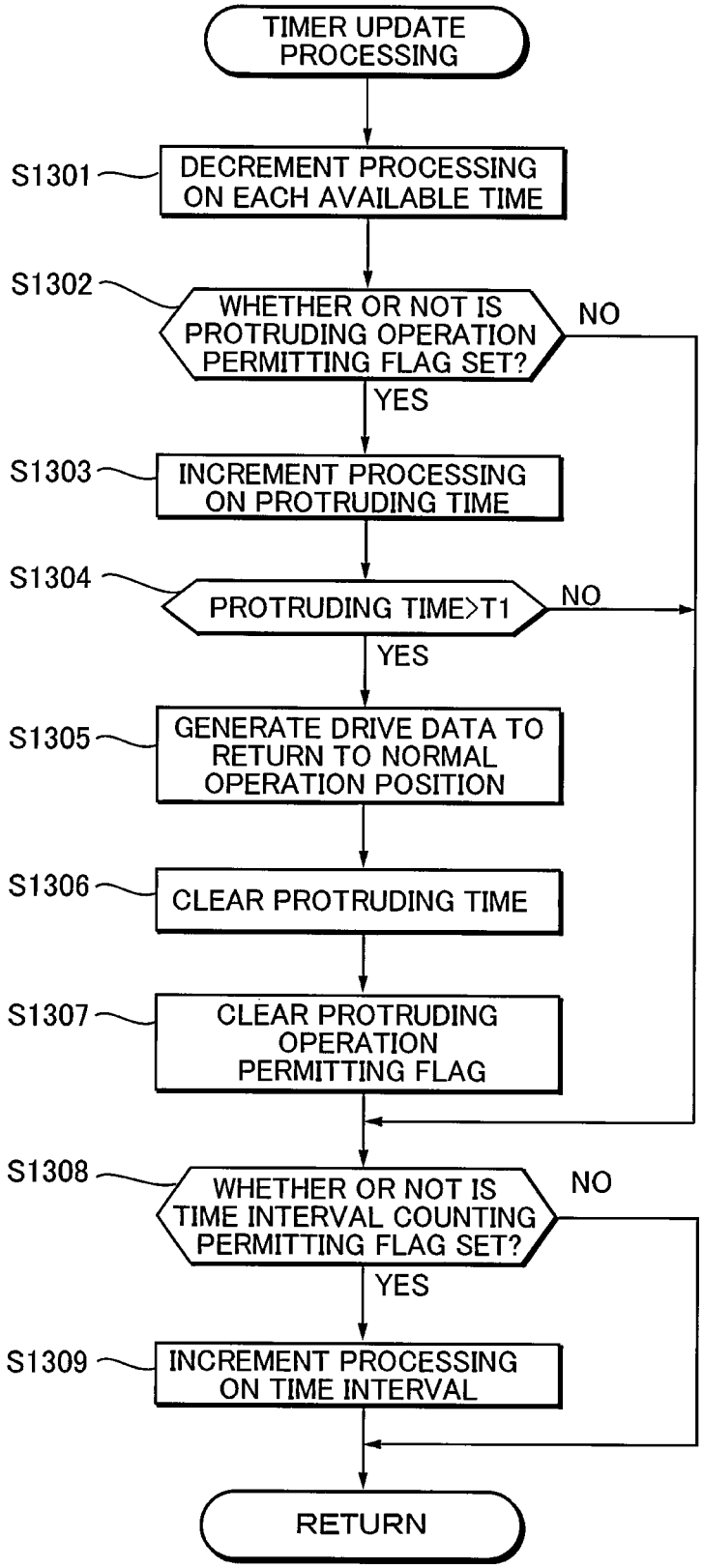
FIG. 57 shows exemplary timer update processing on the entertainment control board.

With reference to FIG. 57, timer update processing on the entertainment control board 33 will be explained.

In step S1301, the CPU 33*a* of the entertainment control board 33 performs decrement processing to decrement the first available time counter and the second available time counter in the RAM 33*c* by one and update the counters.

In step S1302, the CPU 33*a* of the entertainment control board 33 refers to the storage area for protruding operation permitting flag in the RAM 33*c*, and determines whether or not the protruding operation permitting flag is set. When determining that the protruding operation permitting flag is set, the CPU 33*a* of the entertainment control board 33 moves the step to step S1303. On the other hand, when determining that the protruding operation permitting flag is not set, the CPU 33*a* moves the step to step.

In step S1303, the CPU 33*a* of the entertainment control board 33 performs increment processing to increment a protruding time counter in the RAM 33*c* by one and update the counter.

In step S1304, the CPU 33*a* of the entertainment control board 33 refers to the protruding time counter in the RAM 33*c*, and determines whether or not the protruding time>T1 (e.g. five seconds).

In step S1305, the CPU 33*a* of the entertainment control board 33 creates drive data on the electric motor 71 to return the entertainment button 40 to the normal operation position. By this means, after the elapse of T1 for which the entertainment button 40 is held in the protruding position, the entertainment button 40 is returned to the normal operation position.

In step S1306, the CPU 33*a* of the entertainment control board 33 clears the protruding time counter in the RAM 33*c*.

In step S1307, the CPU 33*a* of the entertainment control board 33 clears the protruding operation permitting flag from the storage area for protruding operation permitting flag in the RAM 33*c*.

In step S1308, the CPU 33*a* of the entertainment control board refers to the storage area for time interval counting permitting flag in the RAM 33*c*, and determines whether or not the time interval counting permitting flag is set. When determining that the time interval counting permitting flag is set, the CPU 33*a* of the entertainment control board 33 moves the step to step S1309. On the other hand, when determining that the time interval counting permitting flag is not set, the CPU 33*a* ends this timer update processing.

In step S1309, the CPU 33*a* of the entertainment control board 33 performs increment processing to increment the time interval counter in the RAM 33*c* by one and update the counter.

That is the end of the descriptions of the processing performed by the CPU 33*a* of the entertainment control board 33.

<Display Screen of the Image Display>

Next, with reference to FIG. 58 to FIG. 61, the display screen of the image display 21 will be explained.

Figure 59:
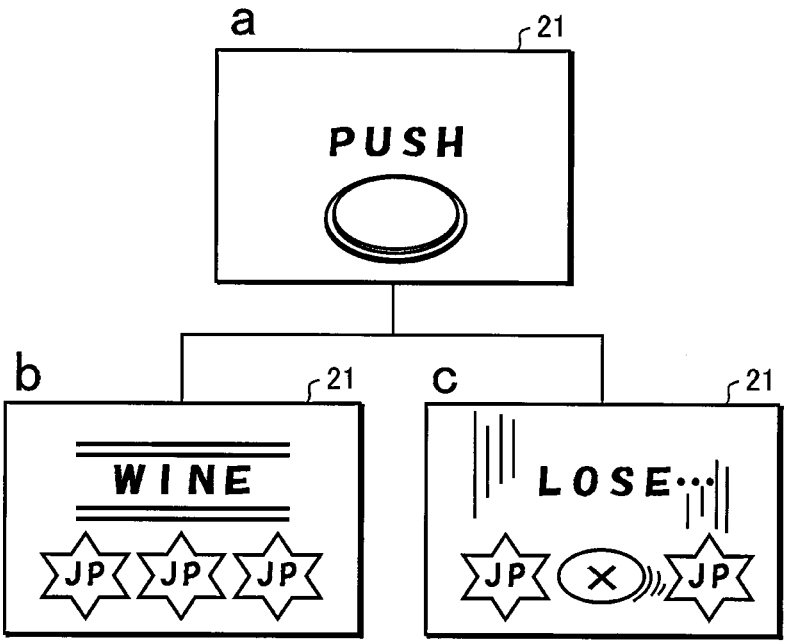
FIG. 59 shows examples of a display screen 2 of the image display each displaying an assigned object symbol.

FIG. 58 and FIG. 59 each shows examples of a display screen of the image display 21 each displaying an assigned object symbol.

In FIG. 58, "a" shows a display screen of the image display 21 showing the image corresponding to protruding information data, because the entertainment button 40 reaches the protruding position (see, for example, the above-described step S1200-8).

Then, when the entertainment button 40 in the protruding position is pushed down, character data as the assigned object symbol displayed on the image display 21 is determined based on the assigned object data and the time interval (see, for example, FIG. 37B and the above-described step S1200-4).

At this time, when the assigned object data is "jack pot", a first assigned object symbol in which three "JP"s are arranged as shown in "b" to "d" of FIG. 58, is displayed on the image display 21.

Here, "b" of FIG. 58 corresponds to the display screen for "character 01 data" shown in FIG. 37 and displays a word such as "WIN!" in large distinct letters as well as the first assigned object symbol. In addition, "c" of FIG. 58 corresponds to the display screen for "character 02" shown in FIG. 37 and displays a word such as "WIN!" in normal sized letters as well as the first assigned object symbol. Moreover, "d" of FIG. 58 corresponds to the display screen for "character 03" shown in FIG. 37 and displays a word such as "WIN!" in smaller letters.

In FIG. 59, "a" shows a display screen of the image display 21 when the first available time is measured while the entertainment button 40 is in the normal operation position.

Then, when the entertainment button 40 in the normal operation position is pushed down, character data for the assigned object symbol displayed on the image display 21 is determined, based on the assigned object data (see, for example, FIG. 37A, and the above-described step S1200-4).

At this time, when the assigned object data is "jack pot", a first assigned object symbol in which three "JP"s are arranged, as shown in "b" of FIG. 59, is displayed on the image display 21. On the other hand, the assigned object data is "loss", a second assigned object symbol in which three "JP"s are not arranged, as shown in "c" of FIG. 59, is displayed on the image display 21.

In addition, when the assigned object data is "loss", a word such as "LOSE" as shown in "c" of FIG. 59 is displayed in normal-sized letters as well as the second assigned object symbol.

Here, the first assigned object symbol or the second assigned object symbol shown on the display screen continue to be displayed until the image control board 34 receives the assigned object symbol stop data from the entertainment control board 33 (see, for example, the above-described step S1131).

Figure 61:
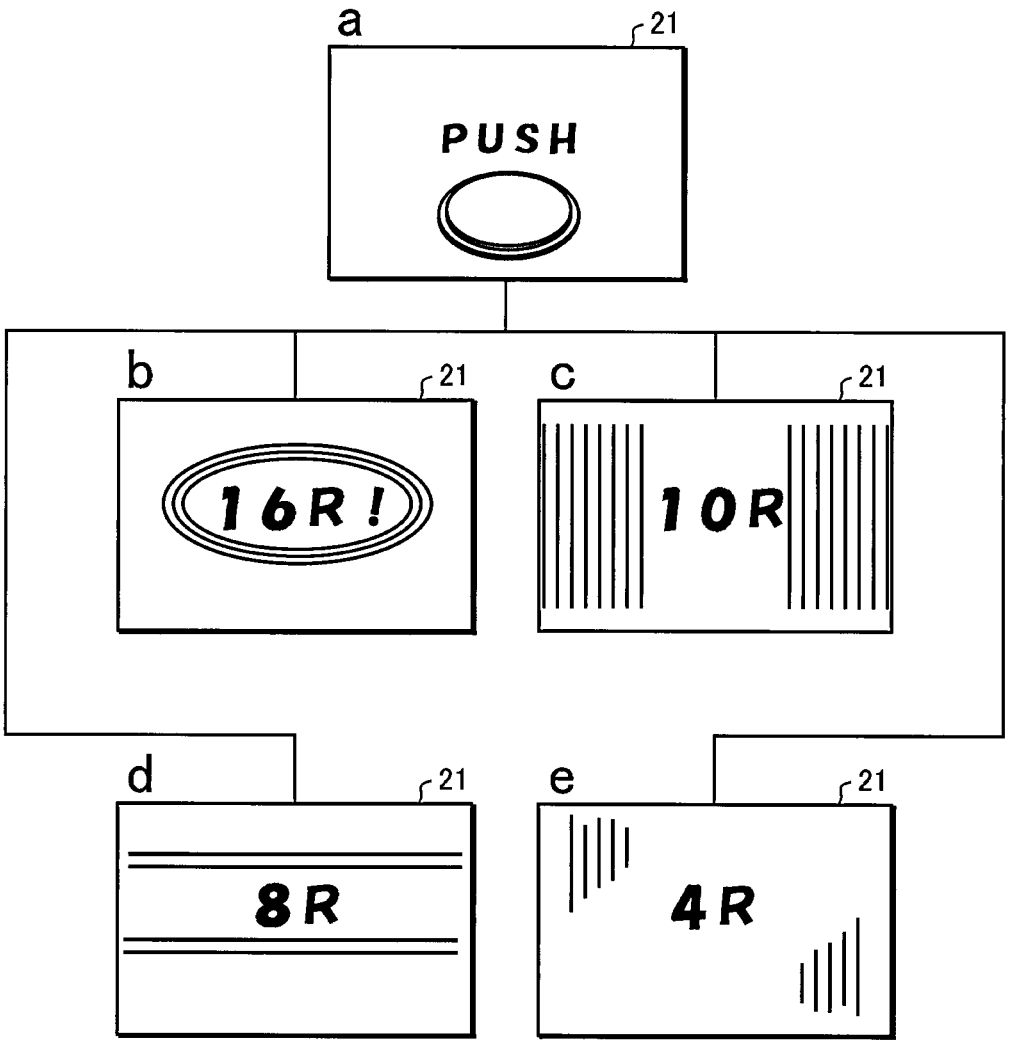
FIG. 61 shows examples of the display screen 2 of the image display each displaying a prize symbol.

FIG. 60 and FIG. 61 each shows examples of display screen of the image display 21 each displaying a prize symbol.

In FIG. 60, "a" shows a display screen of the image display 21 in which the image corresponding to protruding information data is displayed, because the entertainment button 40 reaches the protruding position (see the above-described step 1200-8).

Then, when the entertainment button 40 in the protruding position is pushed down, character data as the prize symbol displayed on the image display 21 is determined, based on the round number data and the time interval (see, for example, FIG. 37D, and the above-described step S1200-4).

At this time, when the round number data is 16R, the prize character "16R" as shown in "b" to "d" of FIG. 60 is displayed on the image display 21.

Here, in FIG. 60, "b" corresponds to the display screen for "character 11" shown in FIG. 37, and displays the prize symbol "16R" in distinct larger letters and with distinct decoration. In addition, "c" corresponds to the display screen for "character 12" shown in FIG. 37 and displays the prize character "16R" in normal-sized letters and with normal decoration. In addition, "d" corresponds to the display screen for "character 13" shown in FIG. 37 and displays the prize symbol "16R" in smaller letters.

In FIG. 61, "a" shows a display screen of the image display 21 when the second available time is measured while the entertainment button 40 is in the normal operation position.

Then, when the entertainment button 40 in the normal operation position is pushed down, character data as the prize symbol displayed on the image display 21 is determined based on the round number data (see, for example FIG. 37C and the above-described step S1200-4).

At this time, when the round number data is 16R, the prize symbol "16R" as shown in "b" of FIG. 61 is displayed on the image display 21. Meanwhile, the round number data is 10 R, the prize symbol "10R" as shown in "c" of FIG. 61 is displayed on the image display 21. In addition, when the round number data is 8R, the prize symbol "8R" as shown in "d" of FIG. 61 is displayed on the image display 21. Meanwhile, when the round data is 4R, the prize symbol "4R" as shown in "e" of FIG. 61 is displayed on the image display 21.

Moreover, as shown in "b" to "e" of FIG. 61, the displayed decoration varies according to the prize symbol.

The present invention can be practiced with various configurations in addition to in the above-described embodiment as long as they do not deviate from the gist of the present invention. The entertainment button device and the discharge device according to the present invention, or the tray unit provided with them, are applicable to various pachinko game machines. In particular, the entertainment button device is applicable to various game machines such as a slot machine besides pachinko game machines.

Figure 62:
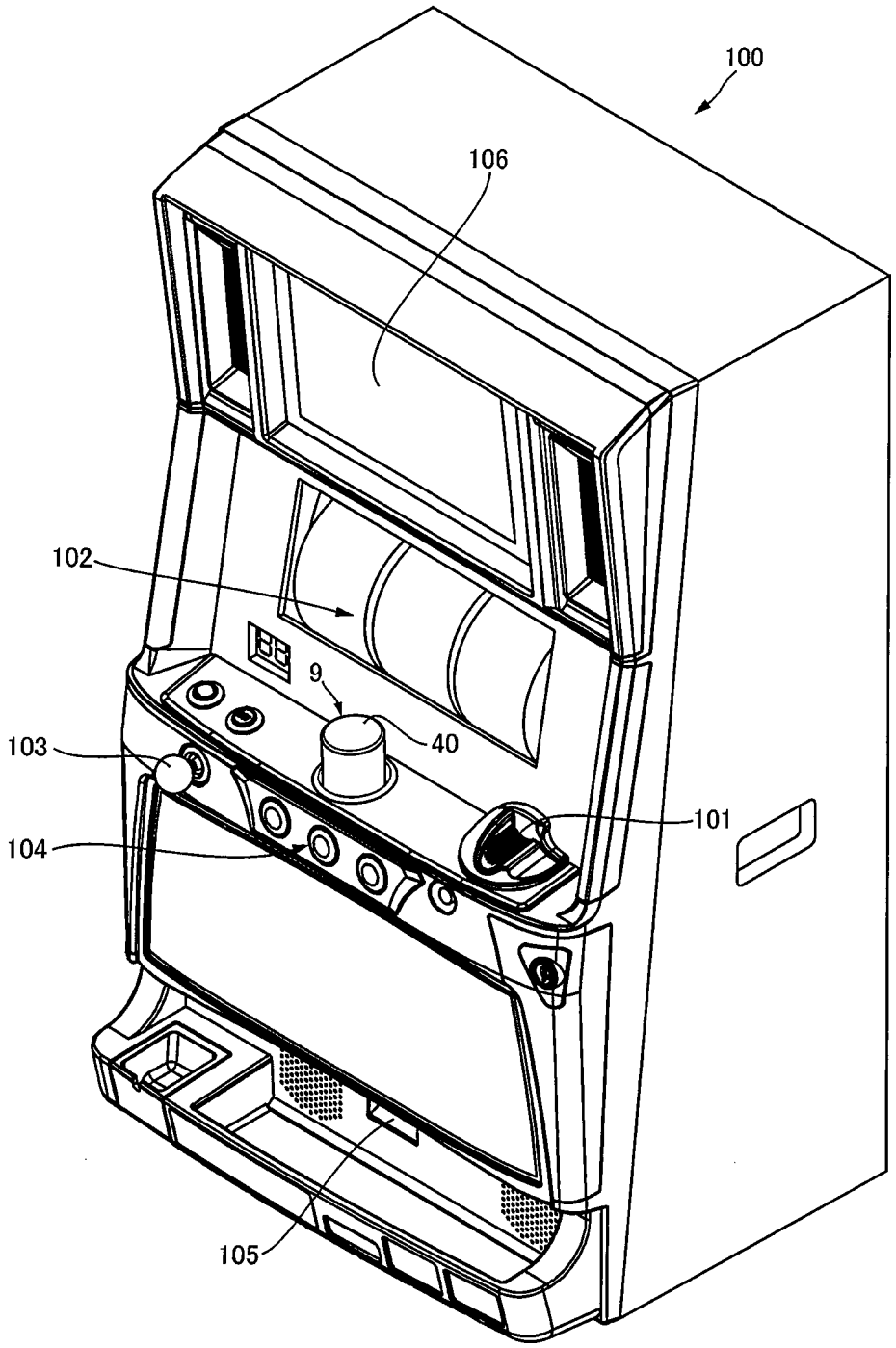
FIG. 62 is a perspective view showing a slot machine according to a variation.

FIG. 62 is a variation showing a slot machine 100 including the entertainment button 40 according to the present invention.

As shown in FIG. 62, the slot machine 100 at least includes: the entertainment button device 9 having the entertainment button 40; a coin slot 101 to insert medals, coins and so forth; a plurality of reels 102 on which several kinds of symbols are shown; a control lever 103 to rotate the reels 102; stop buttons 104 corresponding to the respective reels 102 to stop the reels 102; a payout slot 105 to pay out medals, coins and so forth; and an image display device 106 that displays images associated with entertainments.

With this slot machine 100, combined symbols stationarily displayed on the reel are equivalent to "assigned object", and the number of medals to be paid out and the number of free games are equivalent to "prize."

The player puts medals, coins and so forth in the coin slot 101 and operates the control lever 103 to start rotating the reels 102. Then, the player operates a stop button 104, the reel 102 corresponding to the operated stop button 104 stops.

If a specific symbol is shown or specific symbols are shown at the time all the reels 102 stop, a predetermined number of medals or coins are paid out from the payout slot 105.

Then, the images associated with the entertainment are shown on the image display device 106 until all the reels 102 stop after the reels 102 start rotating. Moreover, the entertainment button 40 moves up and down between a predetermined operation position and the protruding position provided that a predetermined event occurs. By this means, it is possible to improve the effect of the entertainment of the game.

Figure 27:
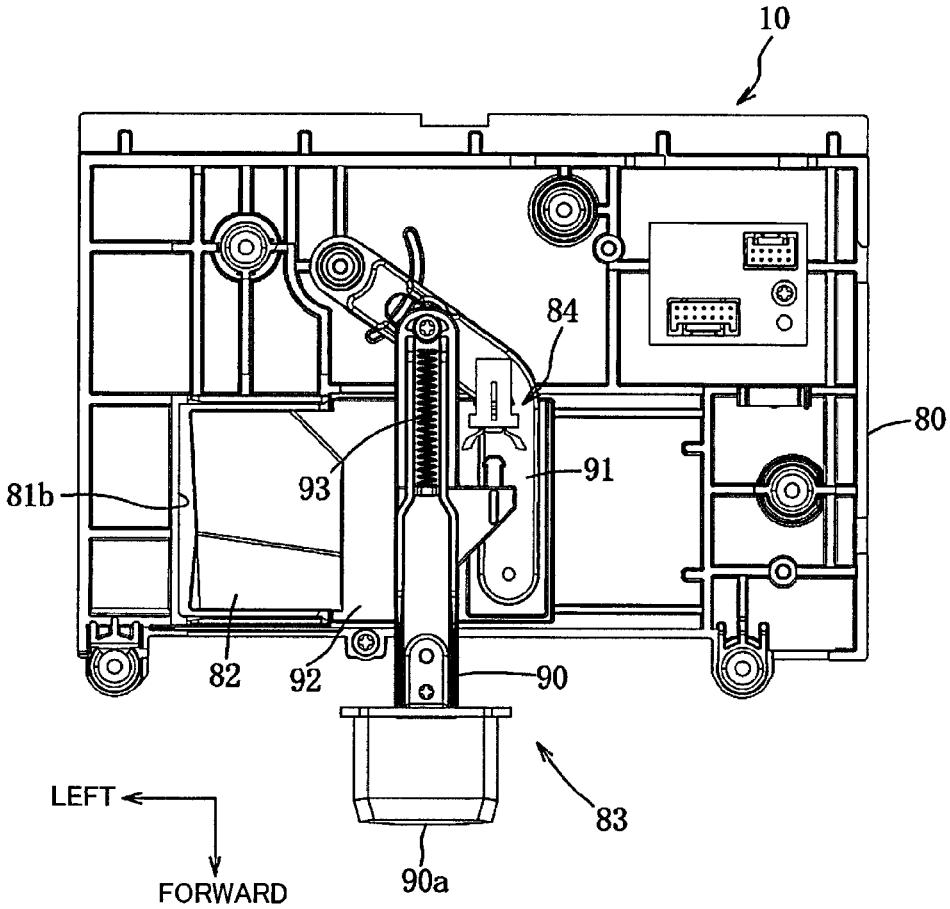
FIG. 27 is an exemplary plan view showing the discharge device.

Here the slot machine 100 shown in FIG. 27 has a configuration where the stop buttons 104 are provided to stop the reels 102 and the reels 102 are stopped by operating the stop buttons 104. However, another configuration is possible where the stop buttons 104 are omitted and the reels 102 automatically stop.

In addition, with the slot machine 100 shown in FIG. 62, the reels 102 may be replaced with an image display device such as a liquid crystal display device, organic electroluminescence panel and so forth.

Figure 63:
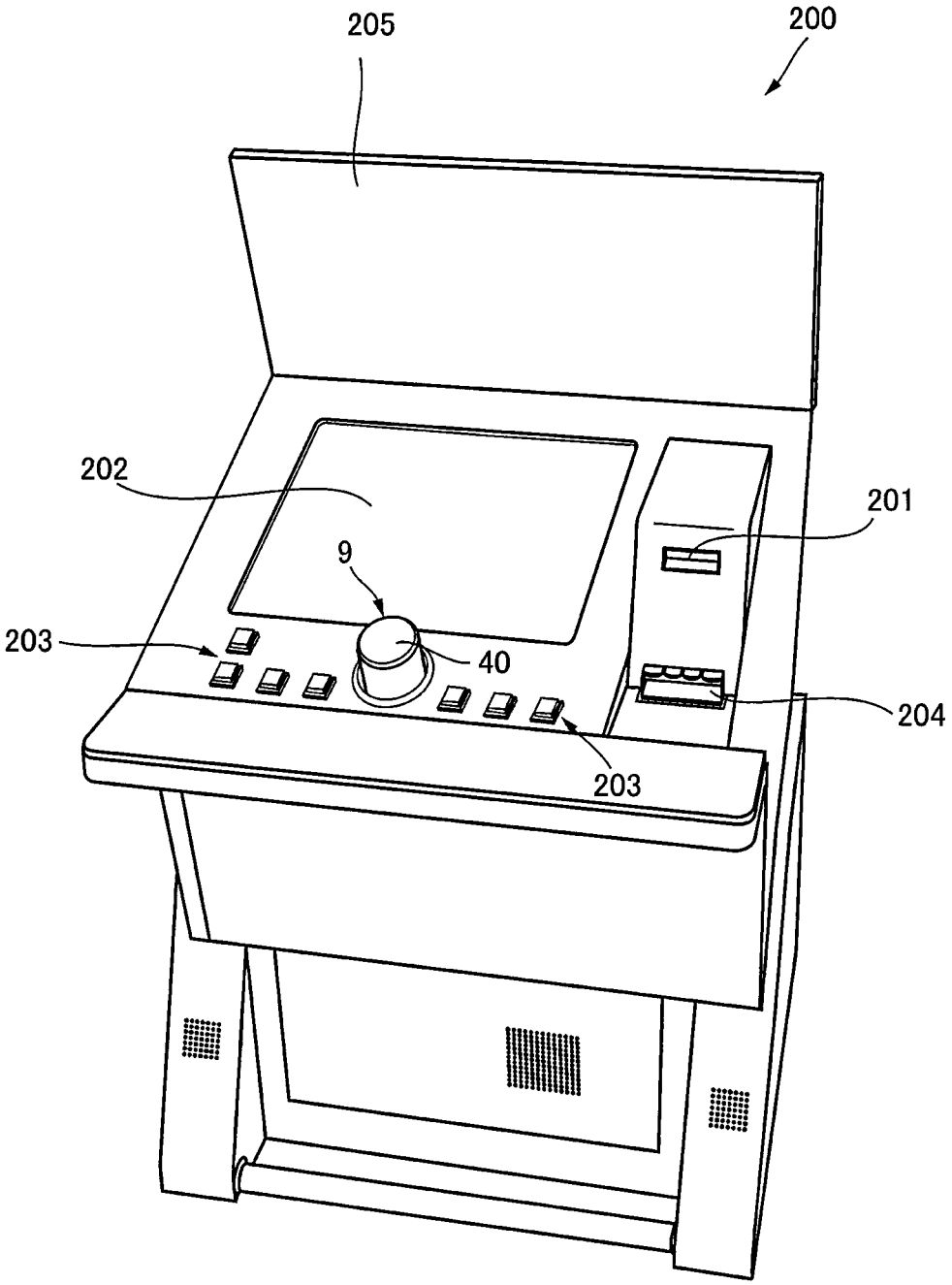
FIG. 63 is a perspective view showing a table game machine according to a variation.

FIG. 63 is a variation showing a table game machine 200 including the entertainment button device 9 according to the present invention.

As shown in FIG. 63, the table game machine 200 at least includes: the entertainment button device 9 having the entertainment button 40; a card slot 201 to insert cards, bills and so forth; an image display device 202 to perform card games such as poker, baccarat and so forth, or games on such as a slot machine; control buttons 203 to control various operations such as start, selection, end of a game and so forth; and a display panel 205 to inform the contents of games.

With this table game machine 200 for slot machine game, combined symbols stationarily displayed on the reel are equivalent to "assigned object", and the number of medals to be paid out and the number of free games are equivalent to "prize." Moreover, for card game, the combination of cards (for example, one pair and two pair in "poker") is equivalent to "assigned object" and the number of medals to be paid out is equivalent to "prize."

The player inserts bills and so forth into the card slot 201 and then plays a game performed on the image display device 202, operating the control buttons 203. Then, a predetermined number of cards, bills and so forth are paid out from the payout slit 204 based on the result of the game.

While the player plays a game with this table game machine 200, the entertainment button 40 is moved up and down between a predetermined normal operation position and the protruding position provided that a predetermined event occurs. By this means, it is possible to improve the effect of the entertainment of the game.

The invention claimed is:

1. A game machine comprising:

an entertainment button configured to be able to move up and down from a normal operation position to a protruding position in which the entertainment button protrudes upward from the normal operation position;

a display part configured to display characters associated with a game;

a character determining part configured to determine a character to be displayed on the display part;

a movement determining part configured to determine whether or not to move the entertainment button from the normal operation position to the protruding position;

a drive control part configured to perform drive control to move the entertainment button from the normal operation position to the protruding position, when the movement determining part determines to move the entertainment button from the normal operation position to the protruding position;

a push operation detecting part configured to detect the entertainment button being pushed down; and an enabling determining part configured to determine, when the push operation detecting part detects the entertainment button being pushed, whether or not to enable the detected push operation on the entertainment button, wherein:

the enabling determining part determines to disable the push operation on the entertainment button detected by the push operation detecting part before the entertainment button is held in the protruding position, when the movement determining part determines to move the entertainment button from the normal operation position to the protruding position;

the character determining part determines a predetermined character when the push operation detecting part detects the entertainment button being pushed down and also the enabling determining part determines to enable the push operation on the entertainment button; and when the character determining part determines the character, the display part displays the determined character.

2. The game machine according to claim 1, further comprising:

a stopper plate configured to hold the entertainment button in the protruding position; and a protruding position detecting part configured to detect the entertainment button being held in the protruding position by the stopper plate, wherein when the movement determining part determines to move the entertainment button from the normal operation position to the protruding position, the enabling determining part determines to disable the push operation on the entertainment button which is detected by the push operation detecting part until the protruding position detecting part detects the entertainment button being held in the protruding position.

3. The game machine according to claim 1, wherein the character determining part determines a character that is different from the predetermined character, when the protruding position detecting part detects the entertainment button being held in the protruding position.

4. The game machine according to claim 1, further comprising:

a button-up-and-down mechanism configured to move the entertainment button up and down from the normal operation position to the protruding position; and a base mounted on a lower part of the button-up-and-down mechanism, the button up-and-down mechanism including:

a cylindrical shaft member extending in a moving direction of the entertainment button;

a rotating mechanism configured to rotate the shaft member;

an annular member that can move between the stopper plate and the base, the entertainment button being attached to the annular member; and a bias member configured to bias the annular member to a direction in which the entertainment button moves up, wherein:

a convex part having an inverted trapezoid shape and a concave part having a trapezoid shape are formed on the shaft member;

a spiral guide part is formed at a boundary between the convex part and the concave part;

the annular member has an engagement part configured to engage with the spiral guide part; and when the rotating mechanism rotates the shaft member in a specific direction, the engagement part moves to an upper end of the shaft member, engaging with the spiral guide part, so that the entertainment button moves to the protruding position.

5. The game machine according to claim 4, wherein:

the protruding position detecting part includes a first protruding position detecting part and a second protruding position detecting part;

the first protruding position detecting part is provided on the stopper plate;

the second protruding position detecting part is provided on the annular member; and the protruding position detecting part detects the entertainment button being held in the protruding position when the first protruding position detecting part approaches the second protruding position detecting part.

6. The game machine according to claim 5, wherein:

the push operation detecting part includes a first push operation detecting part and a second push operation detecting part;

the first push operation detecting part is provided on the annular member;

the second push operation detecting part is provided on the base; and the push operation detecting part detects the entertainment button being pushed down when the first push operation detecting part approaches the second push operation detecting part.

7. The game machine according to claim 4, wherein:

the push operation detecting part includes a first push operation detecting part and a second push operation detecting part;

the first push operation detecting part is provided on the annular member;

the second push operation detecting part is provided on the base; and the push operation detecting part detects the entertainment button being pushed down when the first push operation detecting part approaches the second push operation detecting part.

* * * * *